US011487221B2

(12) United States Patent
Okino et al.

(10) Patent No.: US 11,487,221 B2
(45) Date of Patent: Nov. 1, 2022

(54) DEVELOPER SUPPLY CONTAINER AND DEVELOPER SUPPLYING SYSTEM

(71) Applicant: CANON KABUSHIKI KAISHA, Tokyo (JP)

(72) Inventors: Ayatomo Okino, Moriya (JP); Toshiaki Nagashima, Moriya (JP); Katsuya Murakami, Toride (JP); Fumio Tazawa, Kashiwa (JP); Yusuke Yamada, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/166,124

(22) Filed: Feb. 3, 2021

(65) Prior Publication Data

US 2021/0165345 A1 Jun. 3, 2021

Related U.S. Application Data

(60) Division of application No. 16/242,312, filed on Jan. 8, 2019, now Pat. No. 10,948,849, which is a division of application No. 14/737,646, filed on Jun. 12, 2015, now Pat. No. 10,191,412, which is a continuation of application No. 13/246,293, filed on Sep. 27, 2011,
(Continued)

(30) Foreign Application Priority Data

Mar. 30, 2009 (JP) ..... 2009-082077

(51) Int. Cl.
*G03G 15/08* (2006.01)

(52) U.S. Cl.
CPC ..... *G03G 15/0877* (2013.01); *G03G 15/0867* (2013.01)

(58) Field of Classification Search
USPC ..... 399/262
See application file for complete search history.

(56) References Cited

U.S. PATENT DOCUMENTS 3,951,539 A 4/1976 Draugelis
4,418,643 A 12/1983 Barto, Jr. et al.
(Continued)

FOREIGN PATENT DOCUMENTS

CN 1577158 A 2/2005
CN 1955860 A 5/2007
(Continued)

OTHER PUBLICATIONS

Mar. 10, 2021 Office Action in German Patent Application No. 11 2010 006 134.3 (with English translation).
(Continued)

*Primary Examiner* — Quana Grainger
(74) *Attorney, Agent, or Firm* — Venable LLP

(57) ABSTRACT

A toner cartridge includes a container accommodating toner and including a discharge opening. A pump is configured to alternately generate (i) a first air flow from outside to inside of the toner cartridge and (ii) a second air flow from inside to outside of the toner cartridge, with the pump being configured to supply the toner from the discharge opening to outside of the toner cartridge with the second air flow. The cartridge also includes a rotational force receiving portion configured to receive a rotational force from outside of the toner cartridge, with the rotational force receiving portion being configured to drive the pump with rotation of the rotational force receiving portion.

20 Claims, 68 Drawing Sheets

Related U.S. Application Data now Pat. No. 9,229,368, which is a continuation of application No. PCT/JP2010/056134, filed on Mar. 30, 2010.

(56) References Cited

U.S. PATENT DOCUMENTS

| | | | |
|---|---|---|---|
| 5,089,854 | A | 2/1992 | Kaieda et al. |
| 5,183,782 | A | 2/1993 | Onishi et al. |
| 5,235,354 | A | 8/1993 | Larson |
| 5,446,478 | A | 8/1995 | Larson |
| 5,794,107 | A | 8/1998 | Russell |
| 6,571,076 | B2 | 5/2003 | Kawahara et al. |
| 6,597,883 | B2 | 7/2003 | Muramatsu et al. |
| 7,043,179 | B2 | 5/2006 | Matsumoto et al. |
| 7,245,853 | B2 | 7/2007 | Muramatsu et al. |
| 7,542,704 | B2 | 6/2009 | Okuda et al. |
| 7,574,162 | B2 | 8/2009 | Yamane |
| 7,702,262 | B2 | 4/2010 | Taguchi et al. |
| 7,706,699 | B2 | 4/2010 | Taguchi et al. |
| 7,822,371 | B2 | 10/2010 | Taguchi et al. |
| 7,853,184 | B2 | 12/2010 | Taguchi et al. |
| 7,925,188 | B2 | 4/2011 | Senoh et al. |
| 7,991,334 | B2 | 8/2011 | Taguchi et al. |
| 8,060,003 | B2 | 11/2011 | Yoshizawa |
| 8,126,375 | B2 | 2/2012 | Taguchi et al. |
| 8,565,649 | B2 | 10/2013 | Murakami et al. |
| 8,577,277 | B2 | 11/2013 | Yoshizawa |
| 2003/0081967 | A1 | 5/2003 | Yoshizawa et al. |
| 2005/0025527 | A1 | 2/2005 | Matsumoto et al. |
| 2007/0077098 | A1 | 4/2007 | Katsuyama et al. |
| 2007/0086809 | A1 | 4/2007 | Yamane |
| 2007/0212119 | A1 | 9/2007 | Kurenuma et al. |
| 2008/0031657 | A1 | 2/2008 | Okuda et al. |
| 2008/0124133 | A1 | 5/2008 | Yoshizawa et al. |
| 2008/0226311 | A1 | 9/2008 | Senoh et al. |
| 2009/0010685 | A1 | 1/2009 | Makino |
| 2009/0162104 | A1 | 6/2009 | Wayman et al. |
| 2010/0296847 | A1 | 11/2010 | Kurenuma et al. |
| 2012/0014713 | A1 | 1/2012 | Murakami et al. |

FOREIGN PATENT DOCUMENTS

| | | | |
|---|---|---|---|
| CN | 101103316 | A | 1/2008 |
| CN | 101118404 | A | 2/2008 |
| EP | 1 921 512 | A2 | 5/2008 |
| JP | 63-006464 | U | 1/1988 |
| JP | 2-005770 | | 1/1990 |
| JP | 4-143781 | A | 5/1992 |
| JP | 4-505899 | T | 10/1992 |
| JP | 6-055157 | U | 7/1994 |
| JP | 08-185208 | A | 7/1996 |
| JP | 9-222795 | A | 8/1997 |
| JP | 10-063078 | A | 3/1998 |
| JP | 276389 | B2 | 6/1998 |
| JP | H10-319694 | A | 12/1998 |
| JP | H11-237789 | A | 8/1999 |
| JP | 2001-175064 | A | 6/2001 |
| JP | 2002-072649 | A | 3/2002 |
| JP | 2006-047811 | A | 2/2006 |
| JP | 2007-025625 | A | 2/2007 |
| JP | 2007-058034 | A | 3/2007 |
| JP | 2008-257213 | A | 10/2008 |
| JP | 2008-309858 | A | 12/2008 |
| JP | 2009-008698 | A | 1/2009 |
| JP | 2009-020302 | A | 1/2009 |
| KR | 10-2007-0085096 | A | 8/2007 |
| RU | 2 210 387 | C1 | 10/1998 |
| RU | 2 367 016 | C2 | 9/2009 |
| TW | I550368 | B | 9/2016 |
| UA | 023129 | A | 6/1998 |
| WO | 90/14960 | A1 | 12/1990 |
| WO | 2006/075798 | A1 | 7/2006 |

OTHER PUBLICATIONS

Jul. 6, 2021 Extended Search Report in European Patent Application No. 21168594.6.

Taiwan Office Action dated Nov. 15, 2016, in related Taiwan Patent Application No. 10521406820.

Mar. 6, 2017 Search and Examination Report in United Arab Emirates Patent Application No. 0985/2011.

Jul. 27, 2017 Office Action in Australian Patent Application No. 2016216686.

Aug. 14, 2017 Communication in European Patent Application No. 10 758 918.6.

Aug. 16, 2017 Communication in European Patent Application No. 15 173 072.8.

Office Action in Korean Patent Application No. 10-2015-7008293, dated Jul. 4, 2018.

Office Action in Korean Patent Application No. 10-2015-7008294, dated Jul. 4, 2018.

Decision on Grant in Russian Patent Application No. 2017111211, dated Mar. 6, 2018 (with English translation).

Apr. 25, 2018 Office Action in Taiwanese Patent Application No. 10612123.

Nov. 27, 2017 Office Action in Vietnamese Patent Application No. 1-2016-04480 (with English translation).

Dec. 4, 2017 Office Action in Chinese Patent Application No. 201410397848.2 (with English translation).

Dec. 29, 2017 Office Action in Chinese Patent Application No. 201410397852.9 (with English translation).

Dec. 29, 2017 Office Action in Chinese Patent Application No. 20140398210.0 (with English translation).

Dec. 29, 2017 Office Action in Chinese Patent Application No. 201410398228.0 (with English translation).

Dec. 29, 2017 Office Action in Chinese Patent Application No. 201410398645.5 (with English translation).

Dec. 26, 2017 Office Action in Indian Patent Application No. 7038/CHENP/2011.

Jun. 28, 2016 Office Action in Japanese Patent Application No. 2015-197972.

Aug. 29, 2017 Office Action in Japanese Patent Application No. 2016-242525.

English translation of Japanese Patent Application Laid-Open No. 8-185028.

Russian Notice of Allowance dated Dec. 7, 2016, in related Russian Patent Application No. 2015137323/28 (with English translation).

Korean Office Action dated Apr. 12, 2016, in corresponding Korean Patent Application No. 9-5-2016-026476660.

Japanese Office Action dated Aug. 4, 2015, in Japanese Patent Application No. 2014-189088.

Japanese Office Action dated Jul. 31, 2015, in Japanese Patent Application No. 2014-189088 (with partial English translation).

Russian Decision on Grant dated May 29, 2015, in related Russian Patent Application No. 201143798 (with English translation).

German Office Action dated Nov. 2, 2015, in corresponding German Patent Application No. 11 2010 001 464.7.

Aug. 18, 2020 Office Action in Brazilian Patent Application No. BR122015017781-2 (with English translation).

International Search Report dated Apr. 27, 2010, in International Application No. PCT/JP2010/056133.

Patent Examination Report No. 1 dated Aug. 16, 2012, in Australian Application No. 2010232165.

Decision on Grant—Patent for Invention dated Sep. 17, 2012, in Ukrainian Application No. 201112687.

Official Action dated Dec. 4, 2012, in Ukrainian Application No. 2011 12684.

Notification of the First Office Action (PCT Application in the National Phase) dated Dec. 5, 2012, forwarding a Search Report, in Chinese Application No. 201080022874.7.

Communication dated Dec. 12, 2012, forwarding a Supplemental European Search Report dated Dec. 4, 2012, in European Application No. 10758917.8-2216/2416222.

Communication dated Dec. 12, 2012, forwarding a Supplemental European Search Report dated Nov. 29, 2012, in European Application No. 10758918.6-2216/2416223.

(56) References Cited

OTHER PUBLICATIONS

Notification of the First Office Action (PCT Application in the National Phase) dated Jan. 16, 2013, in Chinese Application No. 201080014943.X.
Russian Office Action dated May 21, 2014, in related Russian Patent Application No. 2011143798.
Japanese Office Action issued in Japanese Patent Application No. 2010-078294 dated Mar. 4, 2014.
Apr. 29, 2019 Office Action in Taiwanese Patent Application No. 107132006.
Mar. 18, 2019 Office Action in Russian Patent Application No. 2018118791 (with English translation).
Jul. 15, 2019 Office Action in Korean Patent Application No. 10-2019-7014392.
Jun. 11, 2019 Examination Report in Australian Patent Application No. 2018523609.
Jul. 14, 2020 Office Action in Brazilian Patent Application No. PI101473-4 (with English translation).
Computer translation of Japanese Patent Application Pub. No. H04-143781 A.
Jul. 3, 2019 Examination Report in United Arab Emirates Patent Application No. UAE/P/0985/2011.
Office Action in Brazilian Patent Application No. 122015017781-2, dated Sep. 3, 2019 (with partial English translation).

(a)

(b)

(a)

(b)

(a)

(b)

(a)

(b)

(a)

(b)

(c)

(a)

(b)

(a)

(b)

DEVELOPER SUPPLY CONTAINER AND DEVELOPER SUPPLYING SYSTEM

FIELD OF THE INVENTION

The present invention relates to a developer supply container detachably mountable to a developer replenishing apparatus and to a developer supplying system including them. The developer supply container and the developer supplying system are used with an image forming apparatus such as a copying machine, a facsimile machine, a printer or a complex machine having functions of a plurality of such machines.

BACKGROUND ART

Conventionally, an image forming apparatus of an electrophotographic type such as an electrophotographic copying machine uses a developer of fine particles. In such an image forming apparatus, the developer is supplied from the developer supply container in response to consumption thereof resulting from image forming operation.

As for the conventional developer supply container, an example is disclosed in Japanese Laid-Open Utility Model Application Sho 63-6464.

In the apparatus disclosed in Japanese Laid-Open Utility Model Application Sho 63-6464, the developer is let fall all together into the image forming apparatus from the developer supply container. More particularly, in the apparatus disclosed in Japanese Laid-Open Utility Model Application Sho 63-6464, a part of the developer supply container is formed into a bellow-like portion so as to permit all of the developer can be supplied into the image forming apparatus from the developer supply container even when the developer in the developer supply container is caked. More particularly, in order to discharge the developer caked in the developer supply container into the image forming apparatus side, the user pushes the developer supply container several times to expand and contract (reciprocation) the bellow-like portion.

Thus, with the apparatus disclosed in Japanese Laid-Open Utility Model Application Sho 63-6464, the user has to manually operate the bellow-like portion of the developer supply container.

On the other hand, Japanese Laid-open Patent Application 2002-72649 employs a system in which the developer is automatically sucked from the developer supply container into the image forming apparatus using a pump. More particularly, a suction pump and an air-supply pump are provided in the main assembly side of the image forming apparatus, and nozzles having a suction opening and an air-supply opening, respectively are connected with the pumps and are inserted into the developer supply container (Japanese Laid-open Patent Application 2002-72649, FIG. 5). Through the nozzles inserted into the developer supply container, an air-supply operation into the developer supply container and a suction operation from the developer supply container are alternately carried out. Japanese Laid-open Patent Application 2002-72649 states that when the air fed into the developer supply container by the air-supply pump passes through the developer layer in the developer supply container, the developer is fluidized.

Thus, in the device disclosed in Japanese Laid-open Patent Application 2002-72649, the developer is automatically discharged, and therefore, the load in operation imparted to the user is reduced, but the following problems may arise.

More particularly, in the device disclosed in Japanese Laid-open Patent Application 2002-72649, the air is fed into the developer supply container by the air-supply pump, and therefore, the pressure (internal pressure) in the developer supply container rises.

With such a structure, even if the developer is temporarily scattered when the air fed into the developer supply container passes through the developer layer, the developer layer results in being packed again by the rise of the internal pressure of the developer supply container by the air-supply.

Therefore, the flowability of the developer in the developer supply container decreases, and in the subsequent suction step, the developer is not easily discharged from the developer supply container, with the result of shortage of the developer amount supplied.

DISCLOSURE OF THE INVENTION

Accordingly, it is an object of the present invention to provide a developer supply container and a developer supplying system in which an internal pressure of a developer supply container is made negative, so that the developer in the developer supply container is appropriately loosened.

It is another object of the present invention to provide a developer supply container and a developer supplying system in which the developer in a developer supply container can be loosened properly by a suction operation through a discharge opening of the developer supply container by a pump portion It is a further object of the present invention to provide a developer supply container and a developer supplying system in which a air flow generating mechanism alternately and repeatedly producing a inward air flow through a pin hole and an outward air flow by which the developer in the developer supply container can be properly loosened According to an aspect of the present invention (first invention), there is provided a developer supply container detachably mountable to a developer replenishing apparatus, said developer supply container comprising a developer accommodating portion for accommodating a developer; a discharge opening for permitting discharging of the developer from said developer accommodating portion; a drive inputting portion for receiving a driving force from said developer replenishing apparatus; and a pump portion capable of being driven by the driving force received by said drive inputting portion to alternating an internal pressure of said developer accommodating portion between a pressure lower than an ambient pressure and a pressure higher than the ambient pressure.

According to another aspect of the present invention (second invention), there is provided a developer supplying system comprising a developer replenishing apparatus, a developer supply container detachably mountable to said developer replenishing apparatus, said developer supplying system comprising said developer replenishing apparatus including a mounting portion for demountably mounting said developer supply container, a developer receiving portion for receiving the developer from said developer supply container, a driver for applying a driving force to said developer supply container; said developer supply container including a developer accommodating portion accommodating developer, a discharge opening for permitting discharging of the developer from said developer accommodating portion toward said developer receiving portion, a drive inputting portion, engageable with said driver, for receiving the driving force, a pump portion for alternately changing an internal pressure of said developer accommodating portion between a pressure higher than an ambient pressure and a pressure lower than the ambient pressure.

According to a further aspect of the present invention (third invention), there is provided a developer supply container detachably mountable to a developer replenishing apparatus, said developer supply container comprising a developer accommodating portion for accommodating a developer; a discharge opening for permitting discharging of the developer from said developer accommodating portion; a drive inputting portion for receiving a driving force from said developer replenishing apparatus; and a pump portion capable of being driven by the driving force received by said drive inputting portion to alternately repeat suction and delivery actions through said discharge opening.

According to a further aspect of the present invention (fourth invention), there is provided a developer supplying system comprising a developer replenishing apparatus, a developer supply container detachably mountable to said developer replenishing apparatus, said developer supplying system comprising said developer replenishing apparatus including a mounting portion for demountably mounting said developer supply container, a developer receiving portion for receiving a developer from said developer supply container, a driver for applying a driving force to said developer supply container; said developer supply container including a developer accommodating portion for accommodating the developer, a discharge opening for permitting discharging of the developer from said developer accommodating portion toward said developer receiving portion, a drive inputting portion for receiving the driving force, a pump portion for alternately repeating suction and delivery actions through said discharge opening.

According to a further aspect of the present invention (fifth invention), there is provided a developer supply container detachably mountable to a developer replenishing apparatus, said developer supply container comprising a developer accommodating portion for accommodating a developer having a fluidity energy of not less than $4.3\times10^{-4}$ $kg\cdot cm^2/s^2$ and not more than $4.14\times10^{-3}$ $kg\cdot cm^2/s^2$; a pin hole for permitting discharge of the developer out of said developer accommodating portion, said discharge opening having an area not more than 12.6 $mm^2$; a drive inputting portion for receiving a driving force from said developer replenishing apparatus; an air flow generating mechanism for generating repeated and alternating inward and outward air flow through the pin hole.

According to a further aspect of the present invention (sixth invention), there is provided a developer supplying system comprising a developer replenishing apparatus, a developer supply container detachably mountable to said developer replenishing apparatus, said developer supplying system comprising said developer replenishing apparatus including a mounting portion for demountably mounting said developer supply container, a developer receiving portion for receiving a developer from said developer supply container, a driver for applying a driving force to said developer supply container; said developer supply container including a developer accommodating portion for accommodating the developer having a fluidity energy of not less than $4.3\times10^{-4}$ $kg\cdot cm^2/s^2$ and not more than $4.14\times10^{-3}$ $kg\cdot cm^2/s^2$; a pin hole for permitting discharge of the developer out of said developer accommodating portion, said discharge opening having an area not more than 12.6 $mm^2$; a drive inputting portion for receiving a driving force from said developer replenishing apparatus; an air flow generating mechanism for generating repeated and alternating inward and outward air flow through the pin hole.

These and other objects, features and advantages of the present invention will become more apparent upon a consideration of the following description of the preferred embodiments of the present invention taken in conjunction with the accompanying drawings.

Figure 12:
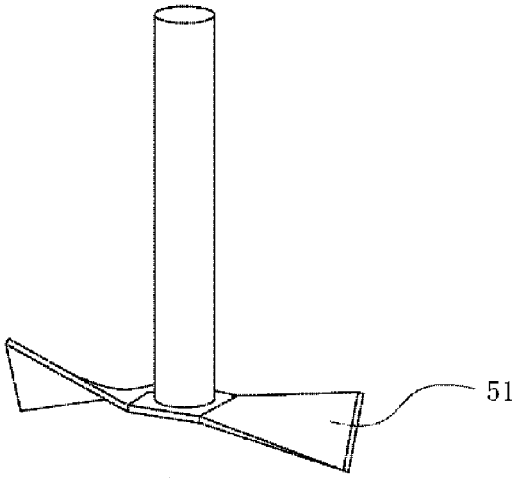
Figure 12:
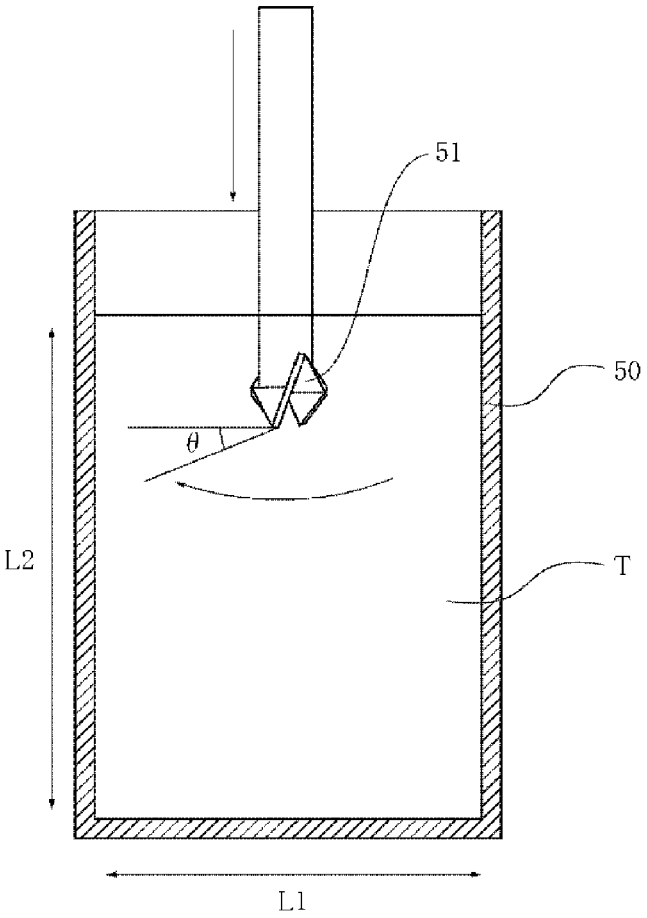

Part (a) of FIG. 12 is a perspective view of a blade used in a device for measuring flowability energy, and (b) is a schematic view of a measuring device.

Figure 13:
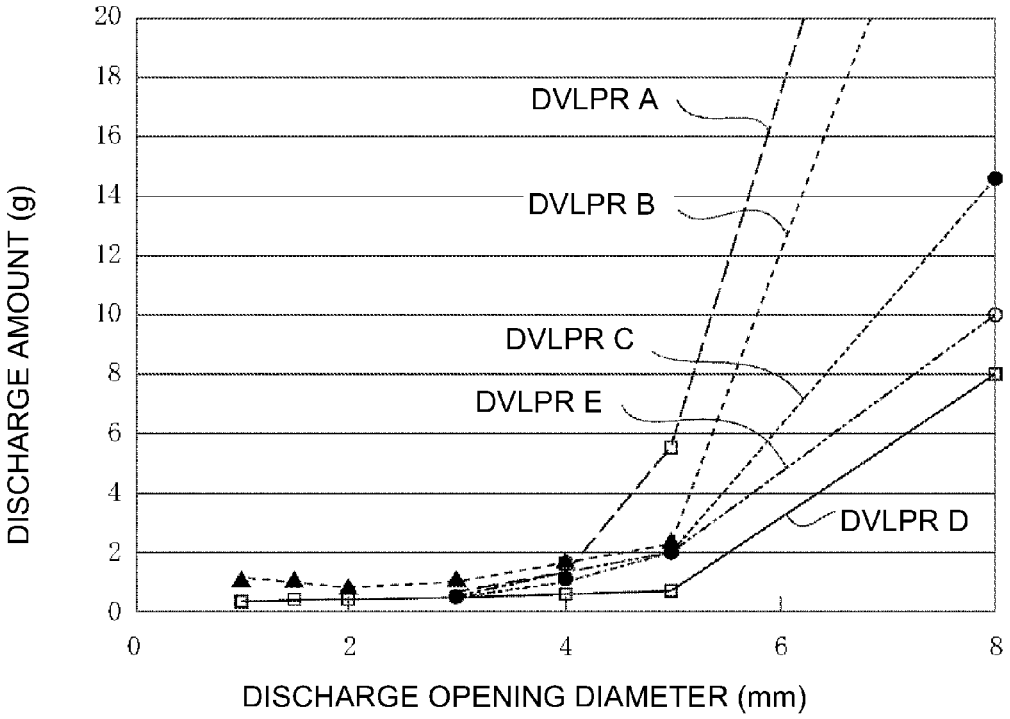

FIG. 13 is a graph showing a relation between a diameter of the discharge opening and a discharge amount.

Figure 14:
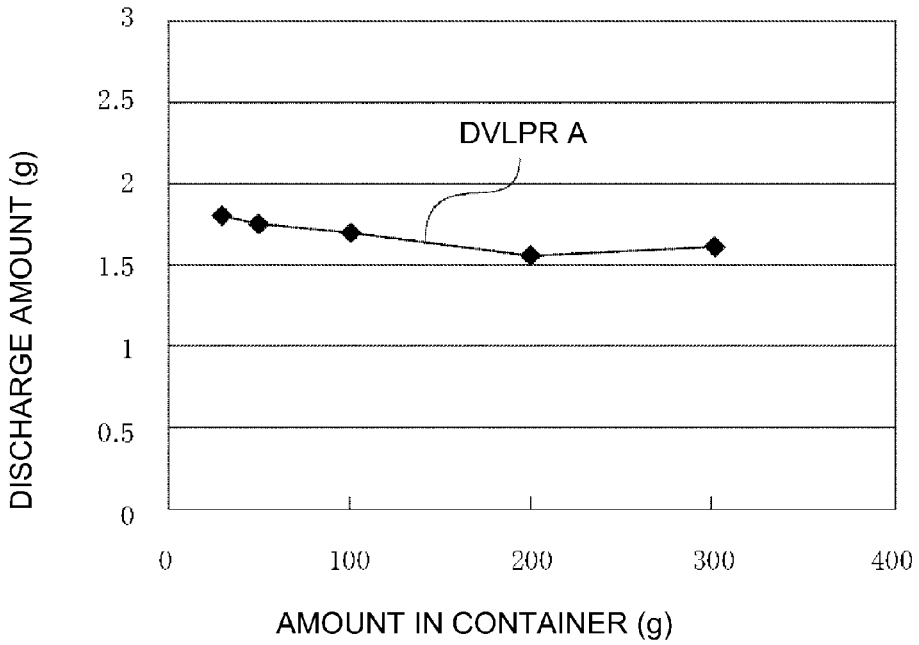

FIG. 14 is a graph showing a relation between an amount filled in the container and a discharge amount.

Figure 15:
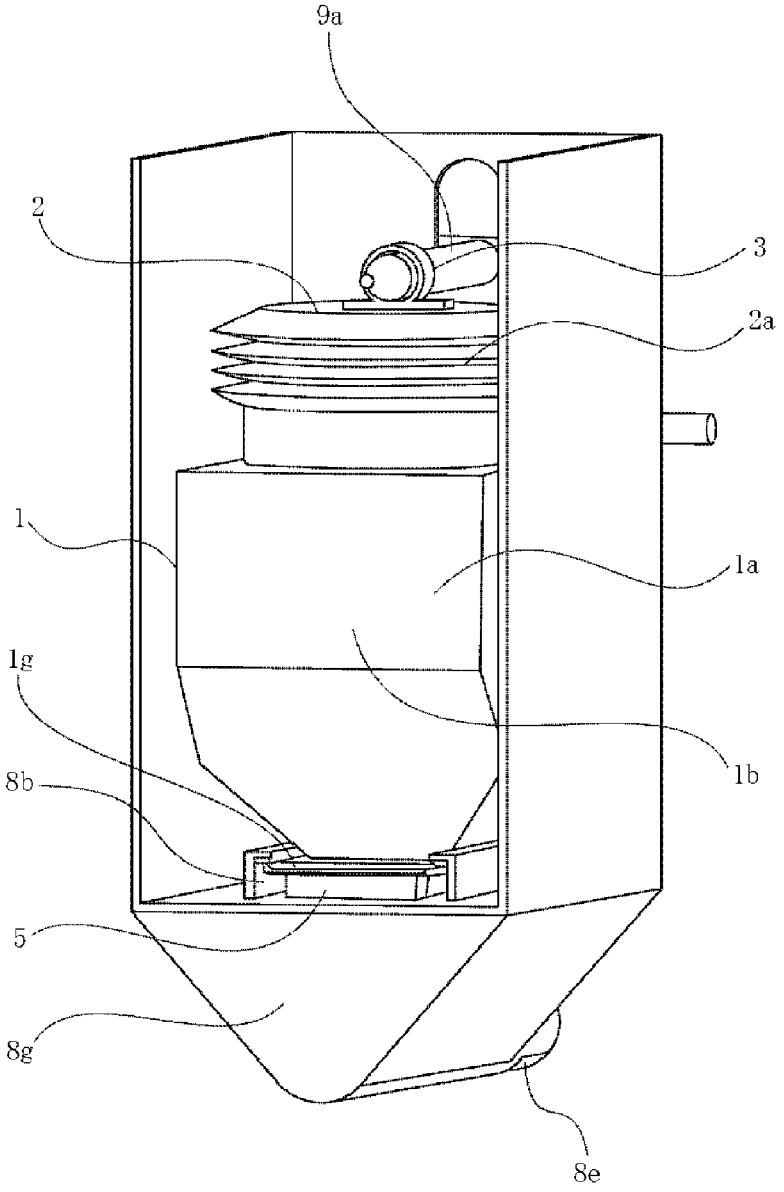

FIG. 15 is a perspective view illustrating parts of operation states of the developer supply container and the developer replenishing apparatus.

Figure 16:
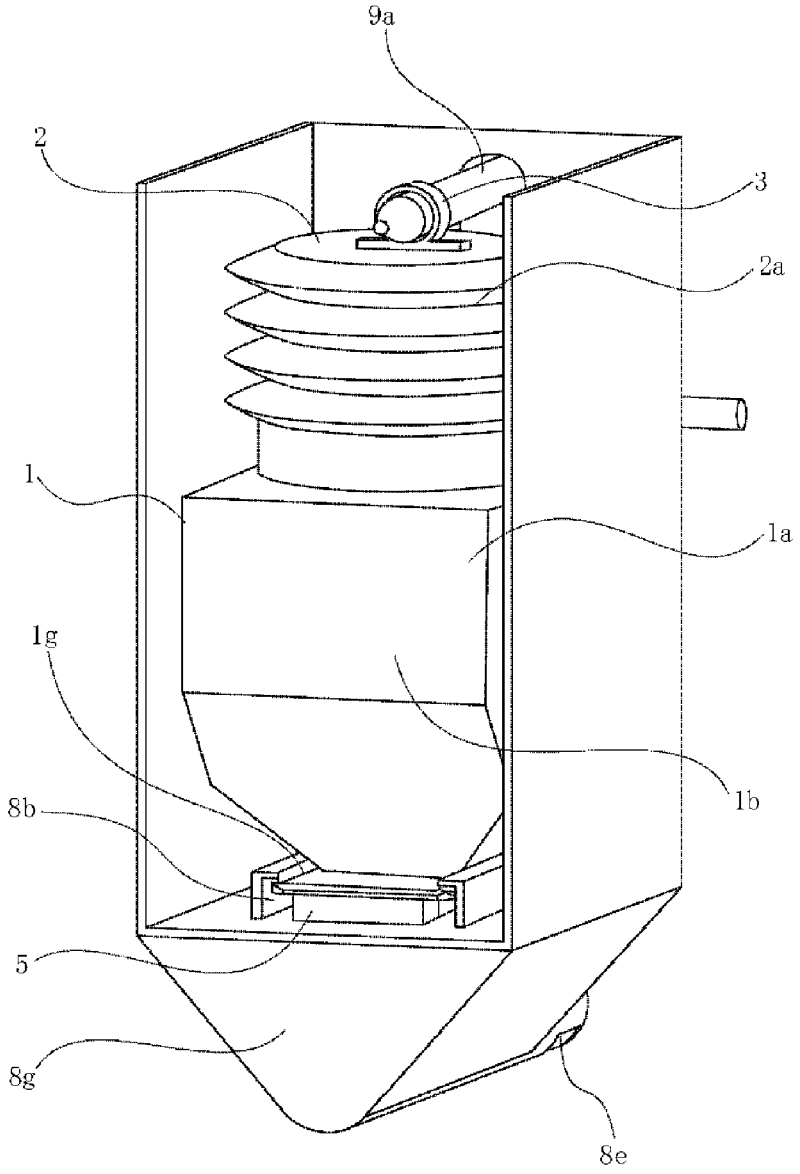

FIG. 16 is a perspective view illustrating the developer supply container and the developer replenishing apparatus.

Figure 17:
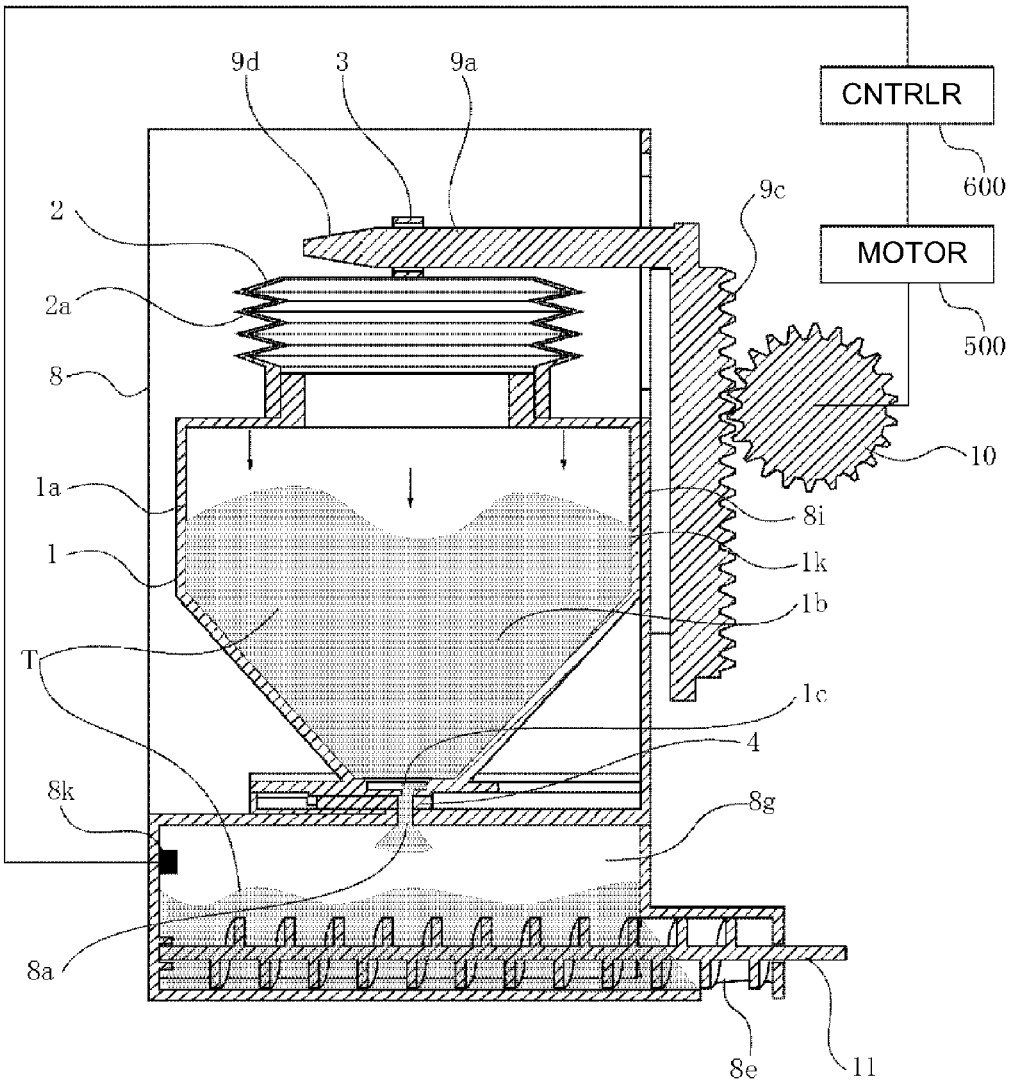

FIG. 17 is a sectional view illustrating the developer supply container and the developer replenishing apparatus.

Figure 18:
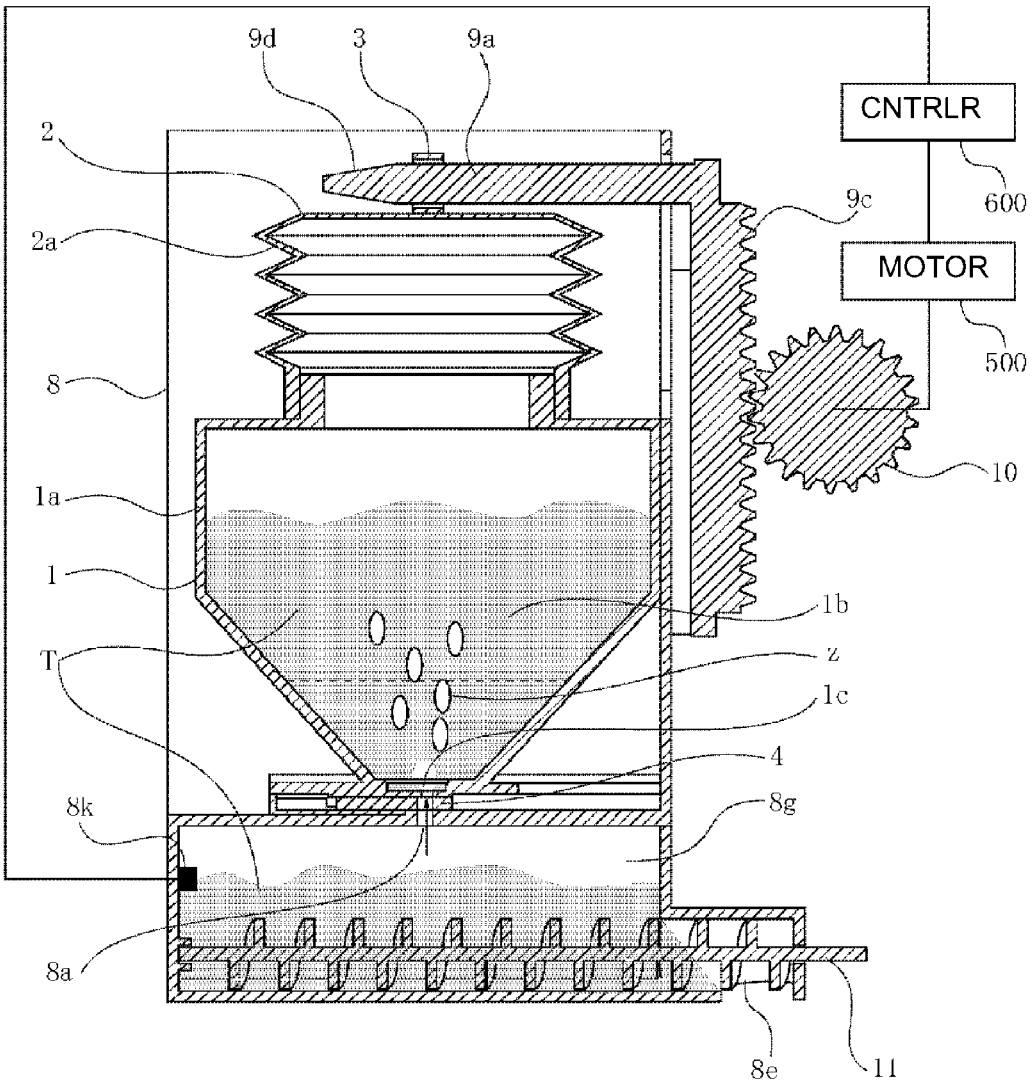

FIG. 18 is a sectional view illustrating the developer supply container and the developer replenishing apparatus.

Figure 19:
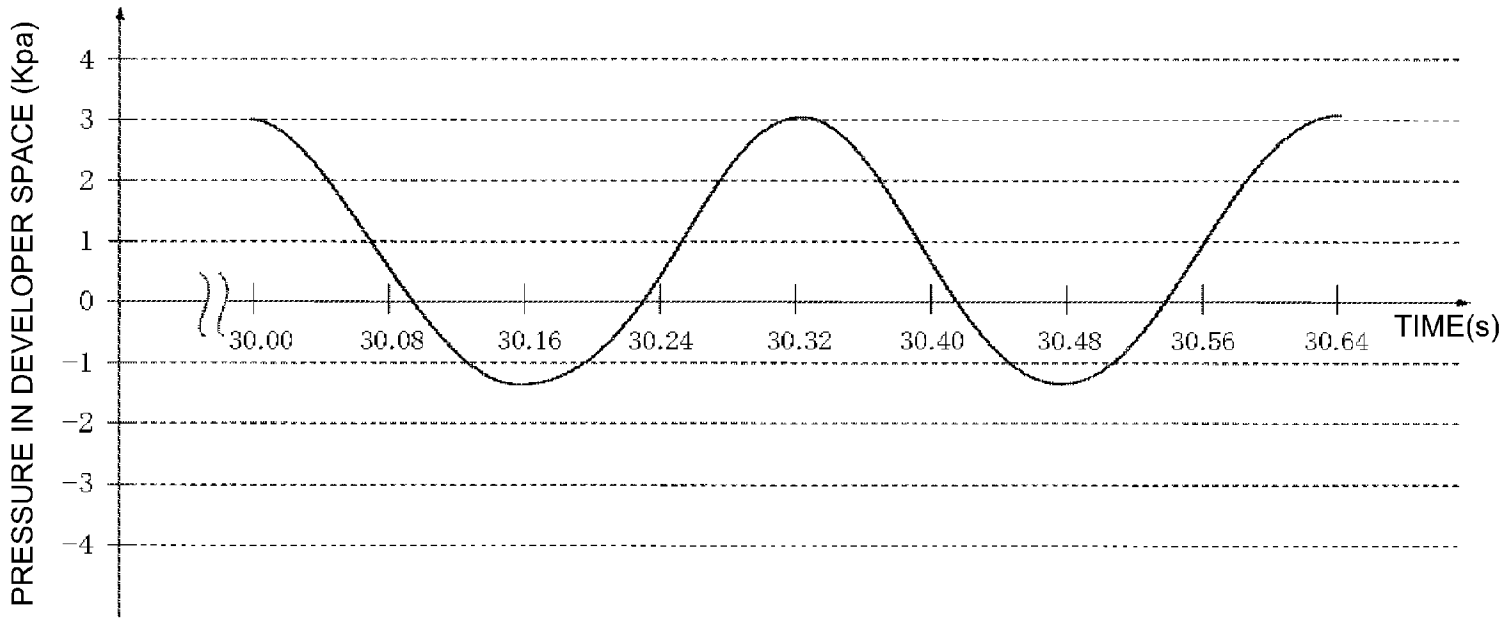

FIG. 19 illustrates a change of an internal pressure of the developer accommodating portion in the apparatus and the system of the present invention.

Figure 20:
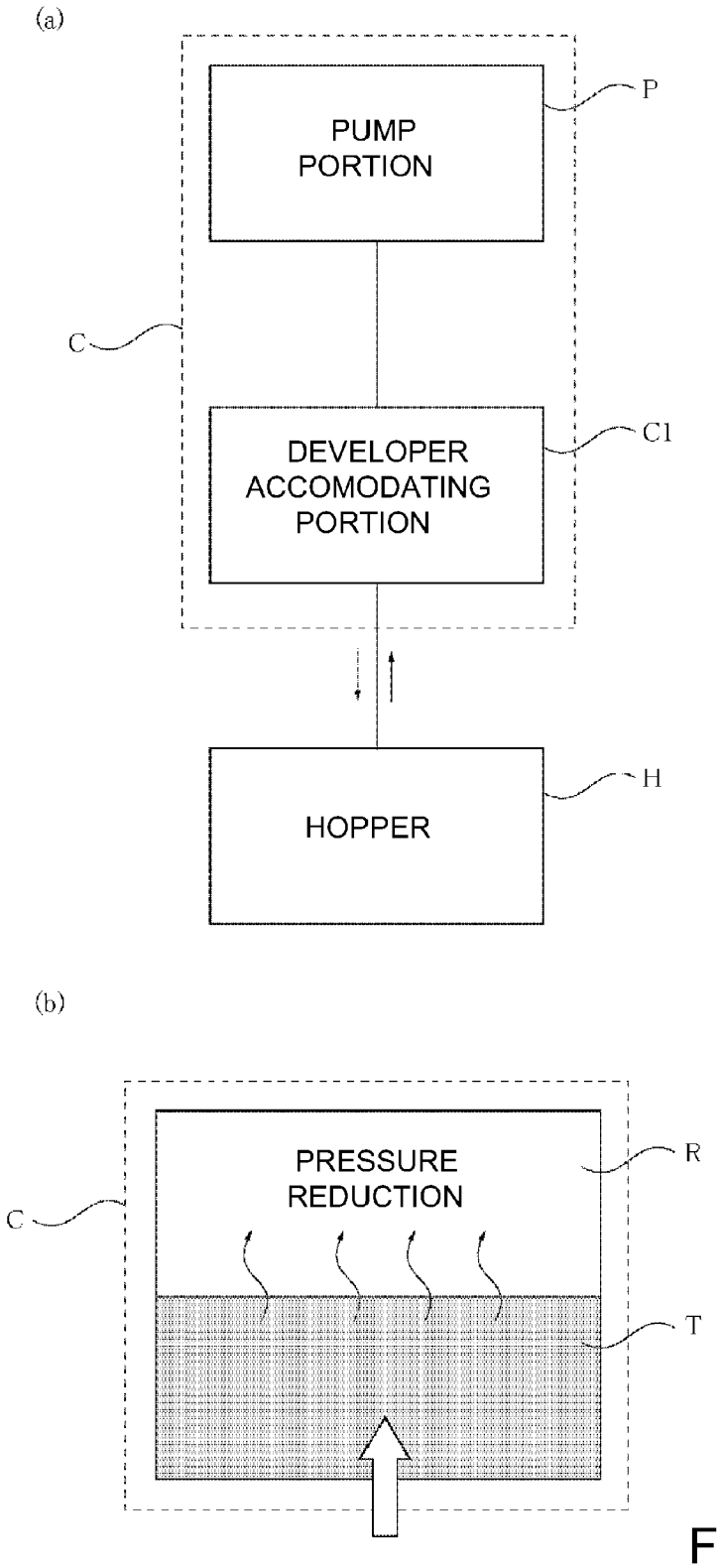

Part (a) of FIG. 20 is a block diagram illustrating a developer supplying system (Embodiment 1) using in the verification experiment, and (b) is a schematic view illustrating phenomenon—in the developer supply container.

Figure 21:
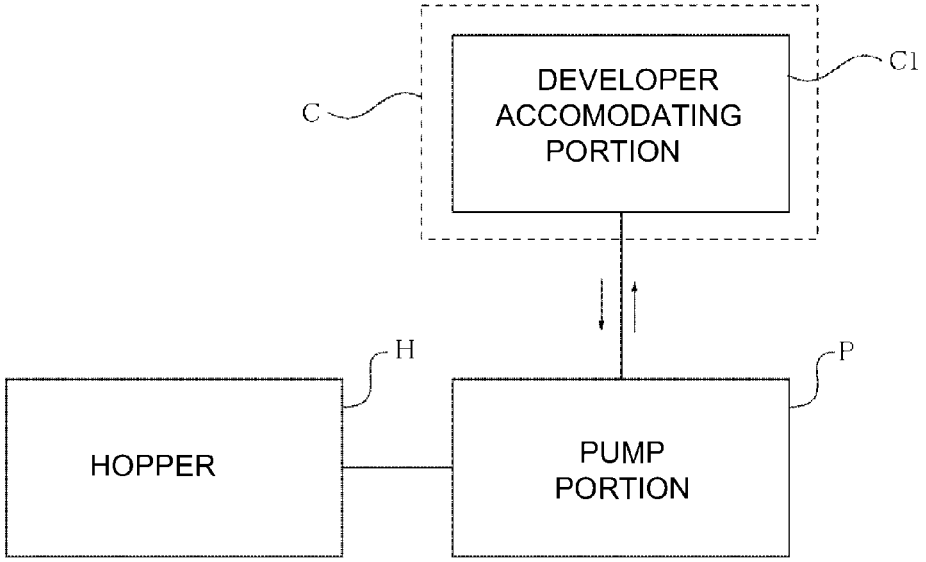
Figure 21:
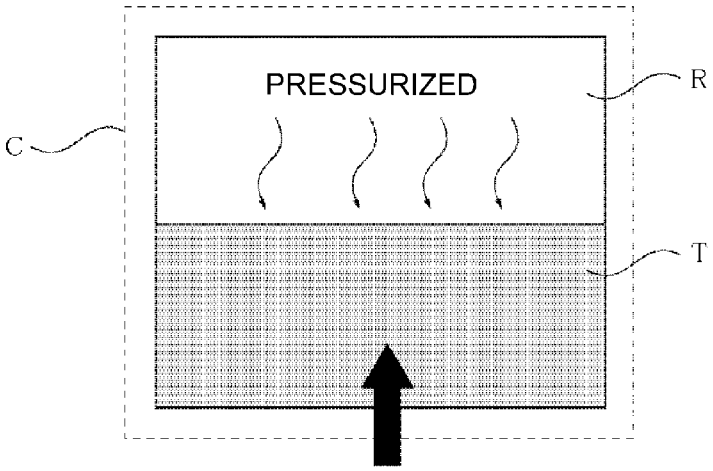

Part (a) of FIG. 21 is a block diagram illustrating a developer supplying system the comparison example) used in the verification experiment, and (b) is a schematic view illustrating phenomenon—in the developer supply container.

Figure 22:
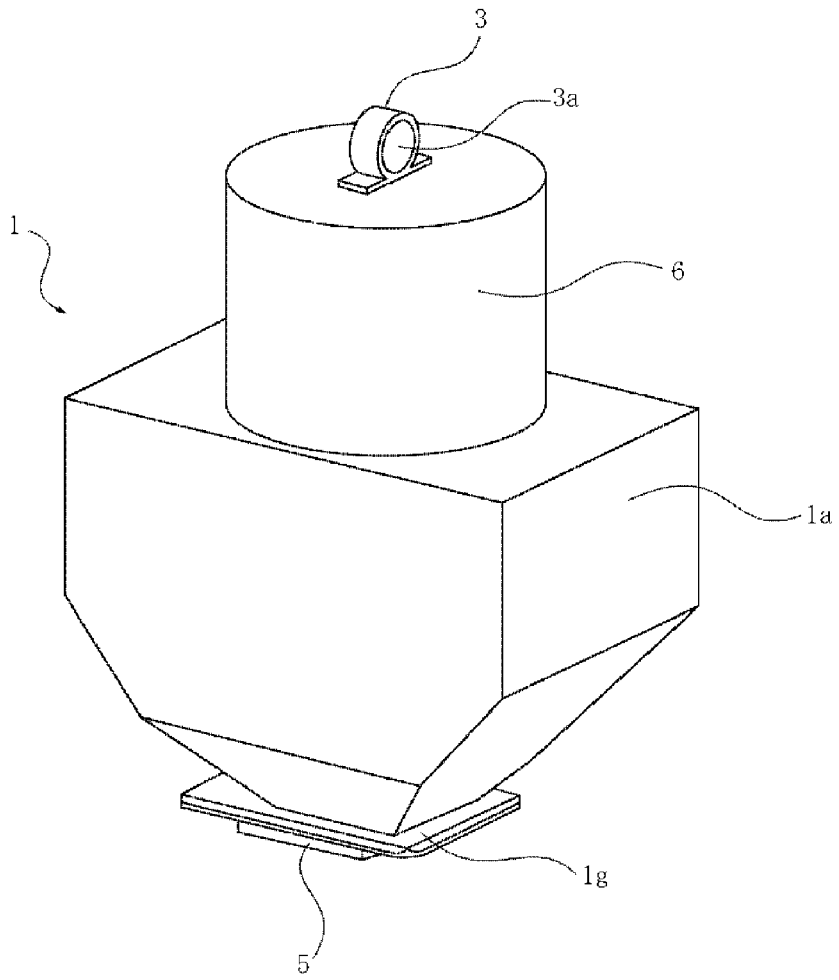

FIG. 22 is a perspective view illustrating a developer supply container according to Embodiment 2.

Figure 23:
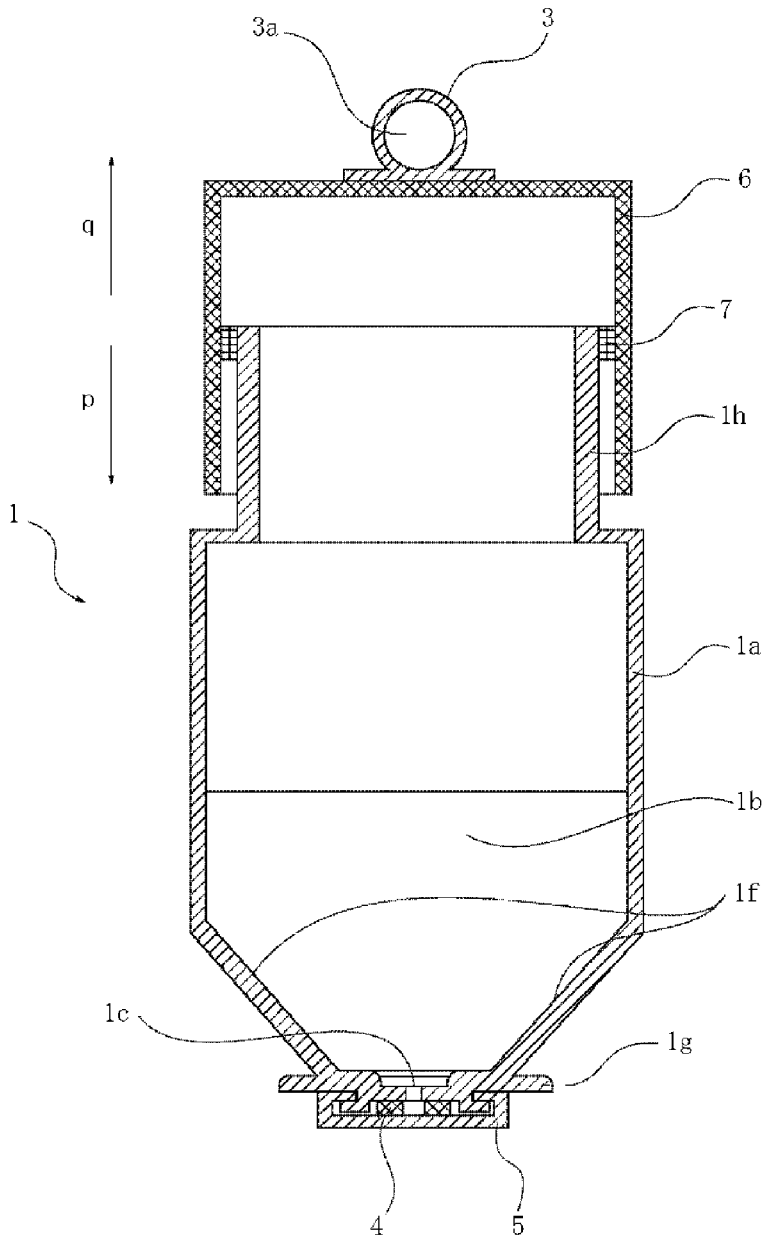

FIG. 23 is a sectional view of the developer supply container of FIG. 22.

Figure 24:
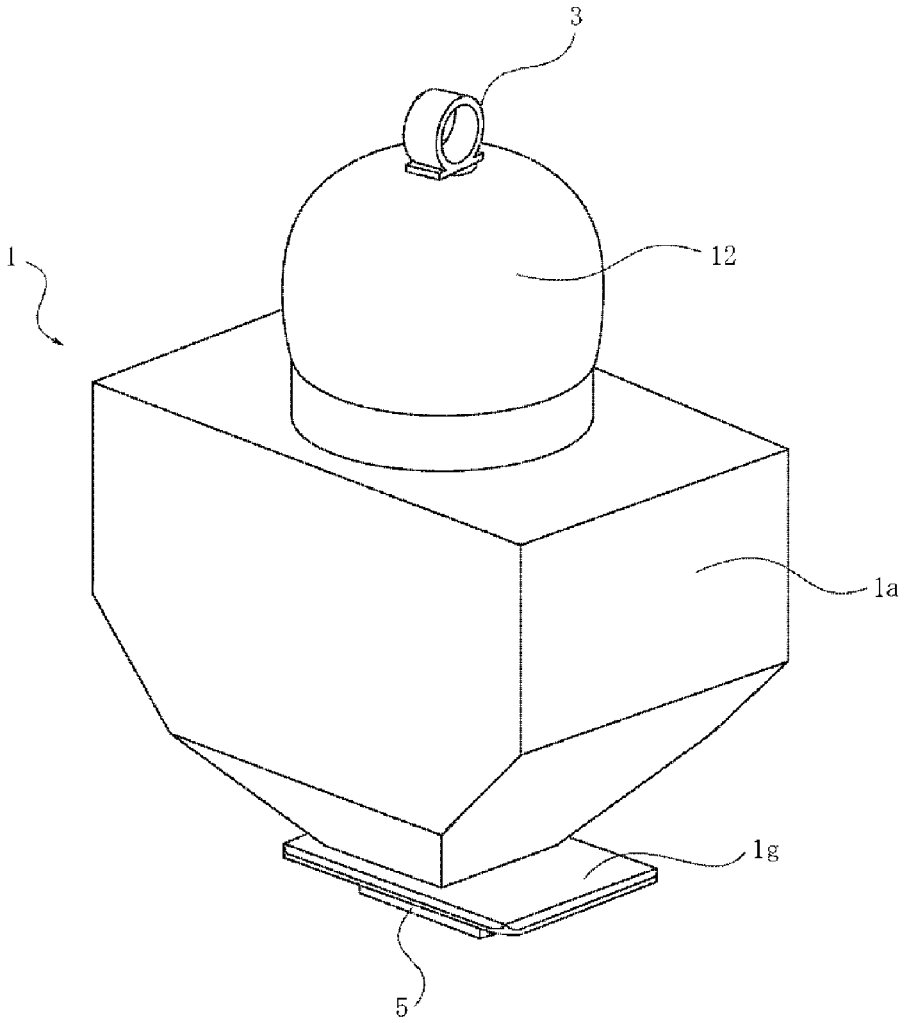

FIG. 24 is a perspective view illustrating a developer supply container according to Embodiment 3.

Figure 25:
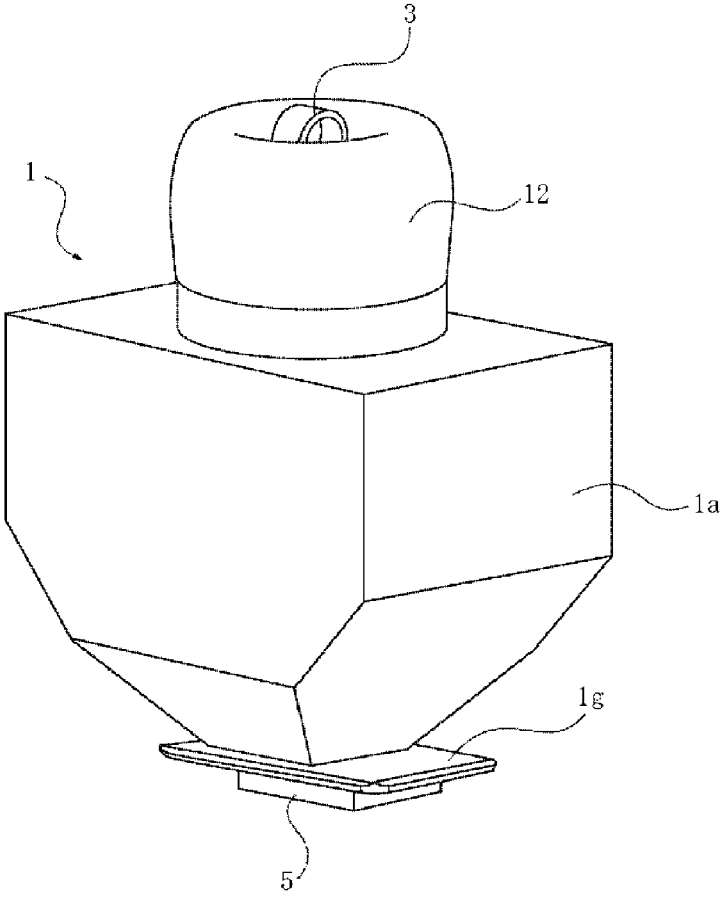

FIG. 25 is a perspective view illustrating a developer supply container according to Embodiment 3.

Figure 26:
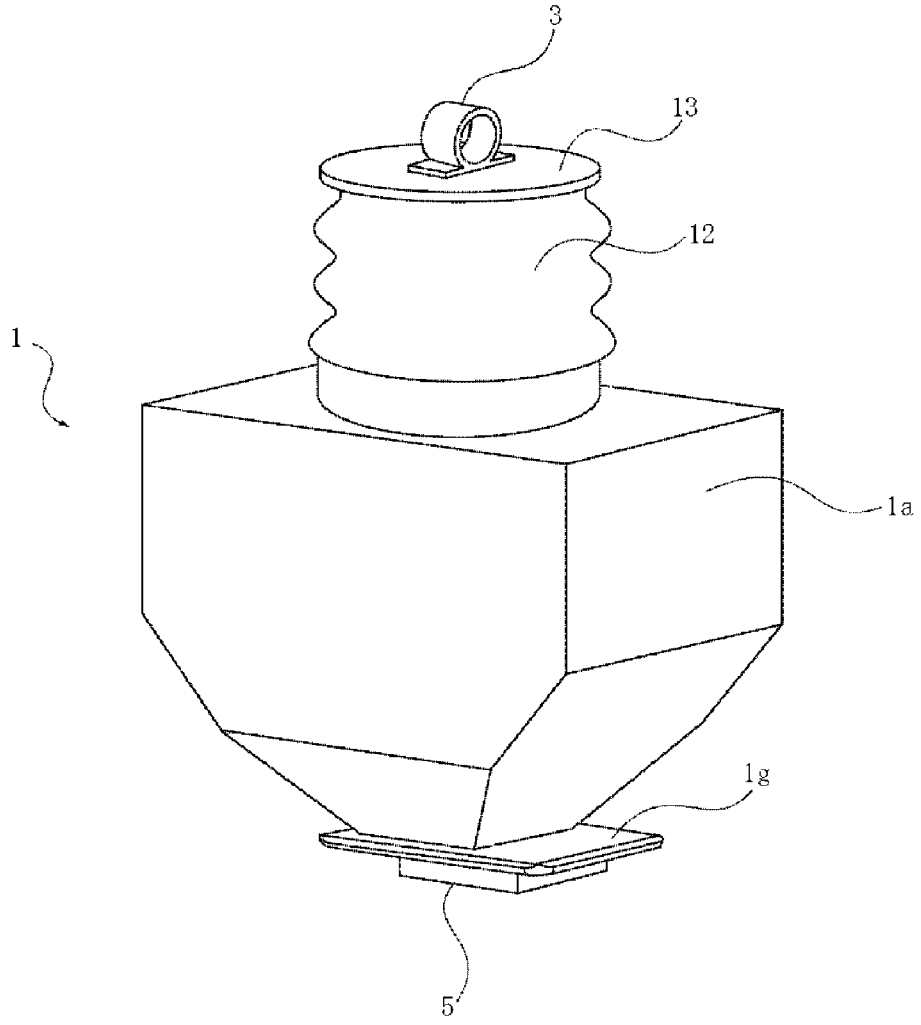

FIG. 26 is a perspective view illustrating a developer supply container according to Embodiment 3.

Figure 27:
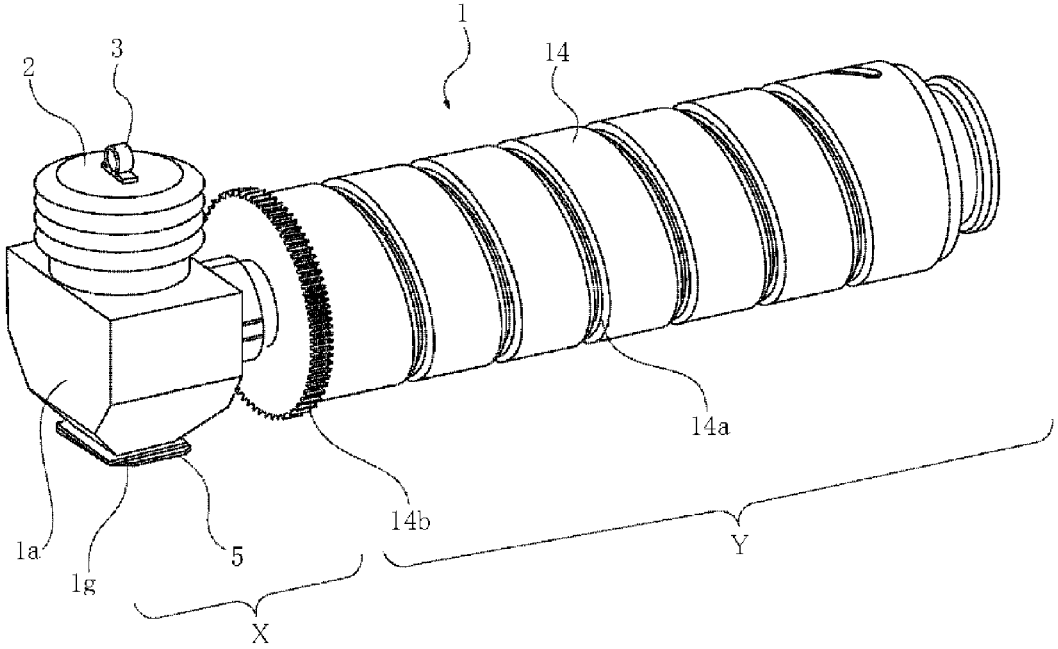

FIG. 27 is a perspective view illustrating a developer supply container according to Embodiment 4.

Figure 28:
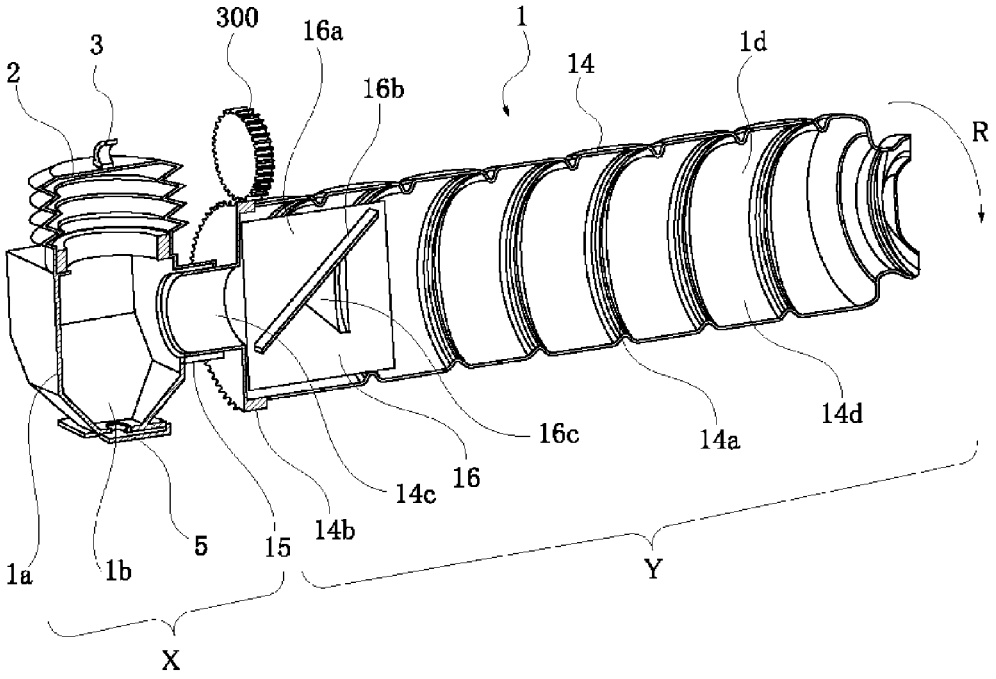

FIG. 28 is a sectional perspective view showing a developer supply container.

Figure 29:
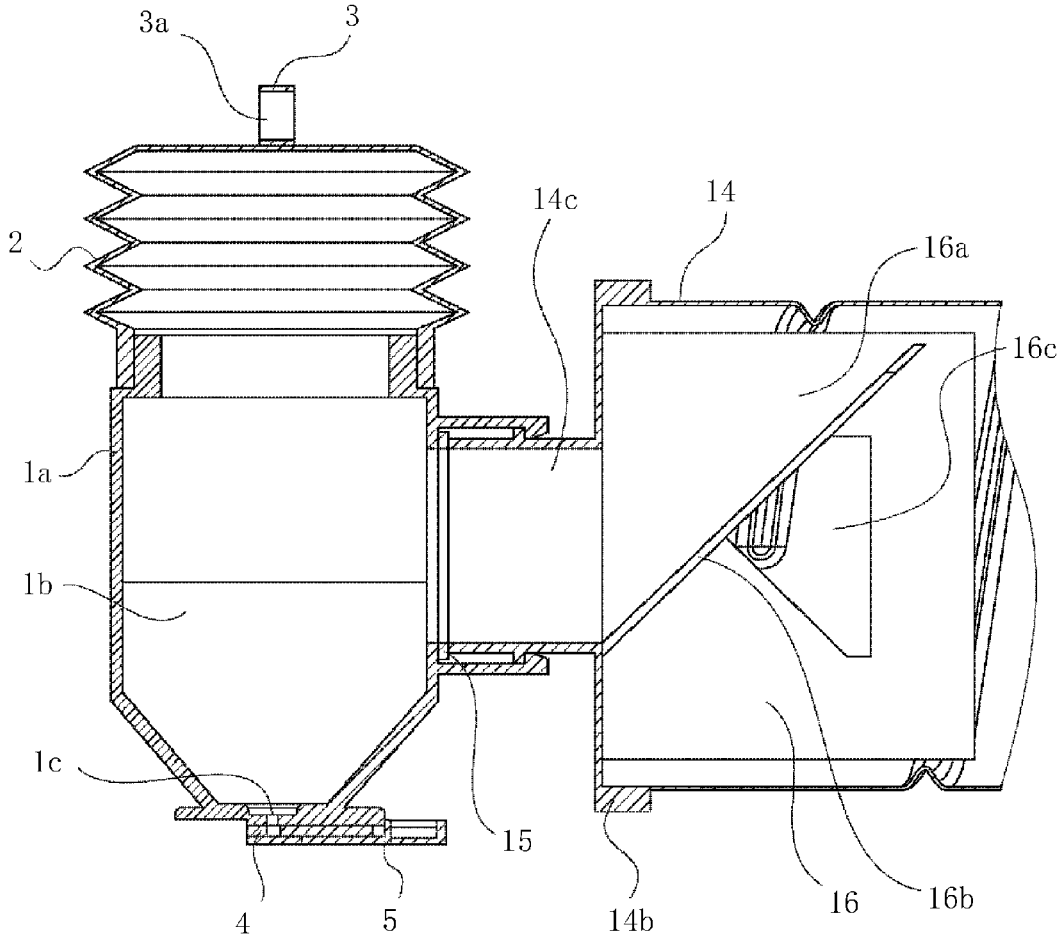

FIG. 29 is a partially sectional view illustrating a developer supply container according to Embodiment 4

Figure 30:
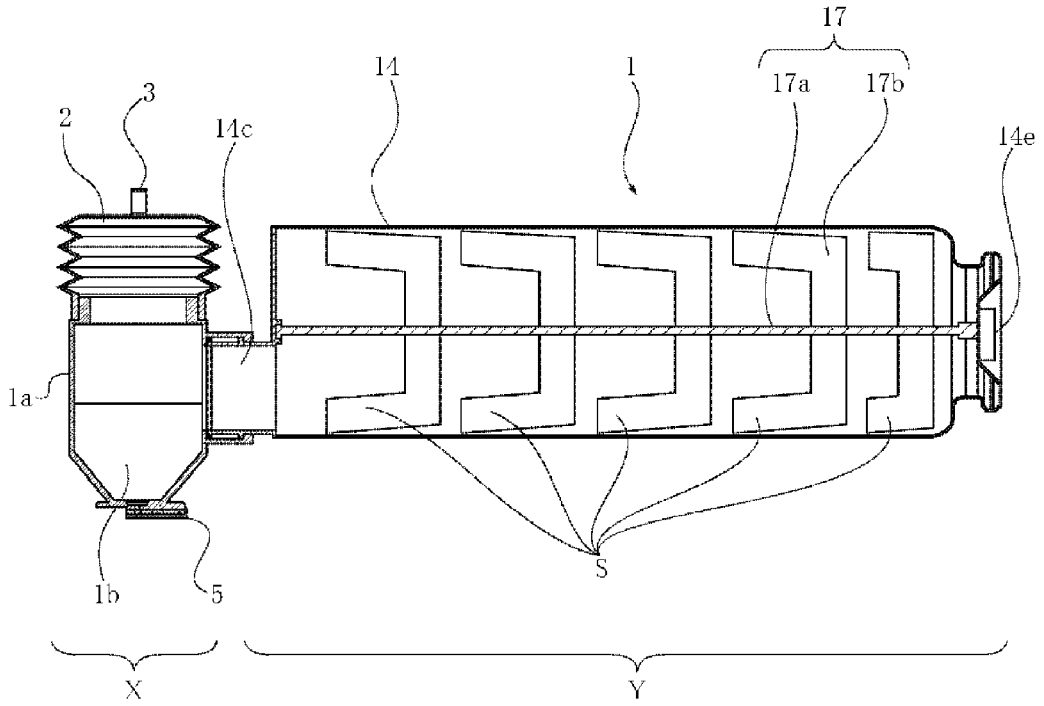

FIG. 30 is a sectional view illustrating another embodiment.

Figure 31:
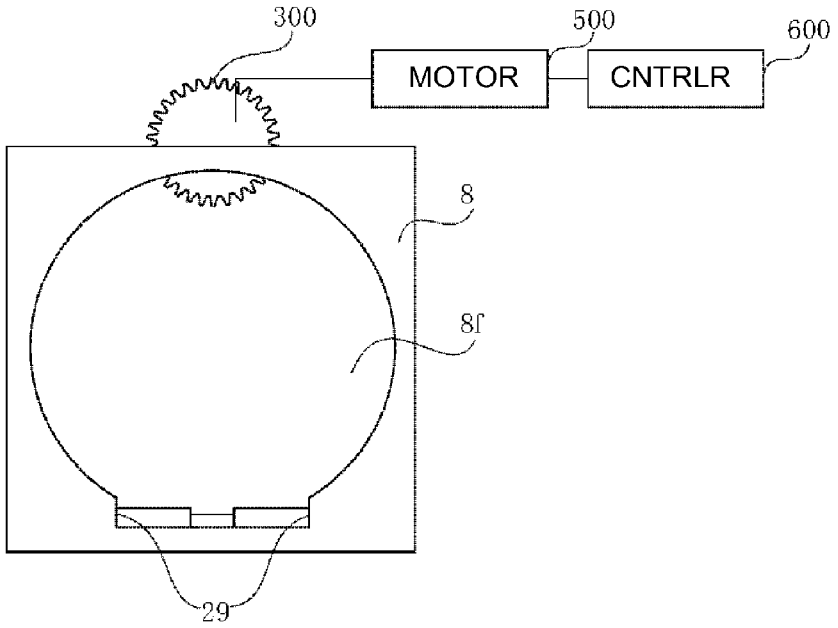
Figure 31:
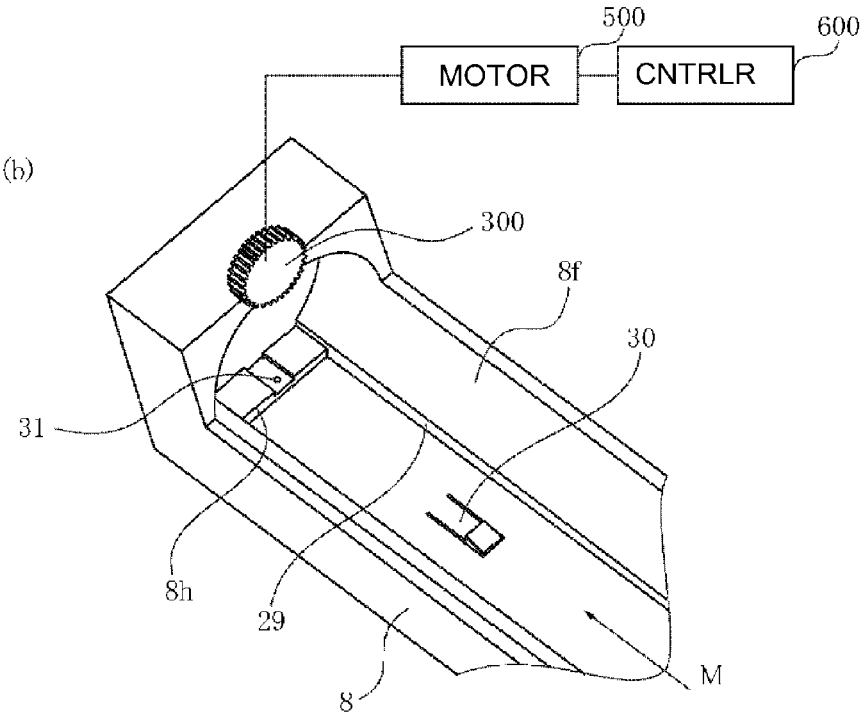

Part (a) of the FIG. 31 is a front view of a mounting portion the (b) is a partial enlarged perspective view of an inside of the mounting portion.

Figure 32:
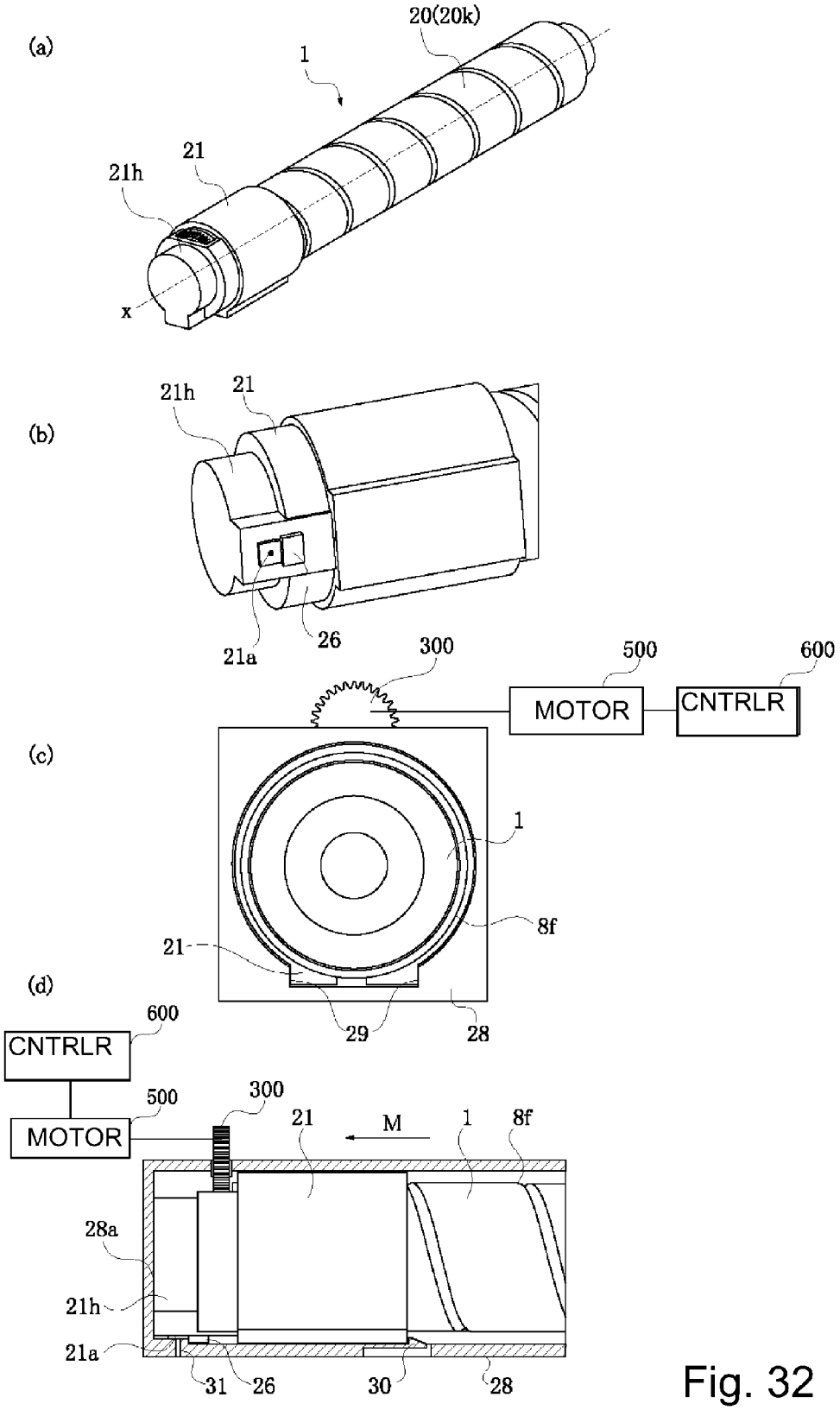

Part (a) of FIG. 32 is a perspective view illustrating a developer supply container according to Embodiment 1, (b) is a perspective view illustrating a state around a discharge opening, (c) and (d) are a front view and a sectional view illustrating a state in which the developer supply container is mounted to the mounting portion of the developer replenishing apparatus.

Figure 33:
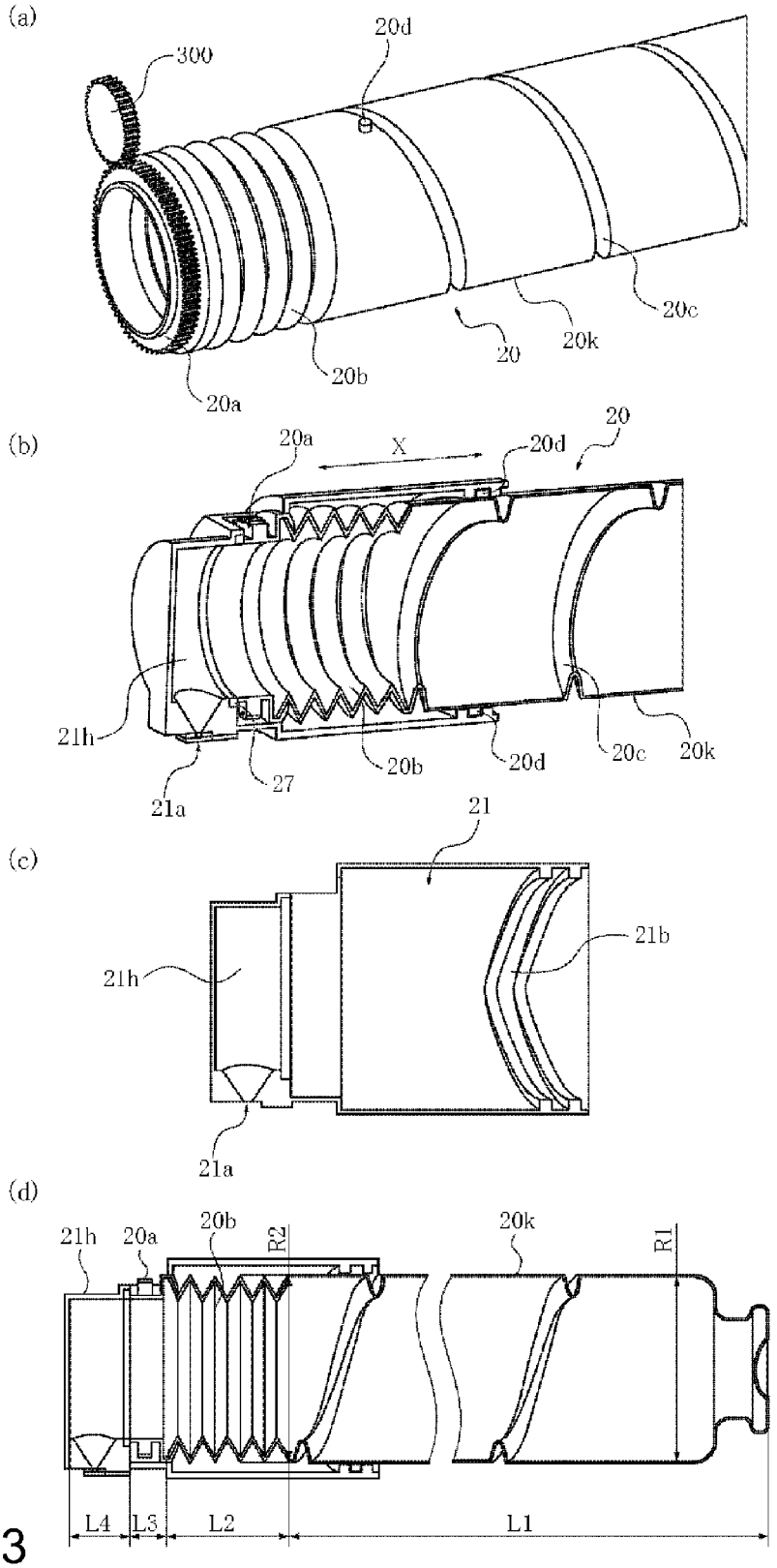

Part (a) of FIG. 33 is a perspective view of a developer accommodating portion, (b) is a perspective sectional view of the developer supply container, (c) the sectional view of an inner surface of a flange portion, and (d) is a sectional view of the developer supply container.

Figure 34:
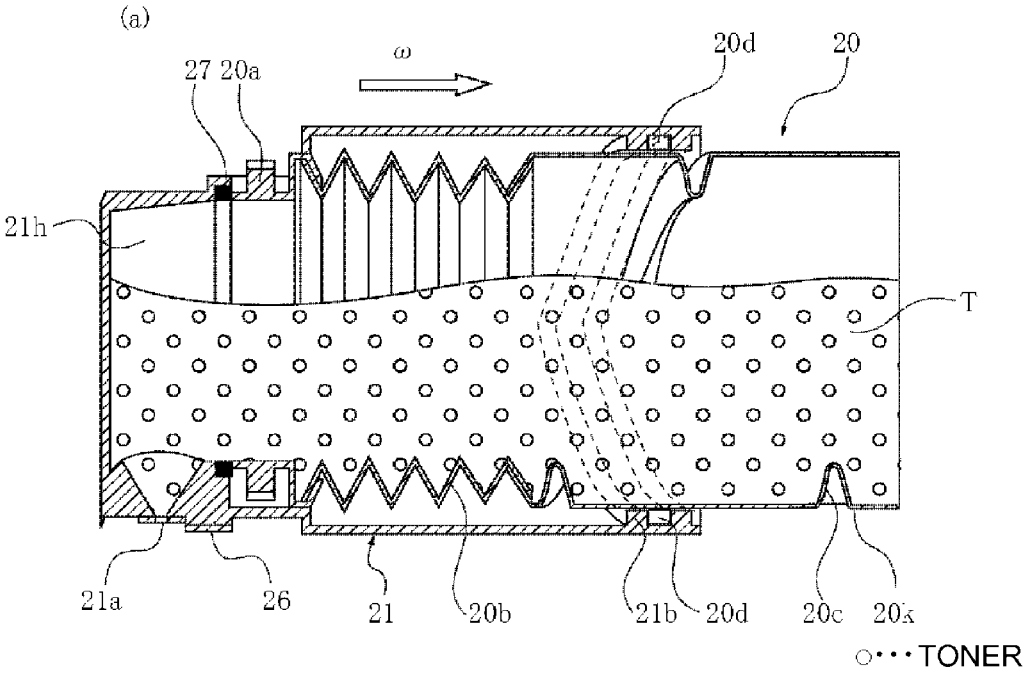
Figure 34:
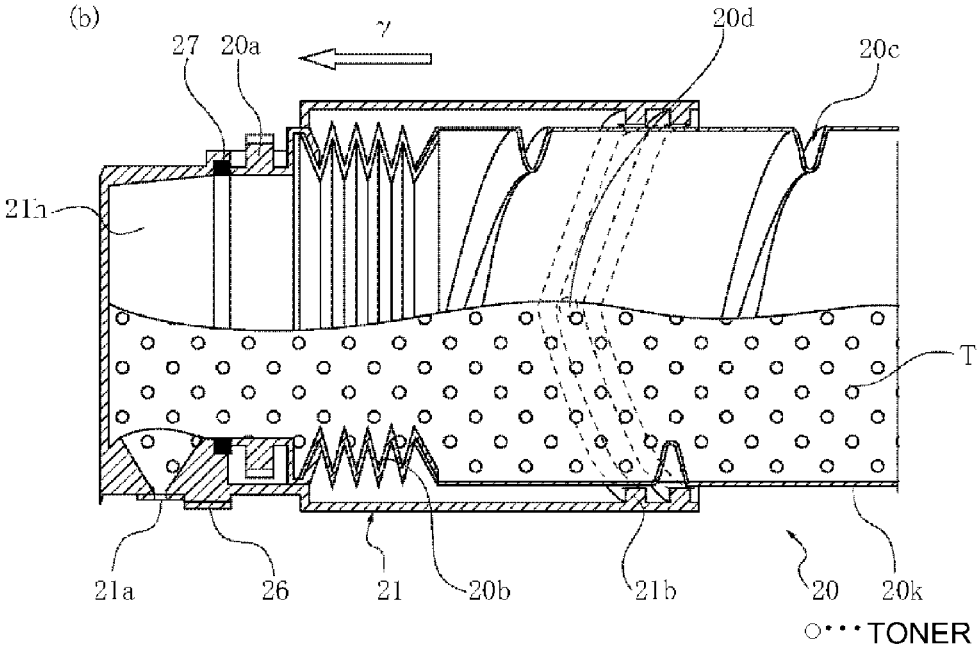

Part (a) and part (b) of FIG. 34 are sectional views showing of suction and discharging operations of a pump portion of the developer supply container according to the developer supply container according to Embodiment 5.

Figure 35:
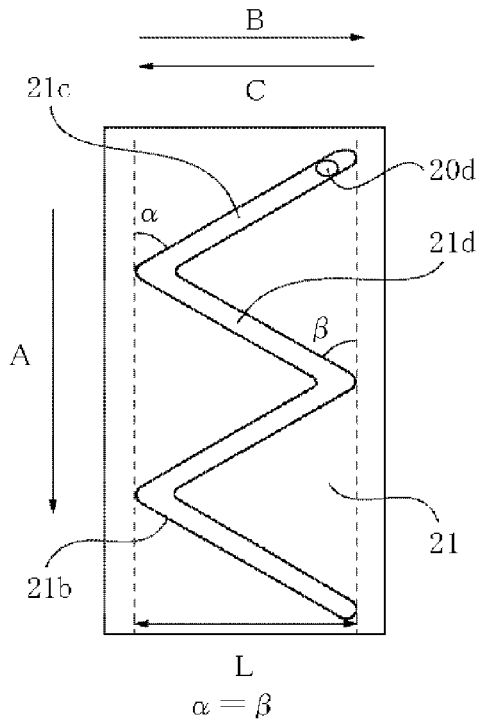

FIG. 35 is an extended elevation illustrating a cam groove configuration of the developer supply container.

Figure 36:
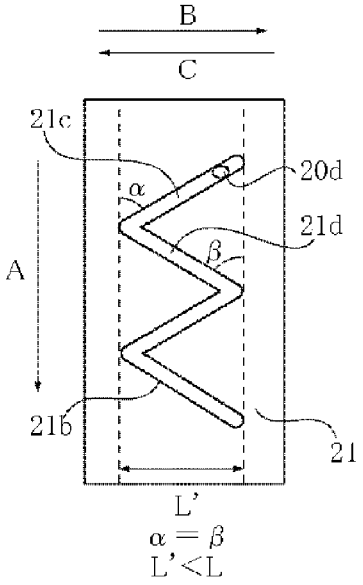

FIG. 36 is an extended elevation of an example of the cam groove configuration of the developer supply container.

Figure 37:
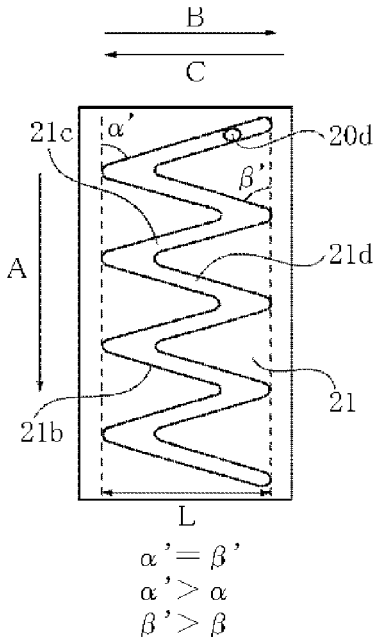

FIG. 37 is an extended elevation of an example of the cam groove configuration of the developer supply container.

Figure 38:
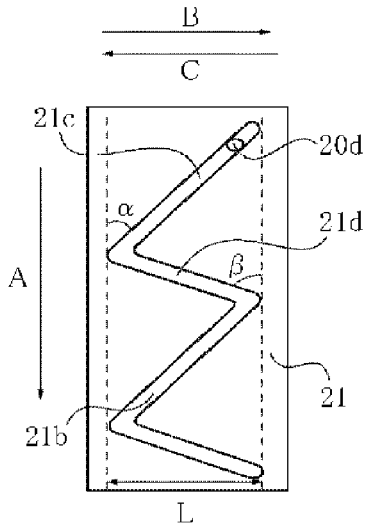

FIG. 38 is an extended elevation of an example of the cam groove configuration of the developer supply container.

Figure 39:
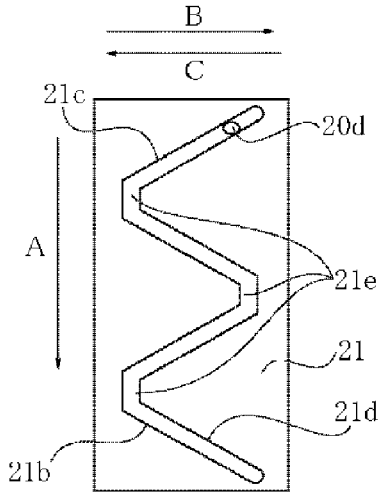

FIG. 39 is an extended elevation of an example of the cam groove configuration of the developer supply container.

Figure 40:
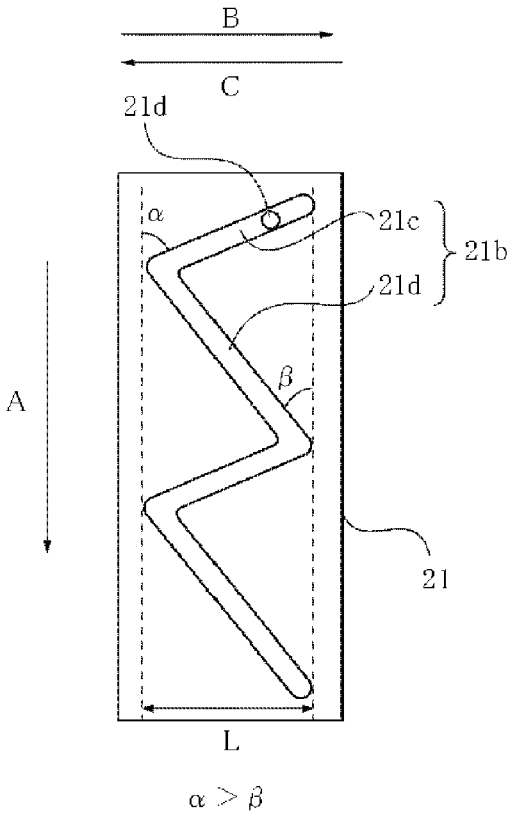

FIG. 40 is an extended elevation of an example of the cam groove configuration of the developer supply container.

Figure 41:
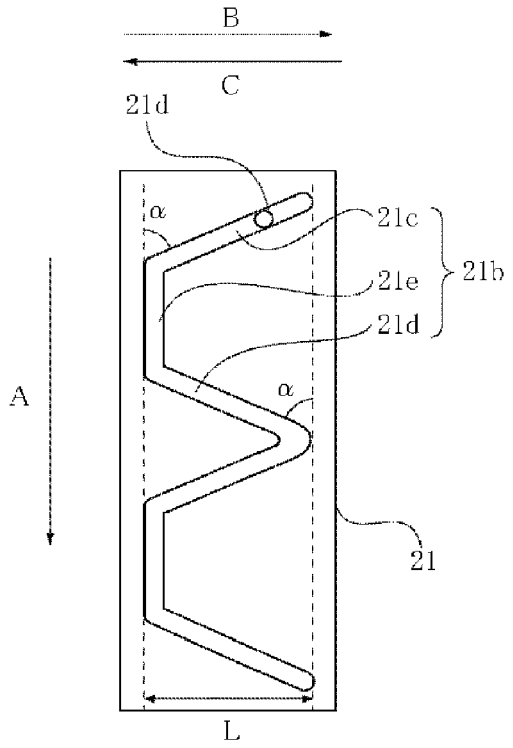

FIG. 41 is an extended elevation illustrating an example of a cam groove configuration of the developer supply container.

Figure 42:
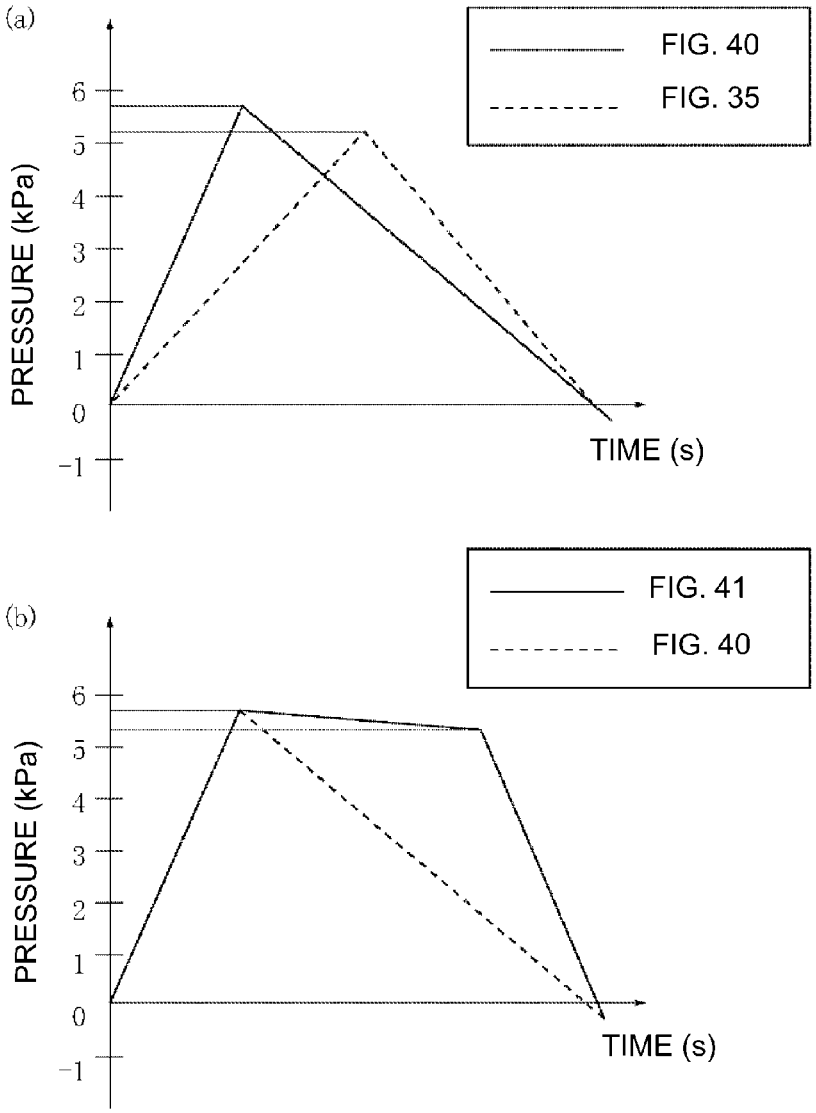

FIG. 42 is a graph showing a change of an internal pressure of the developer supply container.

Figure 43:
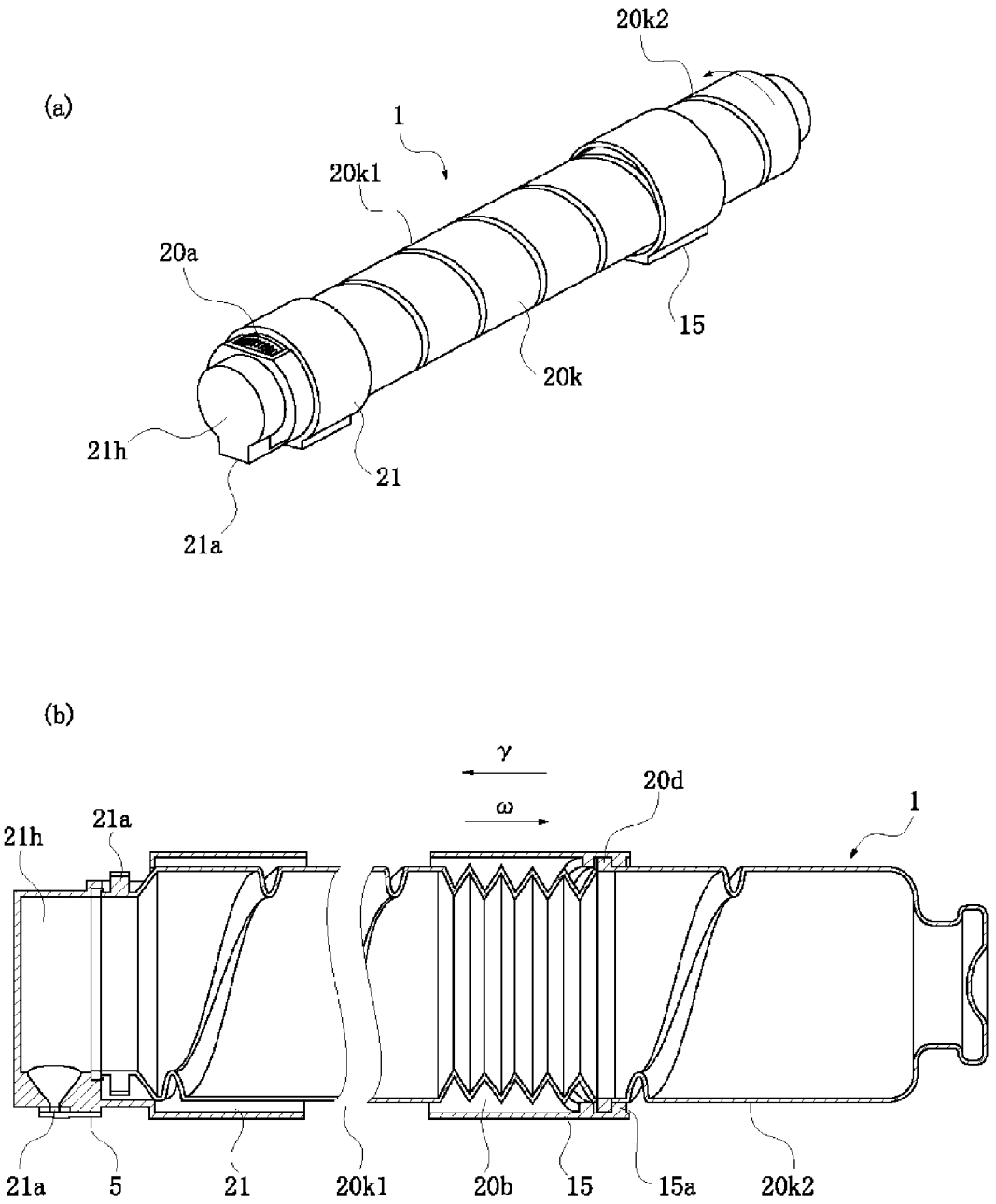

Part (a) of FIG. 43 is a perspective view showing a structure of a developer supply container according to Embodiment 6, and (b) is a sectional view showing a structure of the developer supply container.

Figure 44:
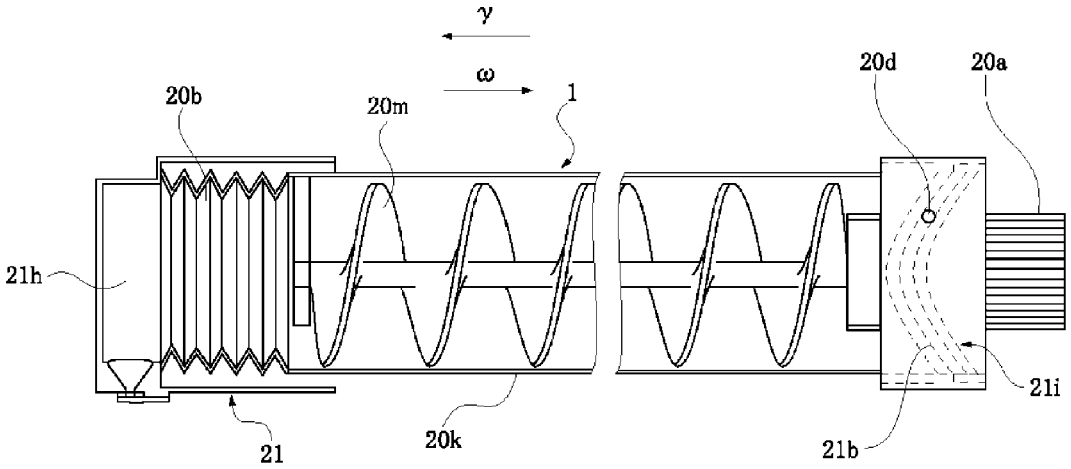

FIG. 44 is a sectional view showing a structure of a developer supply container according to Embodiment 7.

Figure 45:
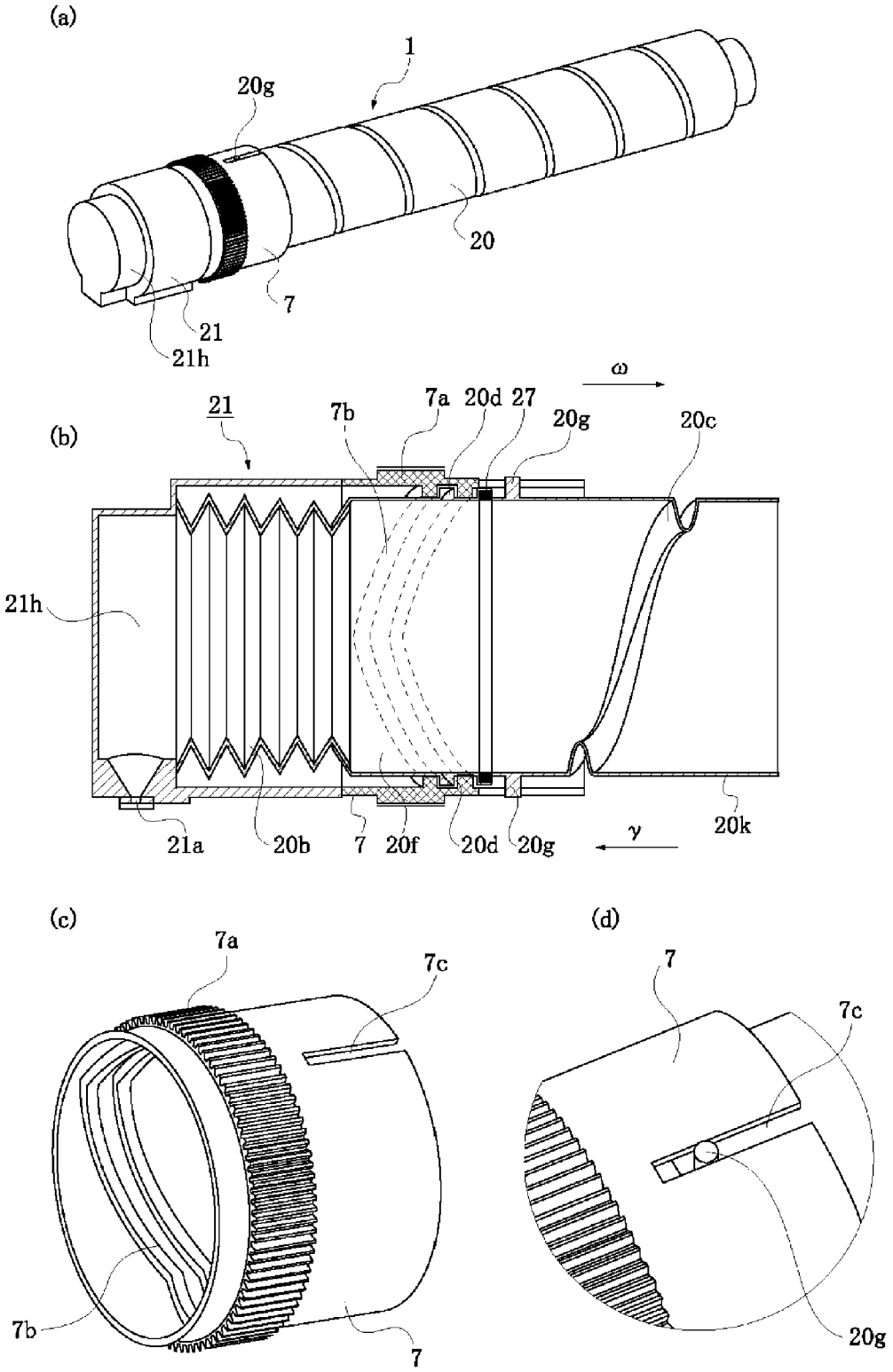

Part (a) of FIG. 45 is a perspective view illustrating a structure of a developer supply container according to Embodiment 8, (b) is a sectional view of the developer supply container, (c) is a perspective view illustrating a cam gear, and (d) is an enlarged view of a rotational engaging portion of the cam gear.

Figure 46:
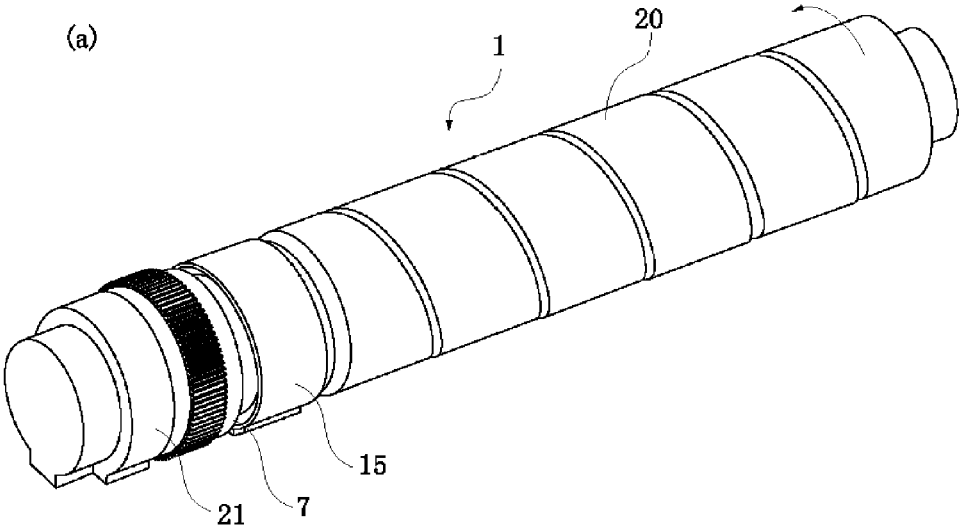
Figure 46:
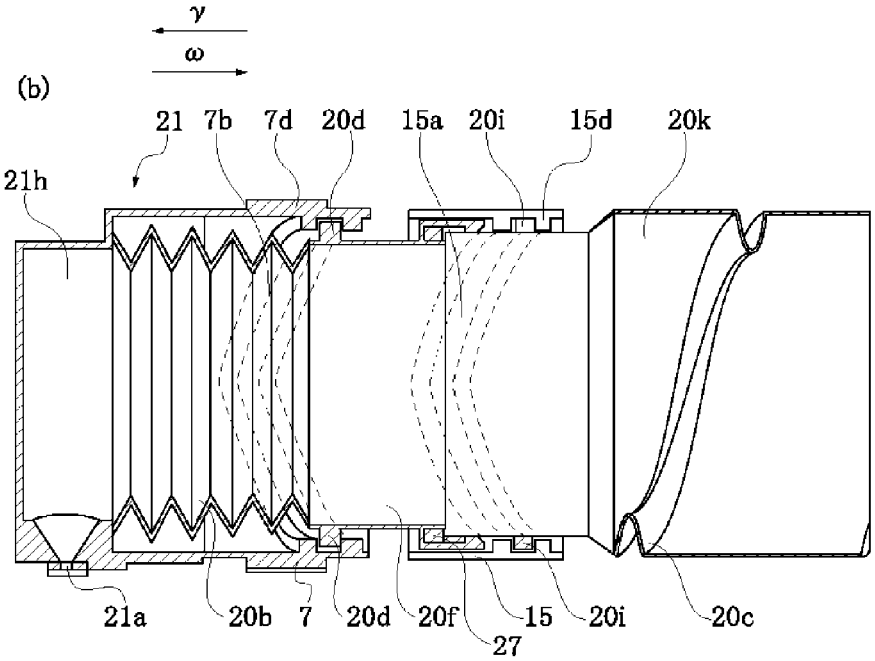

Part (a) of FIG. 46 is a perspective view showing a structure of a developer supply container according to Embodiment 9, and (b) is a sectional view showing a structure of the developer supply container.

Figure 47:
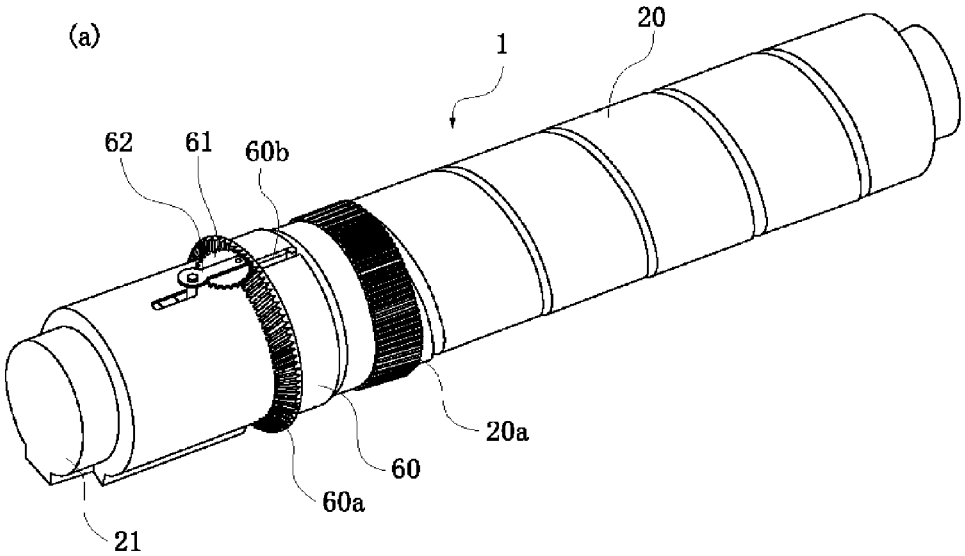
Figure 47:
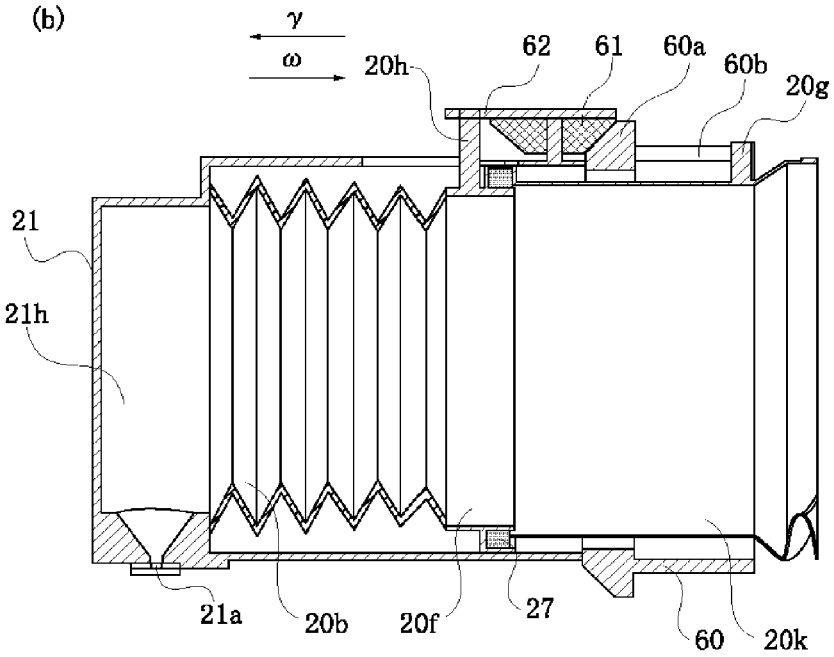

Part (a) of FIG. 47 is a perspective view showing a structure of a developer supply container according to Embodiment 10, and (b) is a sectional view showing a structure of the developer supply container.

Figure 48:
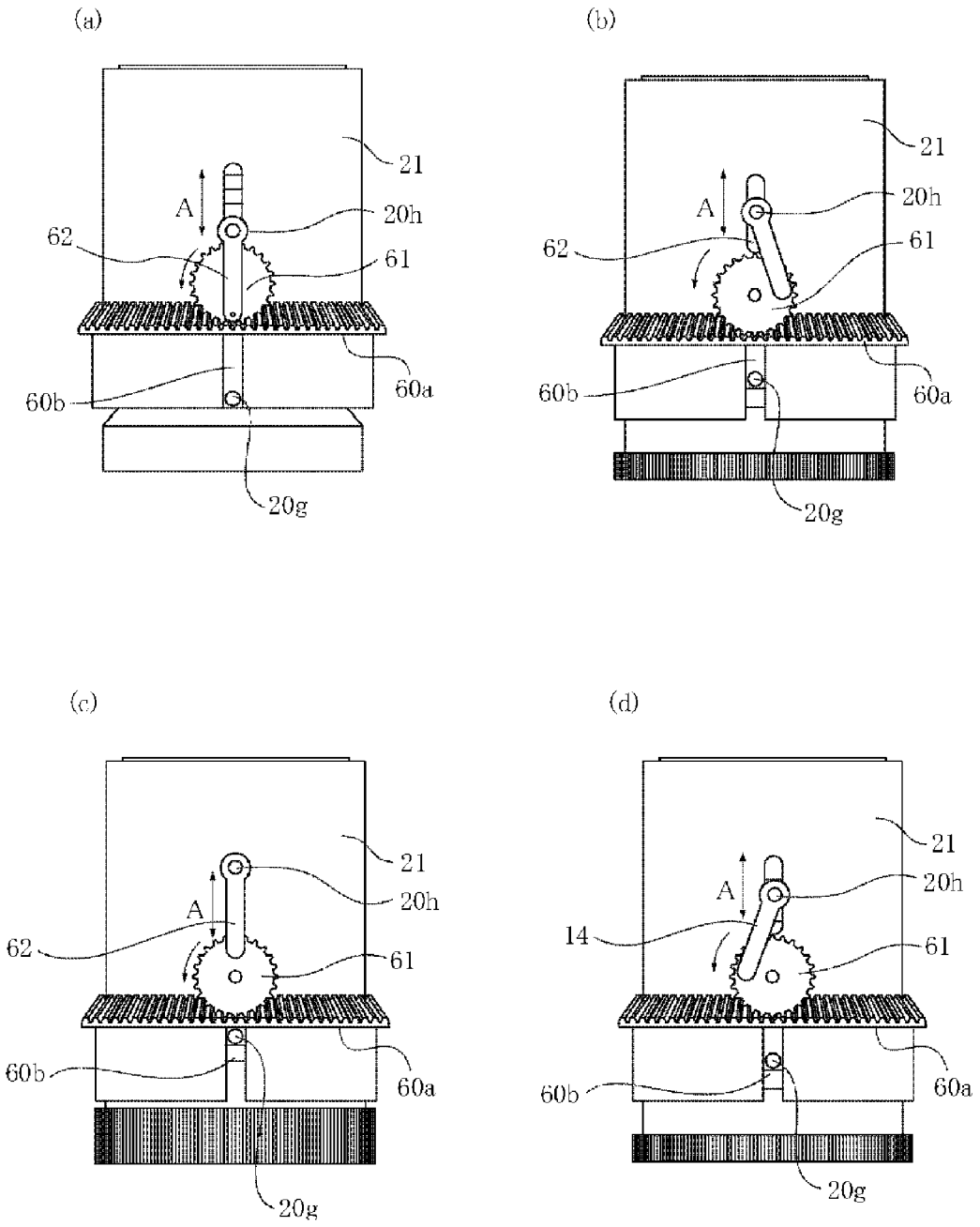

Parts (a)-(d) of FIG. 48 illustrate an operation of a drive converting mechanism.

Figure 49:
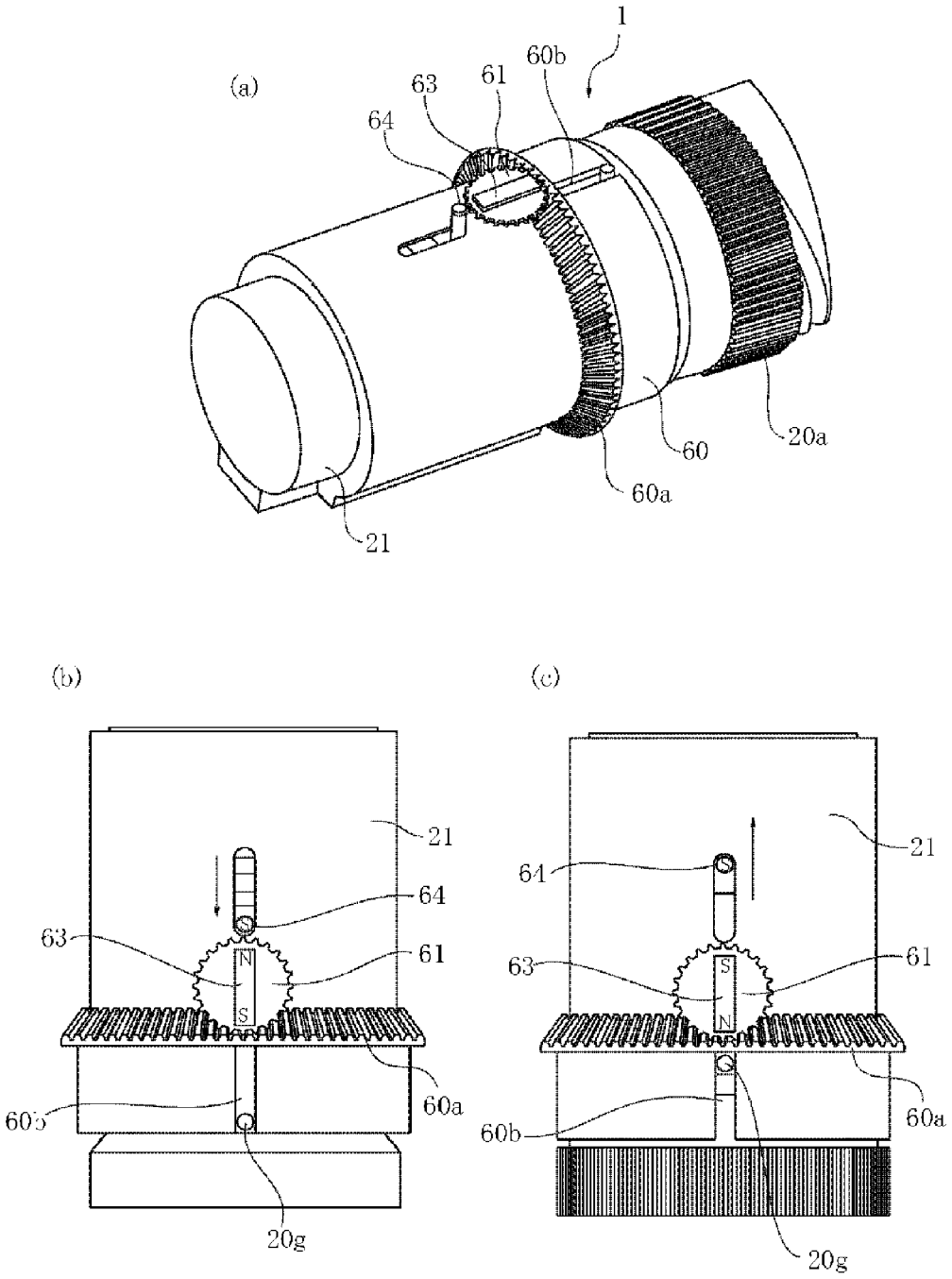

Part (a) of FIG. 49 illustrates a perspective view illustrating a structure of a according to Embodiment 11, (b) and (c) illustrate an operation of a drive converting mechanism.

Figure 50:
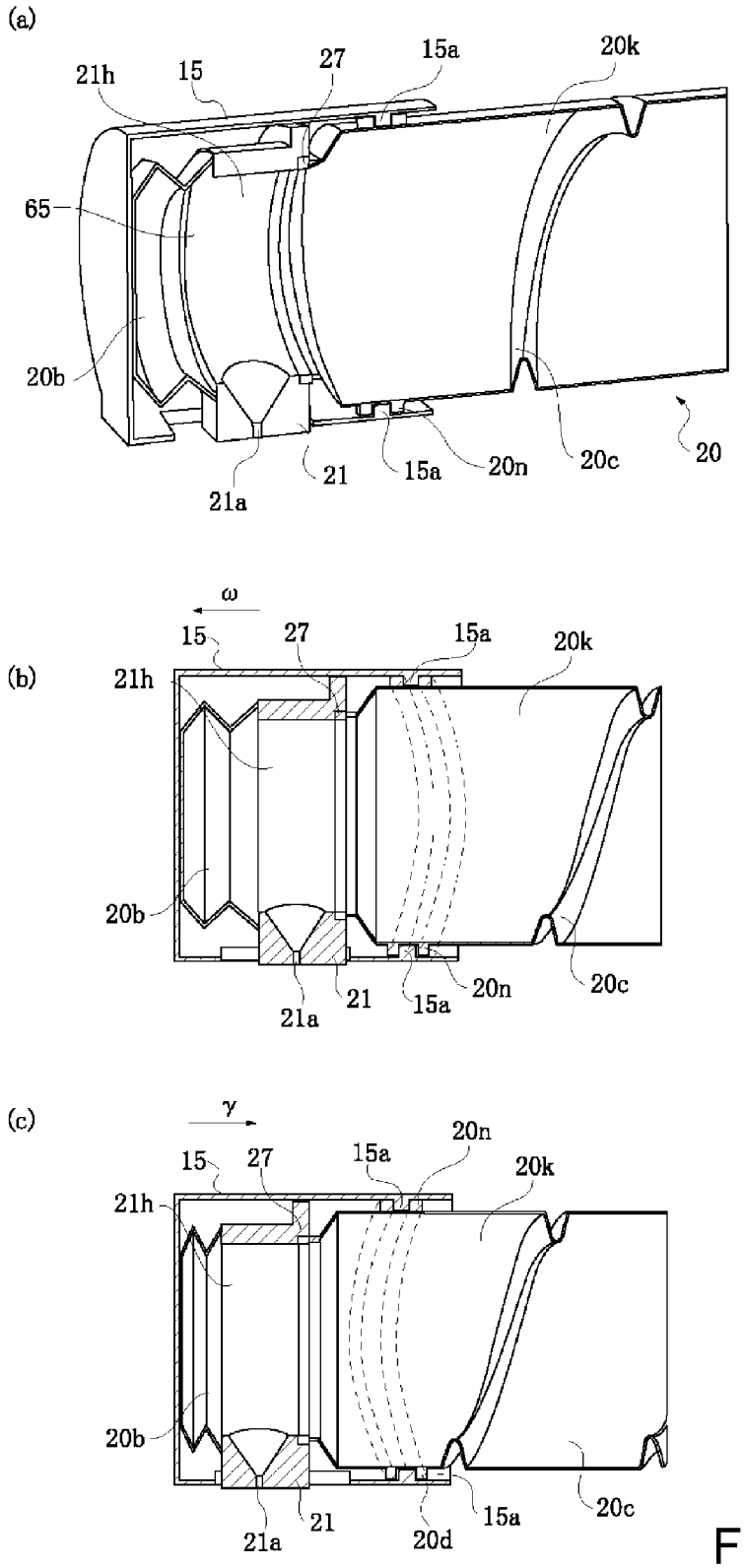

Part (a) of FIG. 50 is a sectional perspective view illustrating a structure of a developer supply container according to Embodiment 12, (b) and (c) are sectional views illustrating suction and discharging operations of a pump portion.

Figure 51:
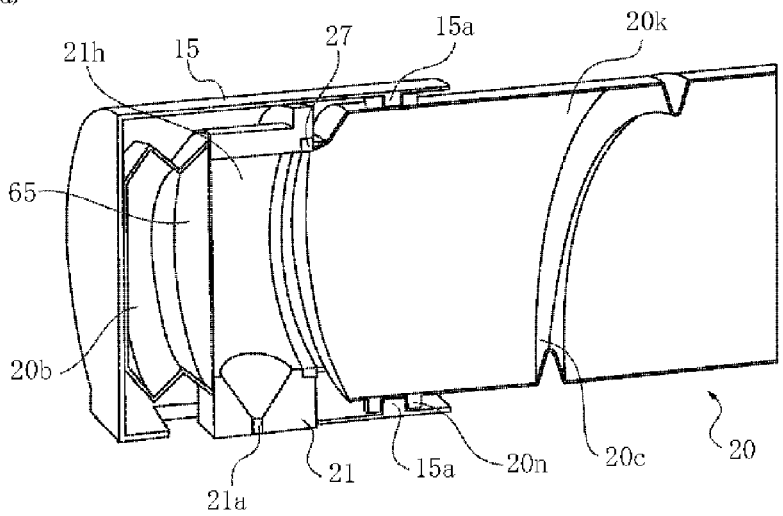
Figure 51:
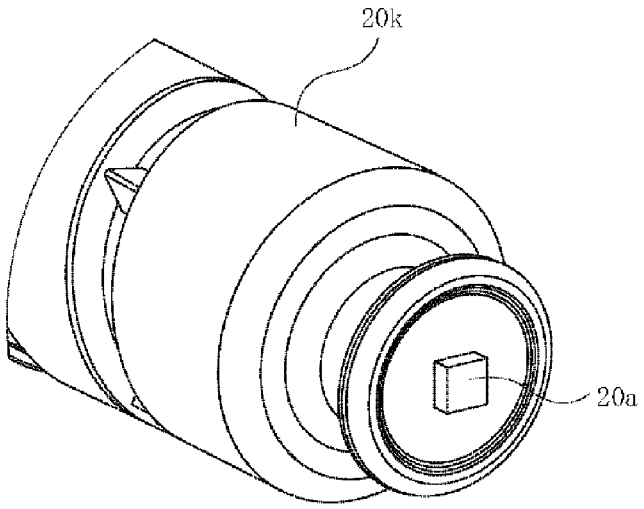

Part (a) of FIG. 51 is a perspective view illustrating another example of a developer supply container according to Embodiment 12, and (b) illustrates a coupling portion of the developer supply container.

Figure 52:
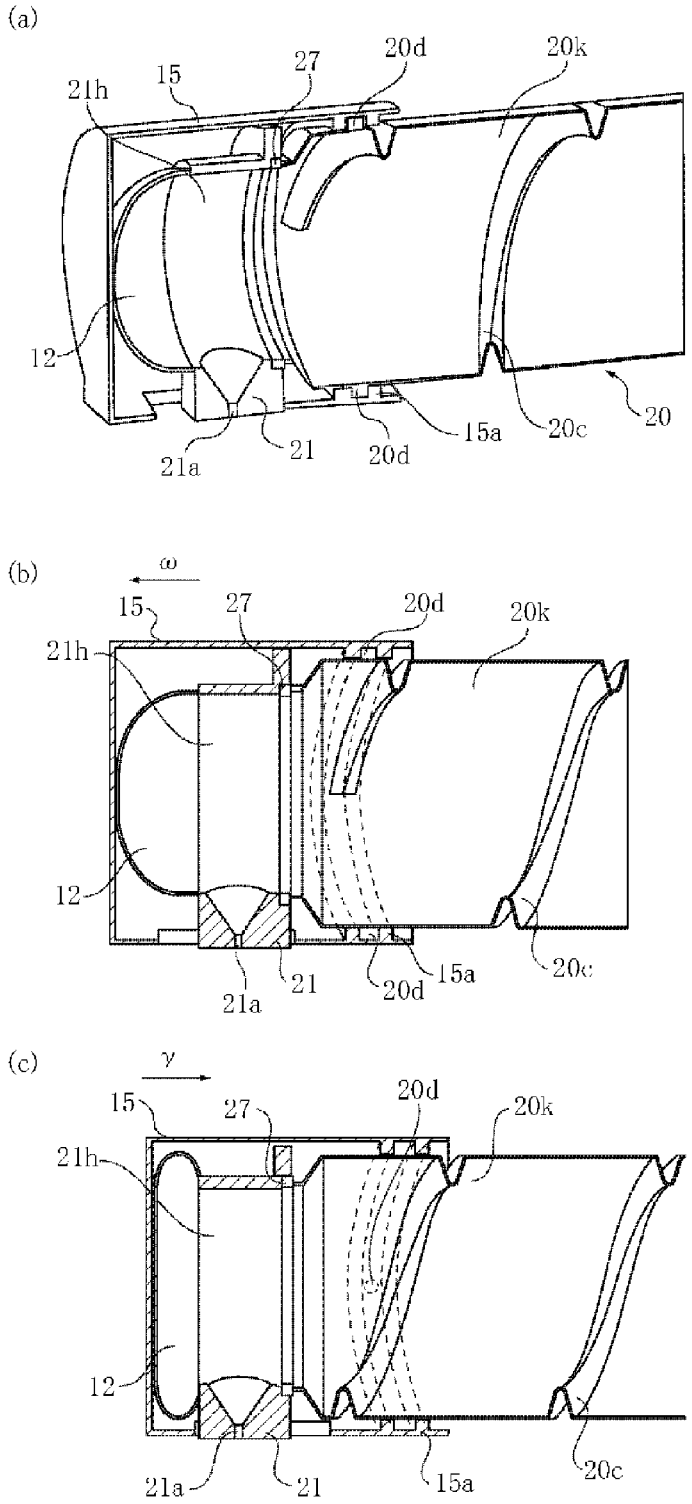

Part (a) of FIG. 52 is a sectional perspective view illustrating a developer supply container according to Embodiment 13, and (b) and (c) are sectional views illustrating suction and discharging operations of a pump portion.

Figure 53:
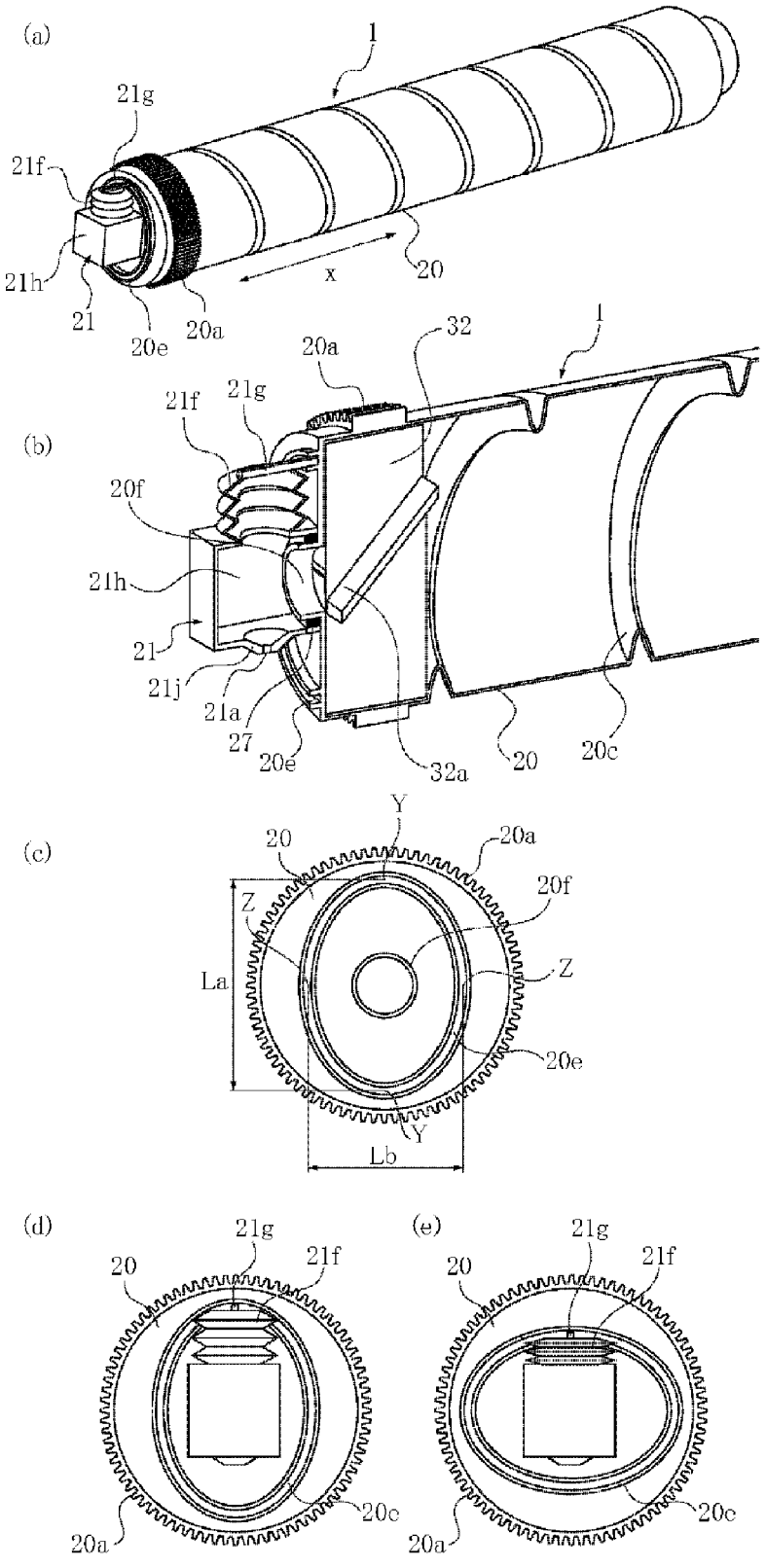

Part (a) of FIG. 53 is a perspective view illustrating a structure of a developer supply container according to Embodiment 14, (b) is a sectional perspective view illustrating a structure of the developer supply container, (c) illustrates a structure of an end of the developer accommodating portion, and (d) and (e) illustrate suction and discharging operations of a pump portion.

Figure 54:
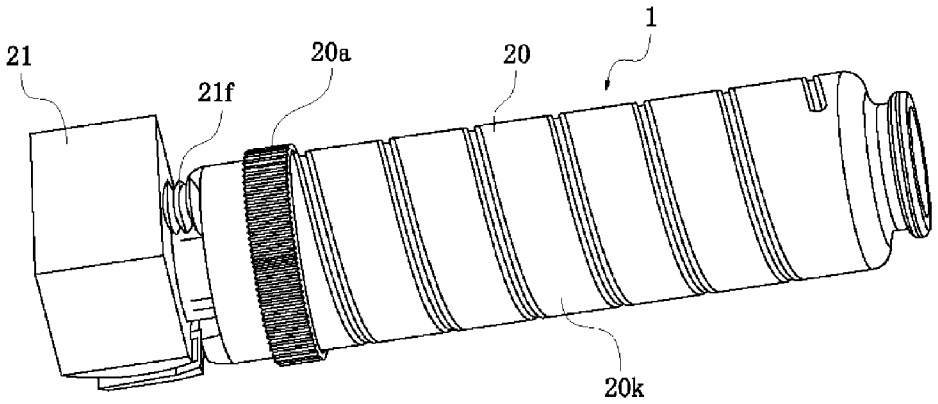
Figure 54:
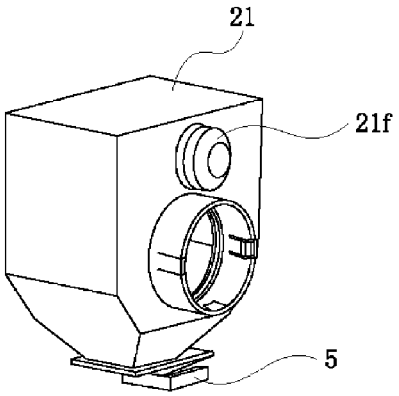
Figure 54:
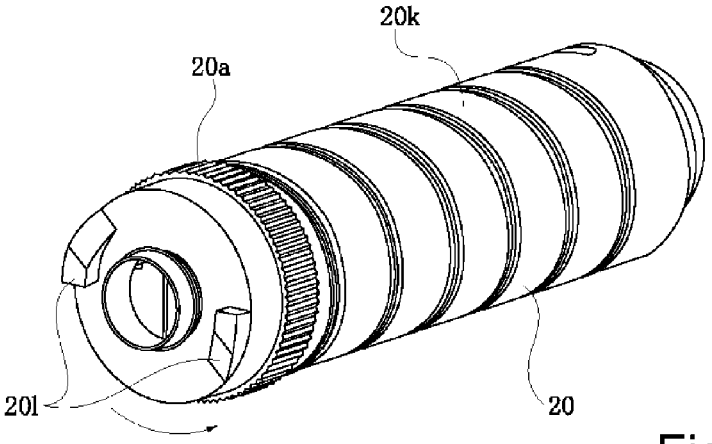

Part (a) of FIG. 54 is a perspective view illustrating a structure of a developer supply container according to Embodiment 15, (b) is a perspective view illustrating a structure of a flange portion, and (c) is a perspective view illustrating a structure of the cylindrical portion.

Figure 55:
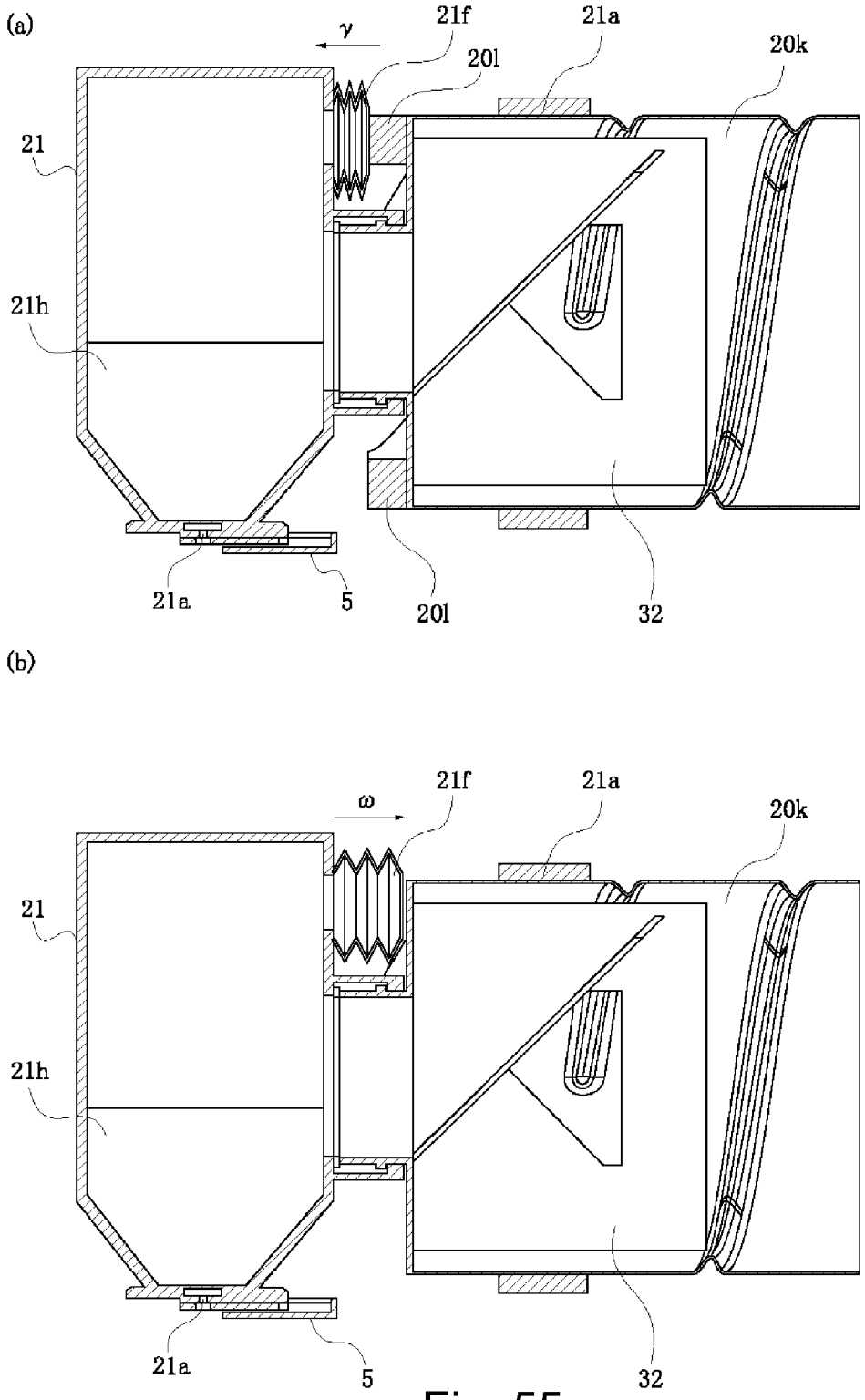

Parts (a) and (b) of FIG. 55 are sectional views illustrating suction and discharging operations of a pump portion of the developer supply container according to Embodiment 15.

Figure 56:
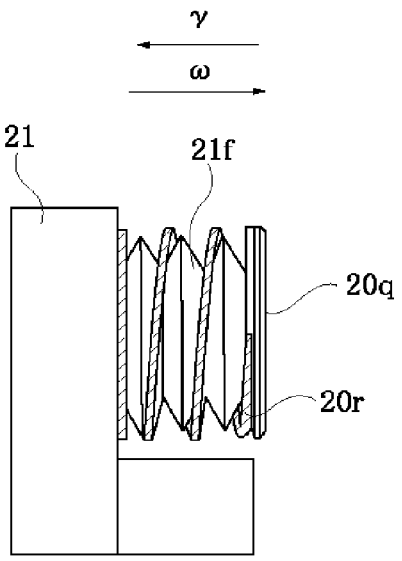

FIG. 56 illustrate a structure of the pump portion of the developer supply container according to Embodiment 15.

Figure 57:
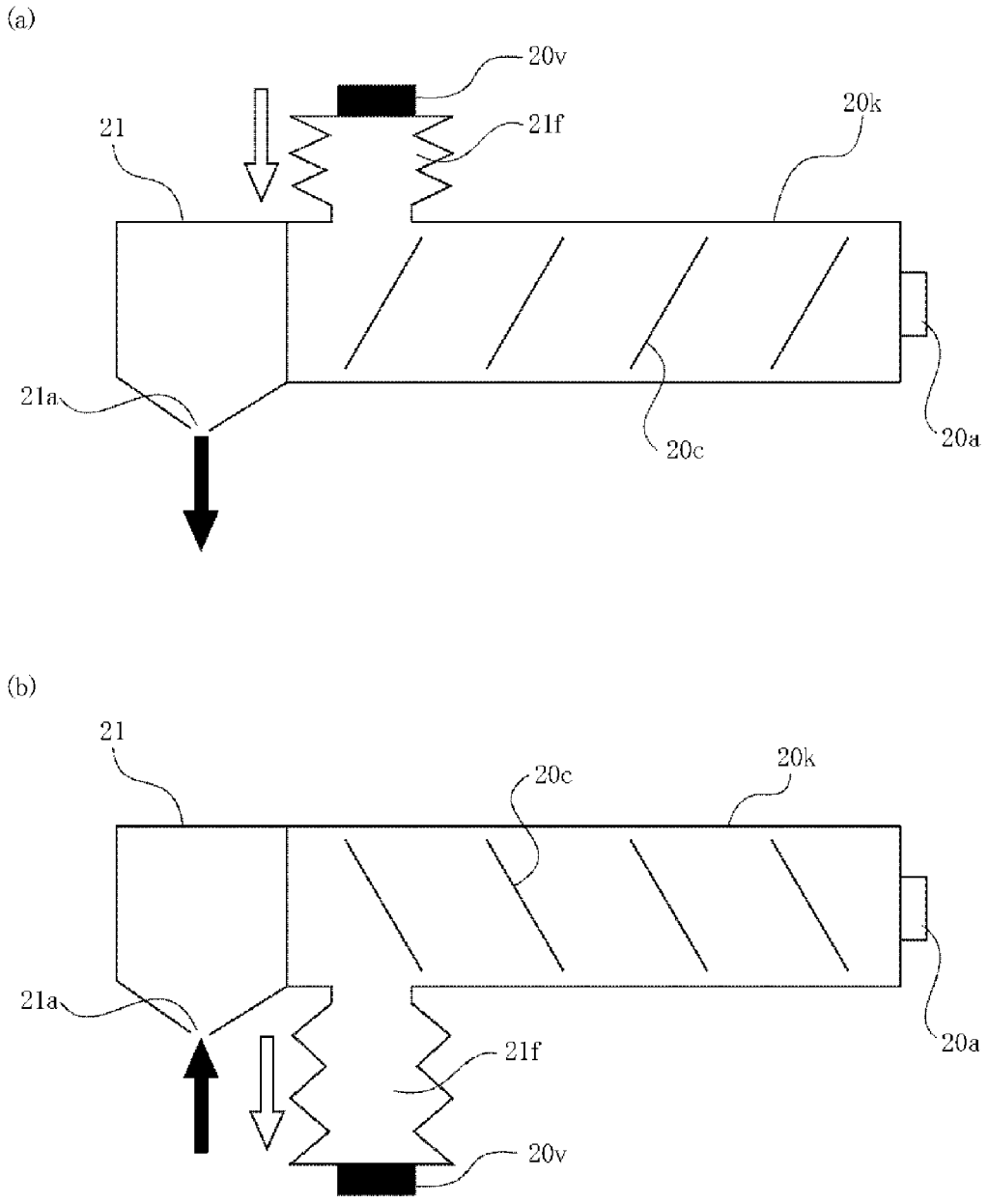

Parts (a) and (b) of FIG. 57 are sectional views schematically illustrating a structure of a developer supply container according to Embodiment 16.

Figure 58:
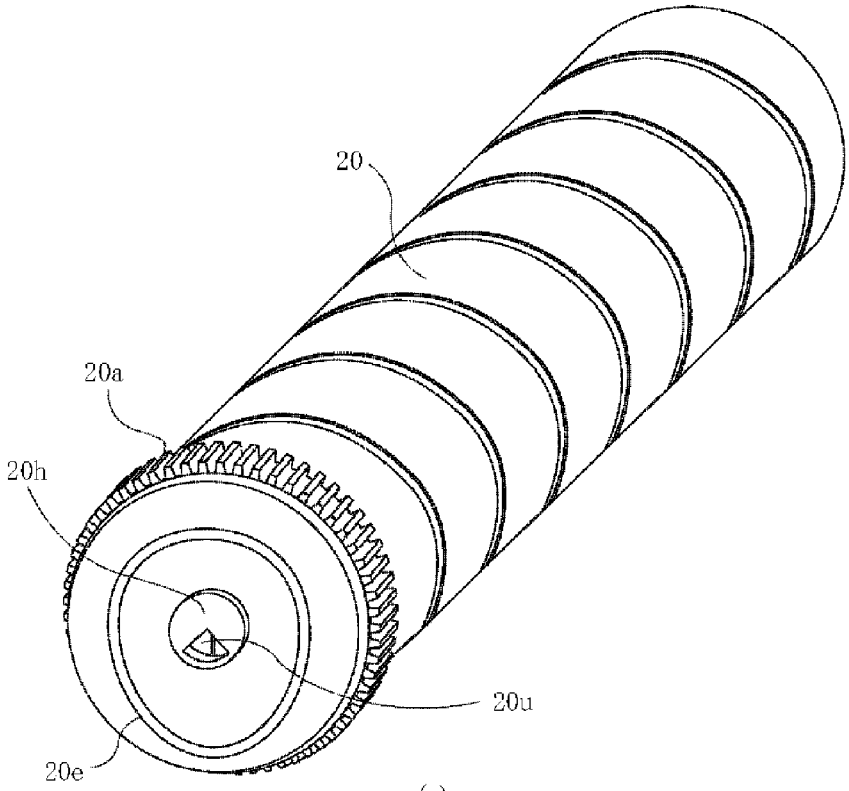
Figure 58:
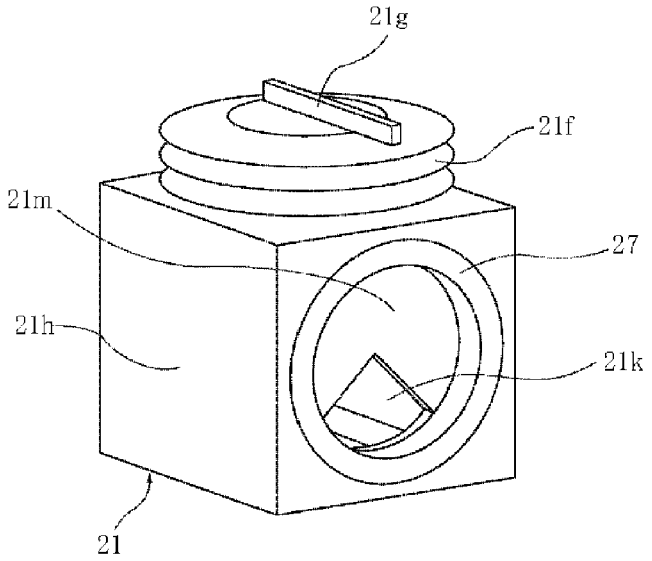

Parts (a) and (b) of FIG. 58 are perspective views illustrating a cylindrical portion and a flange portion of a developer supply container according to Embodiment 13.

Figure 59:
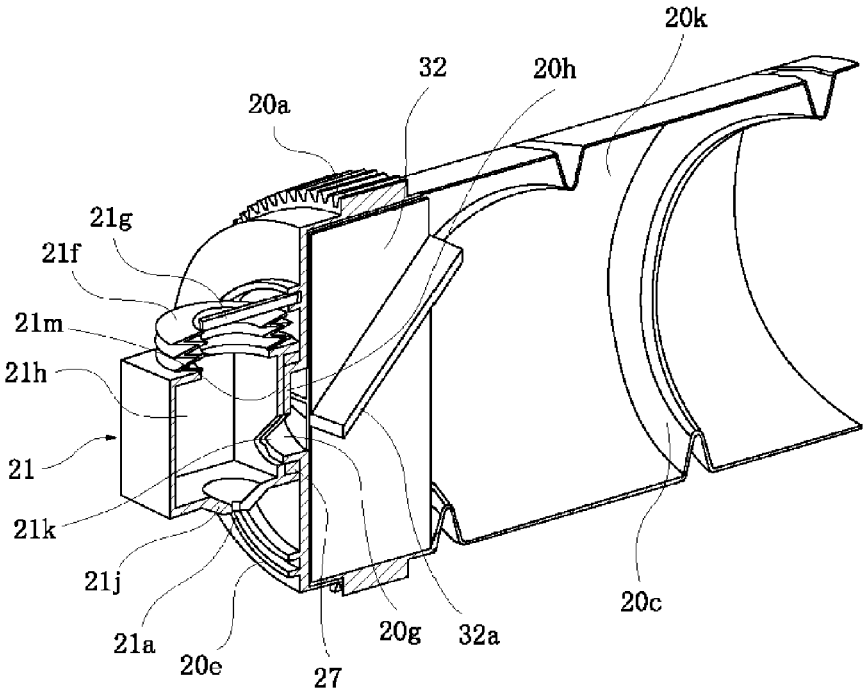
Figure 59:
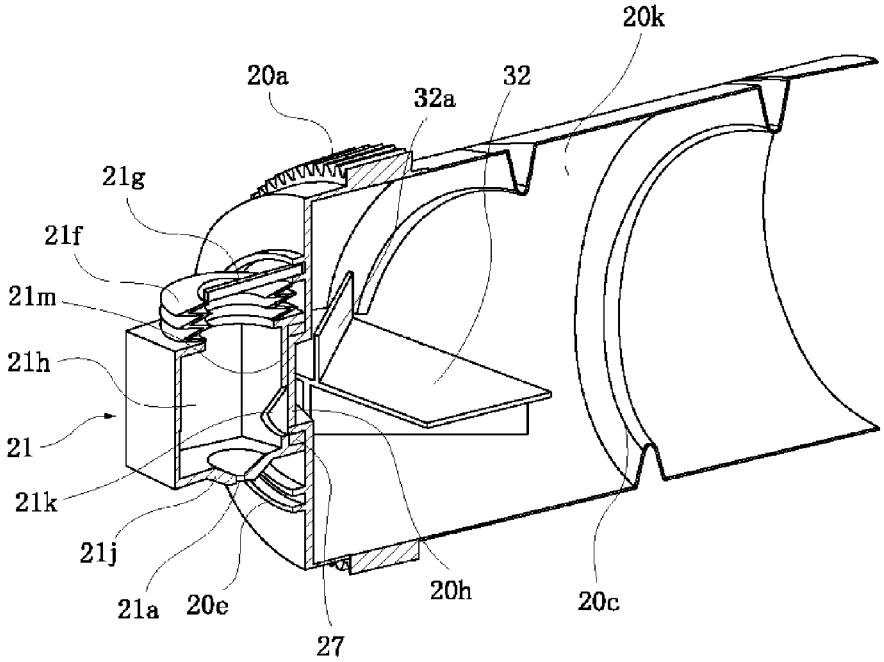

Parts (a) and (b) of FIG. 59 are partially sectional perspective views of a developer supply container according to Embodiment 13.

Figure 60:
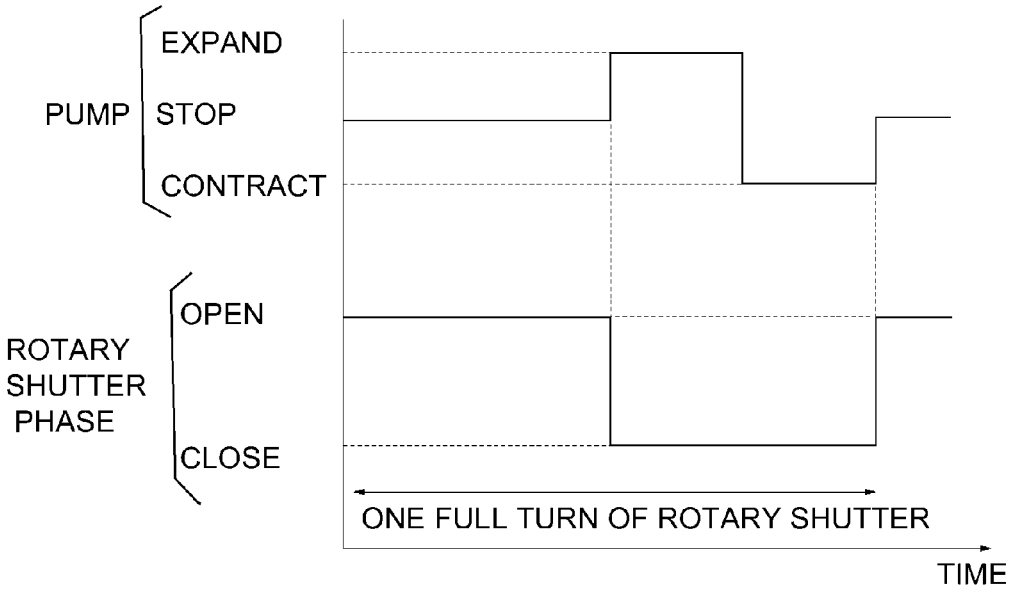

FIG. 60 is a time chart illustrating a relation between an operation state of a pump according to Embodiment 17 and opening and closing timing of a rotatable shutter.

Figure 61:
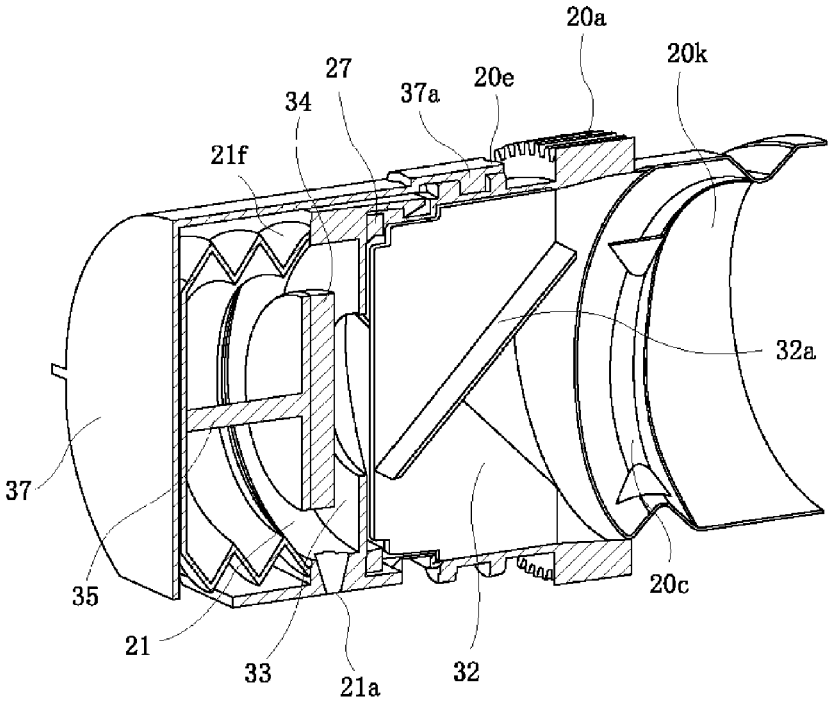

FIG. 61 is a partly sectional perspective view illustrating a developer supply container according to Embodiment 18.

Figure 62:
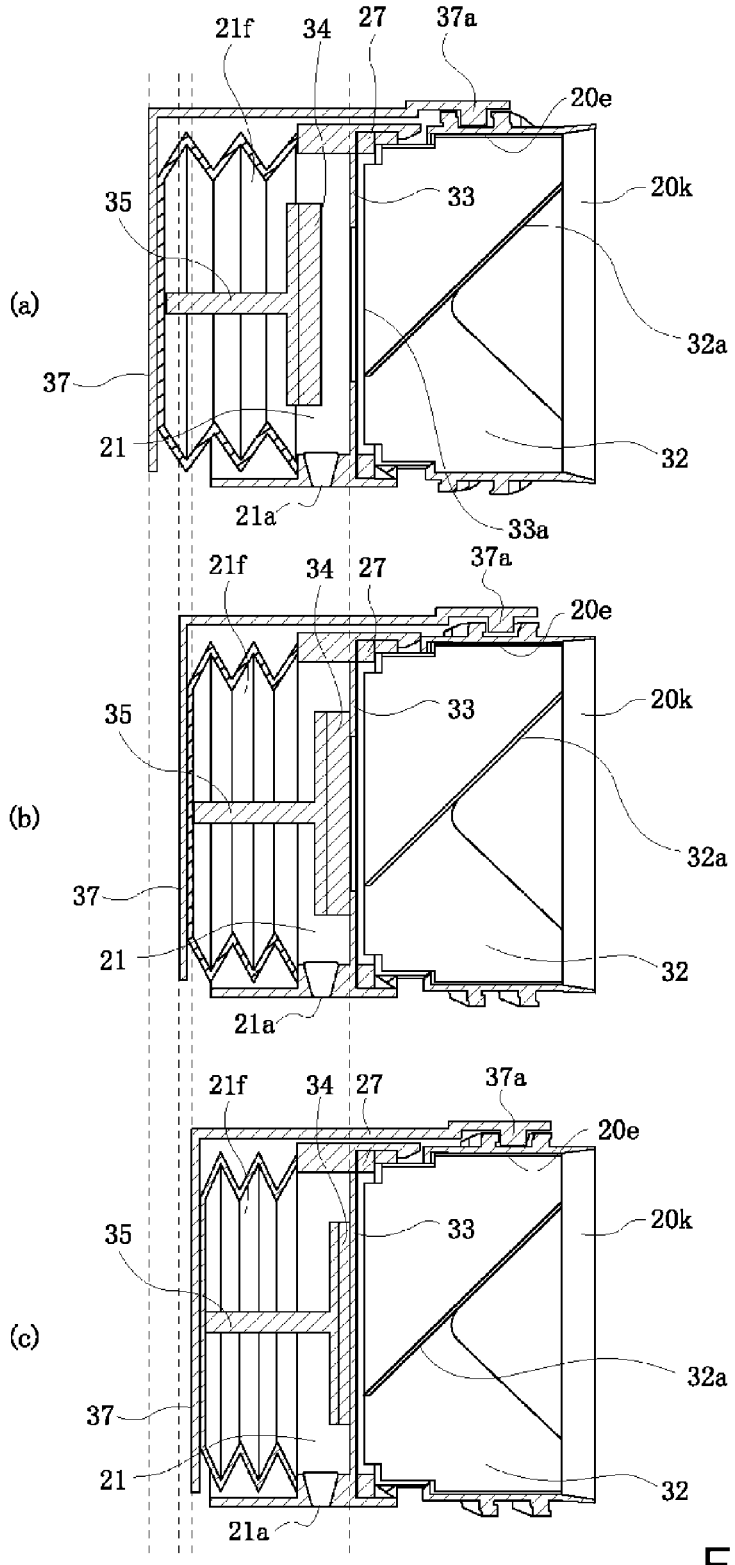

Parts (a)-(c) of FIG. 62 are partially sectional views illustrating operation state of a pump portion according to Embodiment 18.

Figure 63:
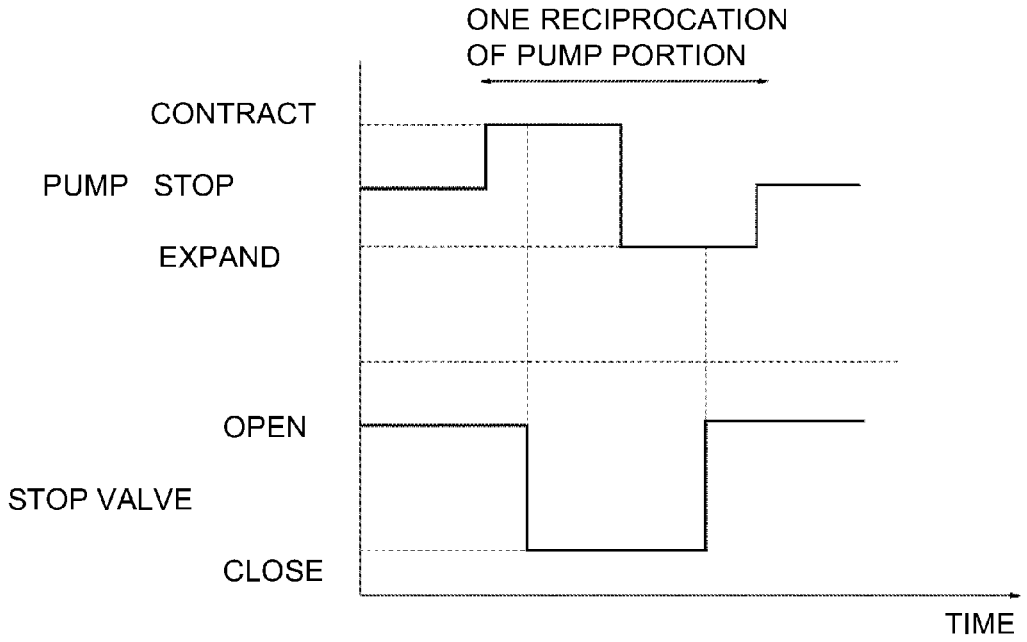

FIG. 63 is a time chart illustrating a relation between an operation state of a pump according to Embodiment 18 and opening and closing timing of a stop valve.

Figure 64:
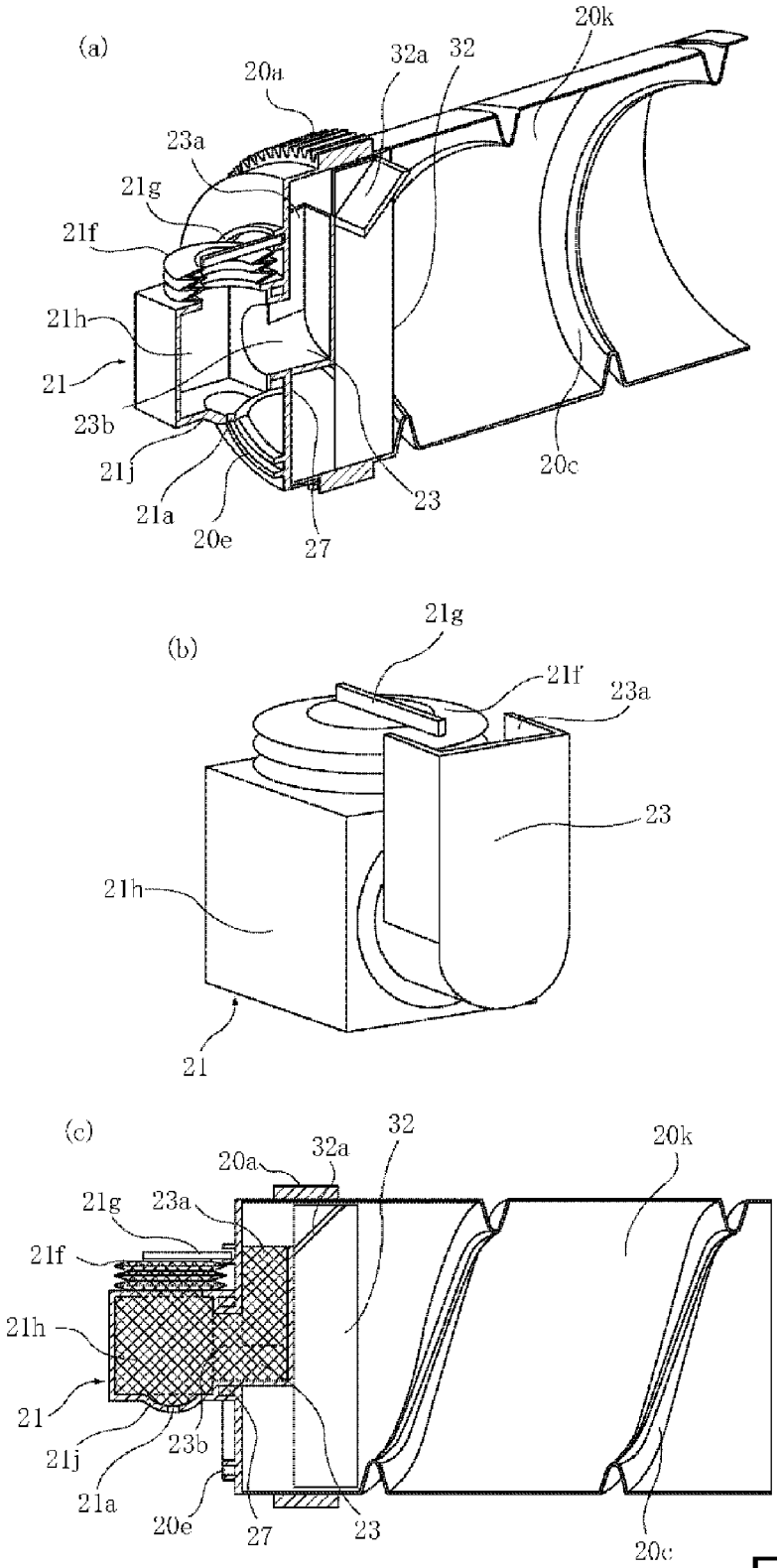

Part (a) of FIG. 64 is a partial perspective view of a developer supply container according to Embodiment 19, (b) is a perspective view of a flange portion, and (c) is a sectional view of the developer supply container.

Figure 65:
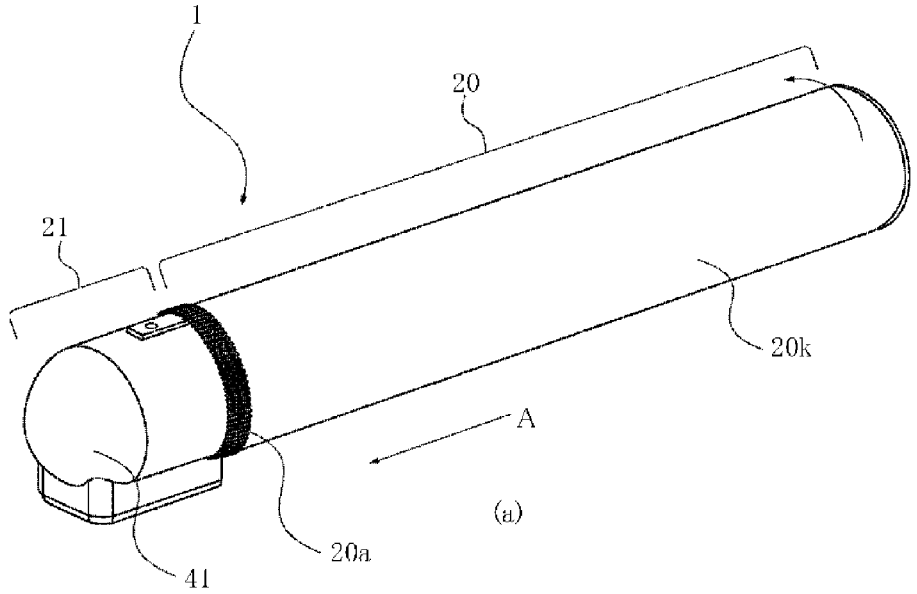
Figure 65:
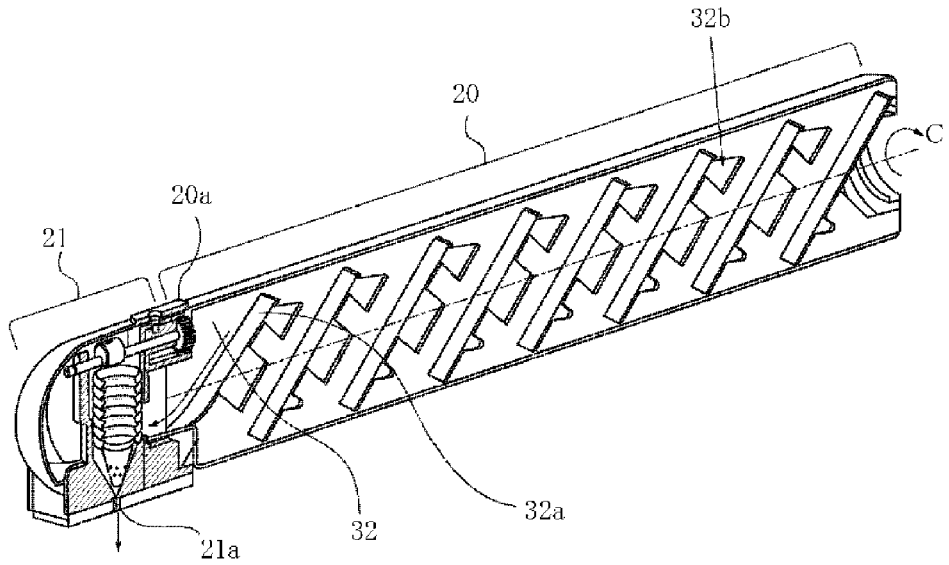

Part (a) of FIG. 65 is a perspective view illustrating a structure of a developer supply container according to Embodiment 20, and (b) is a sectional perspective view of the developer supply container.

Figure 66:
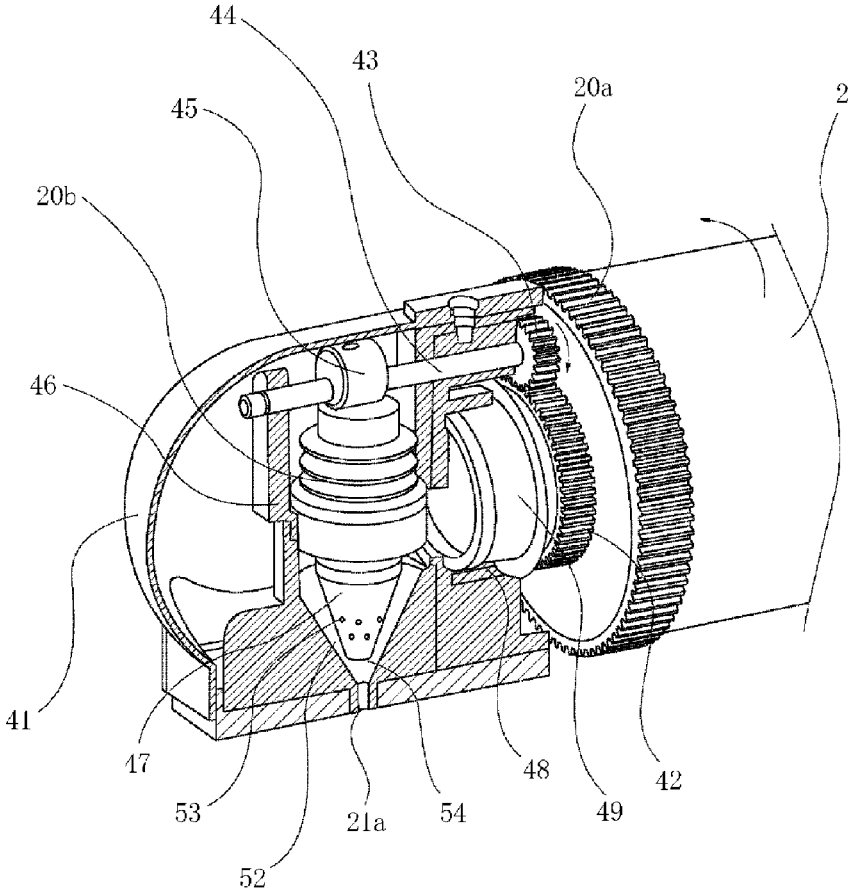

FIG. 66 is a partly sectional perspective view illustrating a structure of a developer supply container according to Embodiment 20.

Figure 67:
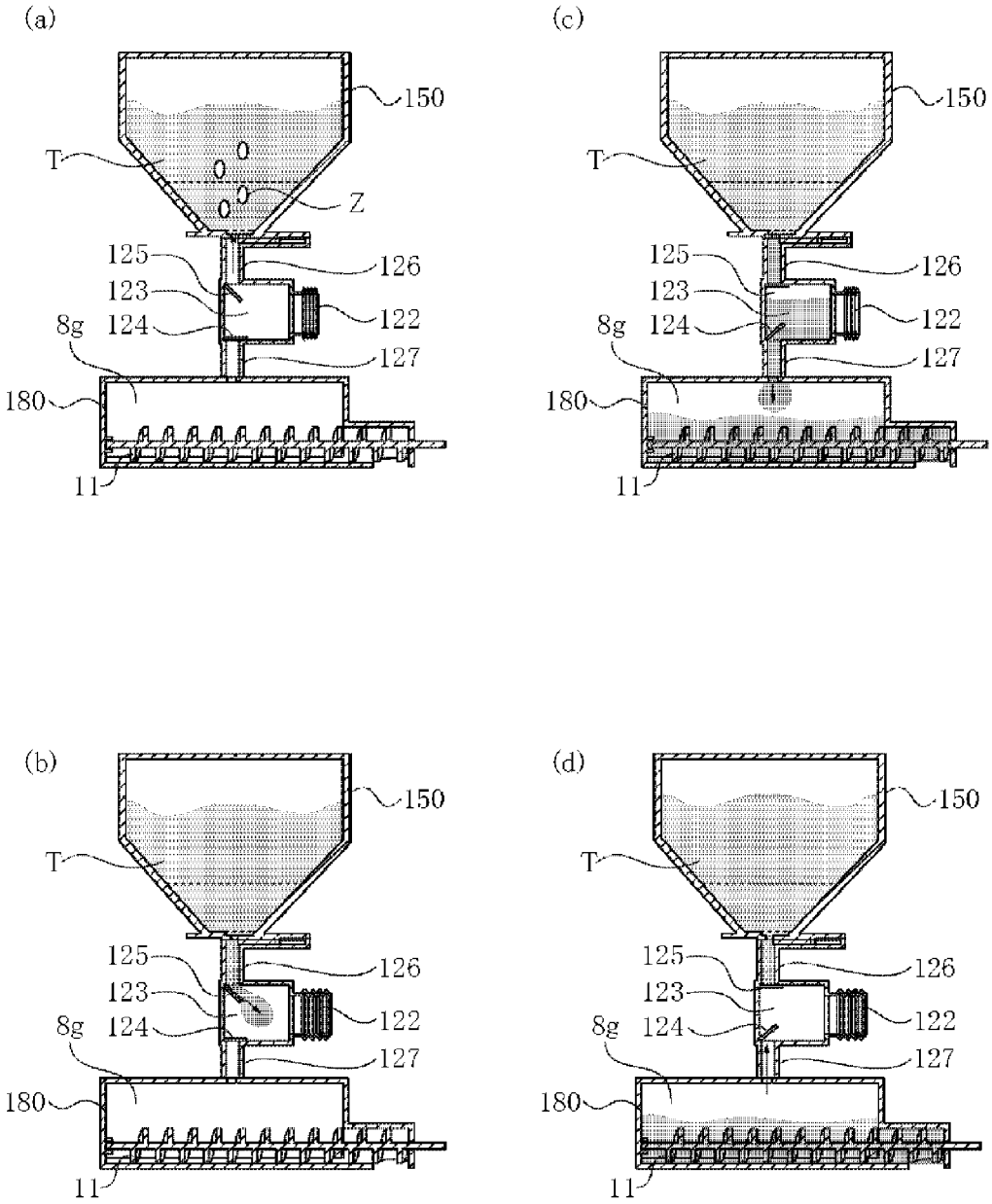

Part (a)-(d) of FIG. 67 are sectional views of the developer supply container and the developer replenishing apparatus of a comparison example, and illustrate a flow of the developer supplying steps.

Figure 68:
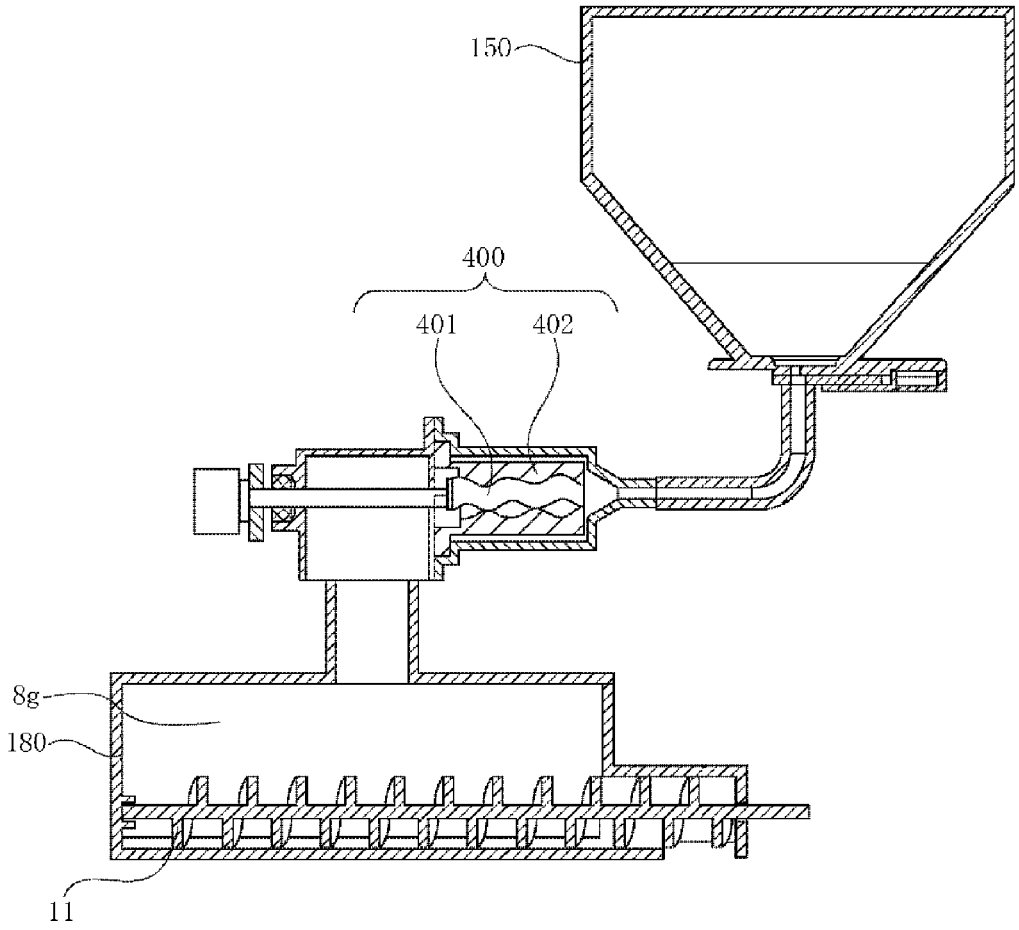

FIG. 68 is a sectional view of a developer supply container and a developer replenishing apparatus of another comparison example.

PREFERRED EMBODIMENTS OF THE INVENTION

In the following, the description will be made as to a developer supply container and a developer supplying system according to the present invention in detail. In the following description, various structures of the developer supply container may be replaced with other known structures having similar functions within the scope of the concept of invention unless otherwise stated. In other words, the present invention is not limited to the specific structures of the embodiments which will be described hereinafter, unless otherwise stated.

Embodiment 1

First, basic structures of an image forming apparatus will be described, and then, a developer replenishing apparatus and a developer supply container constituting a developer supplying system used in the image forming apparatus will be described.

(Image Forming Apparatus)

Figure 1:
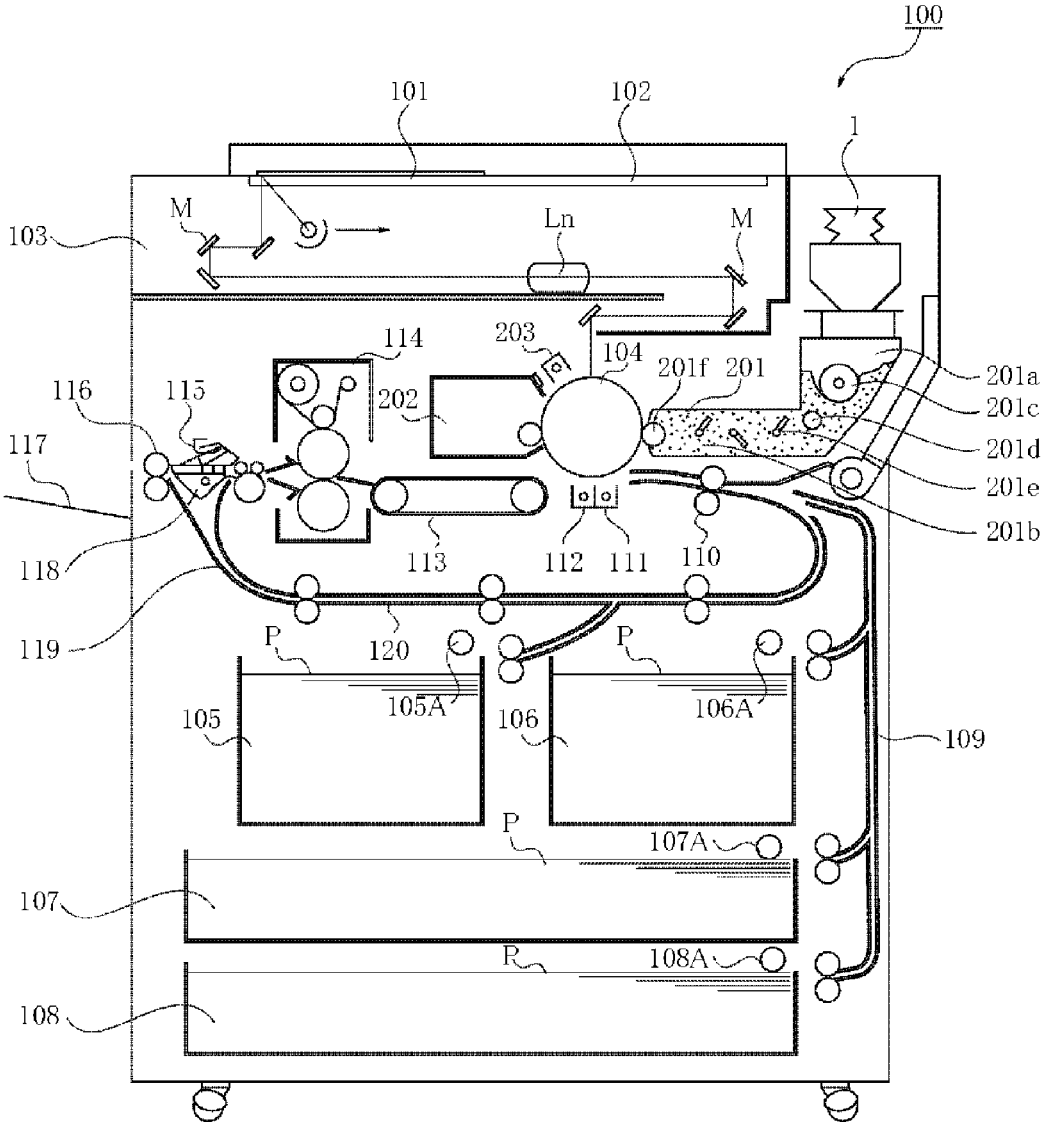
FIG. 1 is a sectional view of an example of an image forming apparatus.

Referring to FIG. 1, the description will be made as to structures of a copying machine (electrophotographic image forming apparatus) employing an electrophotographic type process as an example of an image forming apparatus using a developer replenishing apparatus to which a developer supply container (so-called toner cartridge) is detachably mountable. In the Figure, designated by 100 is a main assembly of the copying machine (main assembly of the image forming apparatus or main assembly of the apparatus). Designated by 101 is an original which is placed on an original supporting platen glass 102. A light image corresponding to image information of the original is imaged on an electrophotographic photosensitive member 104 (photosensitive member) by way of a plurality of mirrors M of an optical portion 103 and a lens Ln, so that an electrostatic latent image is formed. The electrostatic latent image is visualized with toner (one component magnetic toner) as a developer (dry powder) by a dry type developing device (one component developing device) 201*a*.

In this embodiment, the one component magnetic toner is used as the developer to be supplied from a developer supply container 1, but the present invention is not limited to the example and includes other examples which will be described hereinafter.

Specifically, in the case that a one component developing device using the one component non-magnetic toner is employed, the one component non-magnetic toner is supplied as the developer. In addition, in the case that a two component developing device using a two component developer containing mixed magnetic carrier and non-magnetic toner is employed, the non-magnetic toner is supplied as the developer. In such a case, both of the non-magnetic toner and the magnetic carrier may be supplied as the developer.

Designated by 105-108 are cassettes accommodating recording materials (sheets) S. Of the sheet S stacked in the cassettes 105-108, an optimum cassette is selected on the basis of a sheet size of the original 101 or information inputted by the operator (user) from a liquid crystal operating portion of the copying machine. The recording material is not limited to a sheet of paper, but OHP sheet or another material can be used as desired.

One sheet S supplied by a separation and feeding device 105A-108A is fed to registration rollers 110 along a feeding portion 109, and is fed at timing synchronized with rotation of a photosensitive member 104 and with scanning of an optical portion 103.

Designated by 111, 112 are a transfer charger and a separation charger. An image of the developer formed on the photosensitive member 104 is transferred onto the sheet S by a transfer charger 111. Then, the sheet S carrying the developed image (toner image) transferred thereonto is separated from the photosensitive member 104 by the separation charger 112.

Thereafter, the sheet S fed by the feeding portion 113 is subjected to heat and pressure in a fixing portion 114 so that the developed image on the sheet is fixed, and then passes through a discharging/reversing portion 115, in the case of one-sided copy mode, and subsequently the sheet S is discharged to a discharging tray 117 by discharging rollers 116.

In the case of a duplex copy mode, the sheet S enters the discharging/reversing portion 115 and a part thereof is ejected once to an outside of the apparatus by the discharging roller 116. The trailing end thereof passes through a flapper 118, and a flapper 118 is controlled when it is still nipped by the discharging rollers 116, and the discharging rollers 116 are rotated reversely, so that the sheet S is refed into the apparatus. Then, the sheet S is fed to the registration rollers 110 by way of re-feeding portions 119, 120, and then conveyed along the path similarly to the case of the one-sided copy mode and is discharged to the discharging tray 117.

In the main assembly of the apparatus 100, around the photosensitive member 104, there are provided image forming process equipment such as a developing device 201*a* as the developing means a cleaner portion 202 as a cleaning means, a primary charger 203 as charging means. The developing device 201*a* develops the electrostatic latent image formed on the photosensitive member 104 by the optical portion 103 in accordance with image information of the 101, by depositing the developer onto the latent image. The primary charger 203 uniformly charges a surface of the photosensitive member for the purpose of forming a desired electrostatic image on the photosensitive member 104. The cleaner portion 202 removes the developer remaining on the photosensitive member 104.

Figure 2:
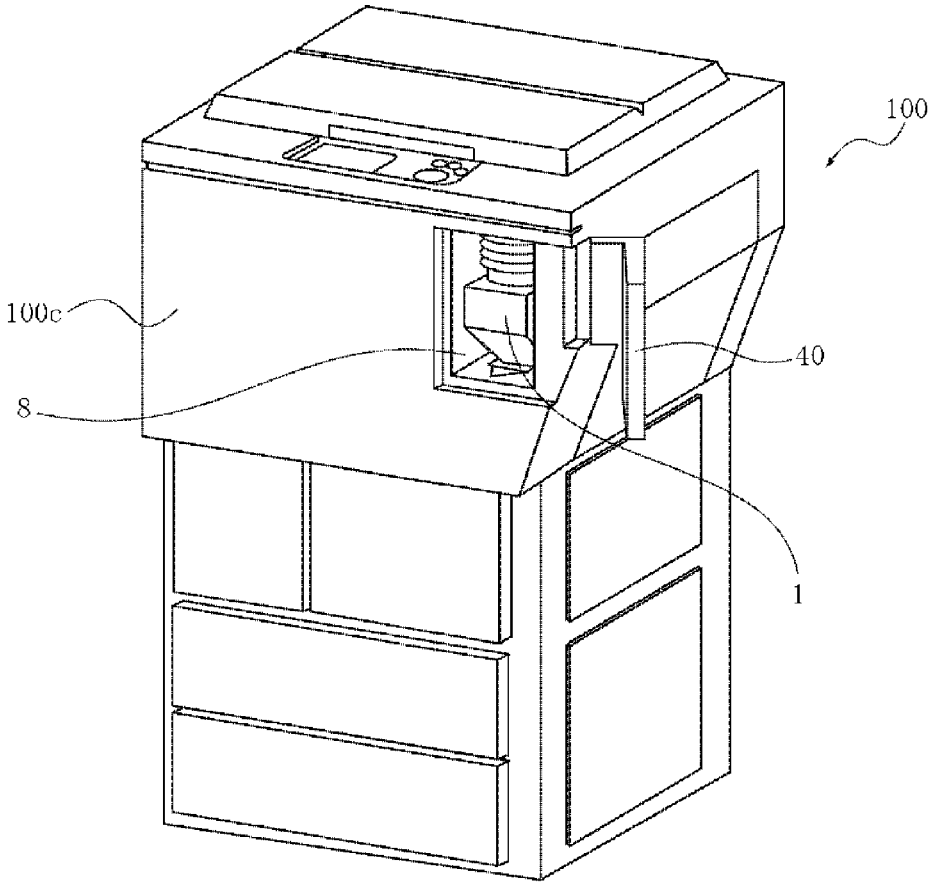
FIG. 2 is a perspective view of the image forming apparatus.

FIG. 2 is an outer appearance of the image forming apparatus. When an operator opens an exchange front cover 40 which is a part of an outer casing of the image forming apparatus, a part of a developer replenishing apparatus 8 which will be described hereinafter appears.

By inserting the developer supply container 1 into the developer replenishing apparatus 8, the developer supply container 1 is set into a state of supplying the developer into the developer replenishing apparatus 8. On the other hand, when the operator exchanges the developer supply container 1, the operation opposite to that for the mounting is carried out, by which the developer supply container 1 is taken out of the developer replenishing apparatus 8, and a new developer supply container 1 is set. The front cover 40 for the exchange is a cover exclusively for mounting and demounting (exchanging) the developer supply container 1 and is opened and closed only for mounting and demounting the developer supply container 1. In the maintenance operation for the main assembly of the device 100, a front cover 100*c* is opened and closed.

(Developer Replenishing Apparatus)

Figure 3:
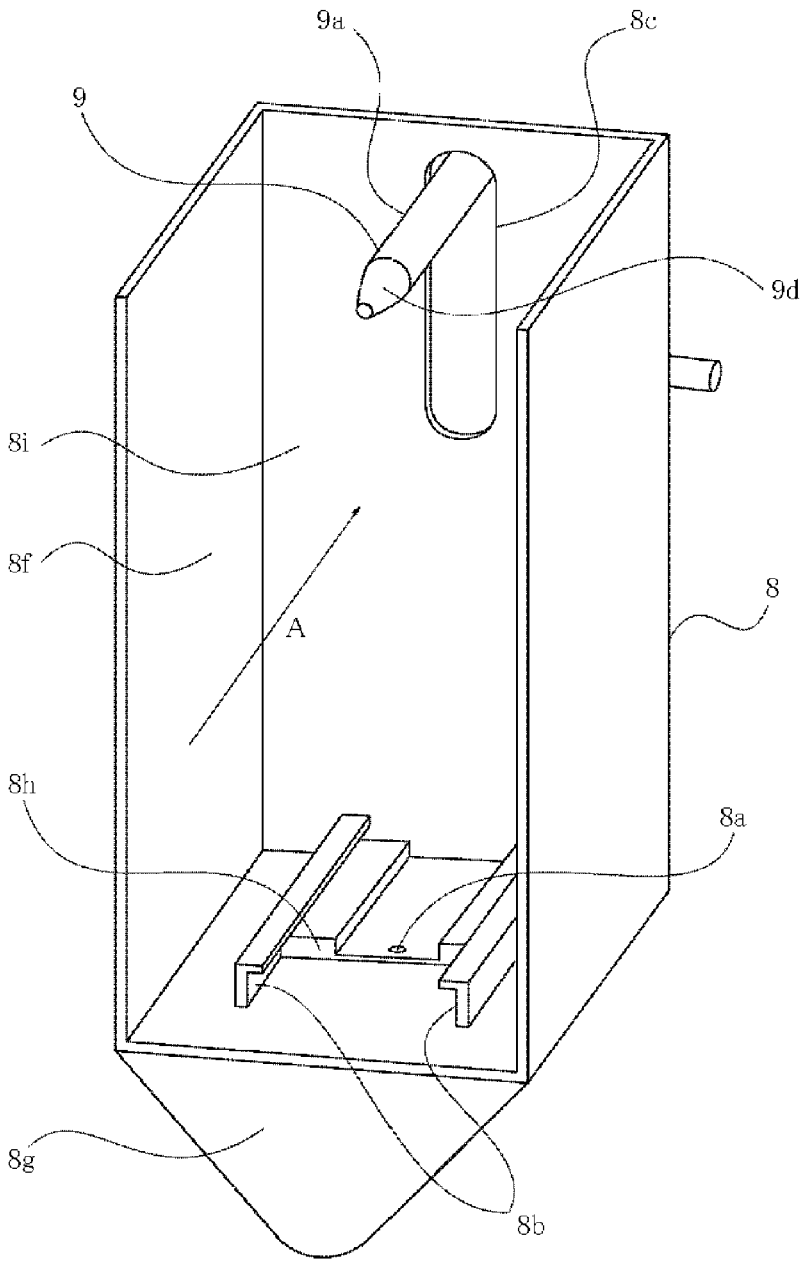
FIG. 3 is a perspective view of a developer replenishing apparatus according to an embodiment of the present invention.
Figure 4:
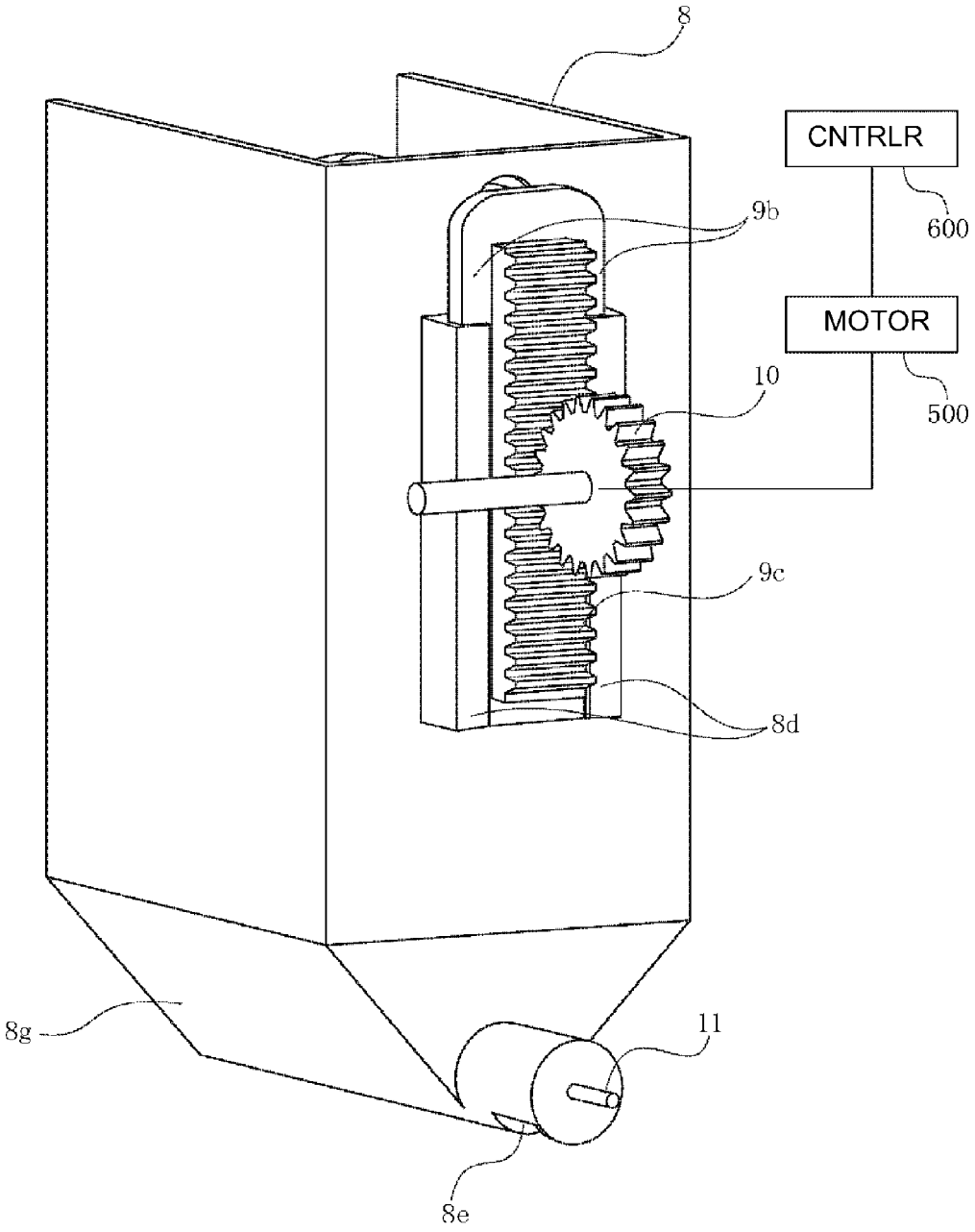
FIG. 4 is a perspective view of the developer replenishing apparatus of FIG. 3 as seen in a different direction.
Figure 5:
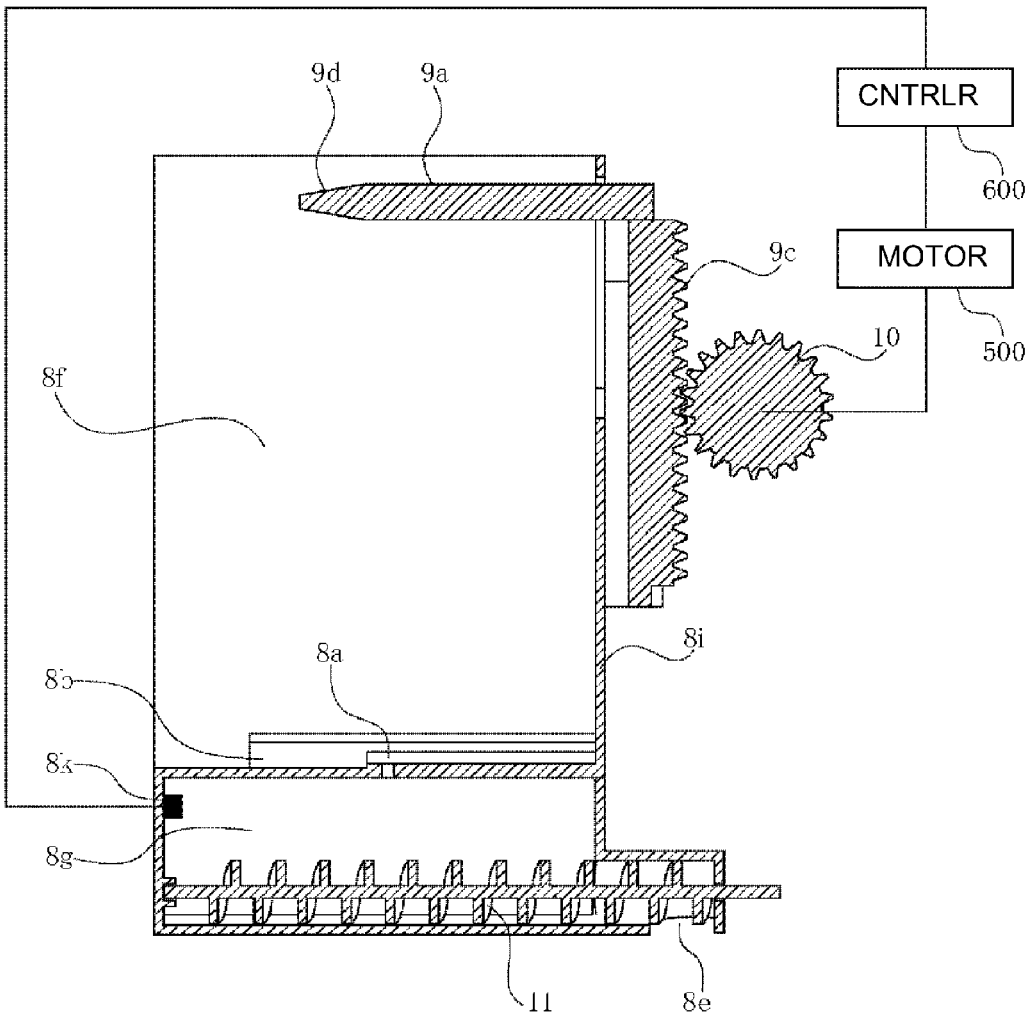
FIG. 5 is a sectional view of the developer replenishing apparatus of FIG. 3.

Referring to FIGS. 3, 4 and 5, the developer replenishing apparatus 8 will be described. FIG. 3 is a schematic perspective view of the developer replenishing apparatus 8. FIG. 4 is a schematic perspective view of the developer replenishing apparatus 8 as seen from the backside. FIG. 5 is a schematic sectional view of the developer replenishing apparatus 8.

The developer replenishing apparatus 8 is provided with a mounting portion (mounting space) to which the developer supply container 1 is demountable (detachably mountable). It is provided also with a developer receiving port (developer receiving hole) for receiving the developer discharged from a discharge opening (discharging port) 1*c* of the developer supply container 1 which will be described hereinafter. A diameter of the developer receiving port 8*a* is desirably substantially the same as that of the discharge opening 1*c* of the developer supply container 1 from the standpoint of preventing as much as possible contamination of the inside of a mounting portion 8*f* with the developer. When the diameters of the developer receiving port 8*a* and the discharge opening 1*c* are the same, the deposition of the developer to and the resulting contamination of the inner surface other than the port and the opening can be avoided.

In this example, the developer receiving port 8*a* is a minute opening (pin hole) correspondingly to the discharge opening 1*c* of the developer supply container 1, and the diameter is approx. 2 mm cp. There is provided a L-shaped positioning guide (holding member) 8*b* for fixing a position of the developer supply container 1, so that the mounting direction of the developer supply container 1 to the mounting portion 8*f* is the direction indicated by an arrow A. The removing direction of the developer supply container 1 from the mounting portion 8*f* is opposite to the direction A.

The developer replenishing apparatus 8 is provided in the lower portion with a hopper 8*g* for temporarily accumulates the developer As shown in FIG. 5, in the hopper 8*g*, there are provided a feeding screw 11 for feeding the developer into the developer hopper portion 201*a* which is a part of the developing device 201, and an opening 8*e* in fluid communication with the developer hopper portion 201*a*. In this embodiment, a volume of the hopper 8*g* is 130 $cm^3$.

As described hereinbefore, the developing device 201 of FIG. 1 develops, using the developer, the electrostatic latent image formed on the photosensitive member 104 on the basis of image information of the original 101. The developing device 201 is provided with a developing roller 201*f* in addition to the developer hopper portion 201*a*.

The developer hopper portion 201*a* is provided with a stirring member 201*c* for stirring the developer supplied from the developer supply container 1. The developer stirred by the stirring member 201*c* is fed to the feeding member 201*e* by a feeding member 201*d*.

The developer fed sequentially by the feeding members 201*e*, 201*b* is carried on the developing roller 201*f*, and is finally to the photosensitive member 104. As shown in FIGS. 3, 4, the developer replenishing apparatus 8 is further provided with a locking member 9 and a gear 10 which constitute a driving mechanism for driving the developer supply container 1 which will be described hereinafter.

The locking member 9 is locked with a locking portion 3 functioning as a drive inputting portion for the developer supply container 1 when the developer supply container 1 is mounted to the mounting portion 8*f* for the developer replenishing apparatus 8. The locking member 9 is loosely fitted in an elongate hole portion 8*c* formed in the mounting portion 8*f* of the developer replenishing apparatus 8, and movable up and down directions in the Figure relative to the mounting portion 8*f*. The locking member 9 is in the form of a round bar configuration and is provided at the free end with a tapered portion 9*d* in consideration of easy insertion into a locking portion 3 (FIG. 9) of the developer supply container 1 which will be described hereinafter.

The locking portion 9*a* (engaging portion engageable with locking portion 3) of the locking member 9 is connected with a rail portion 9*b* shown in FIG. 4, and the sides of the rail portion 9*b* are held by a guide portion 8*d* of the developer replenishing apparatus 8 and is movable in the up and down direction in the Figure.

The rail portion 9*b* is provided with a gear portion 9*c* which is engaged with a gear 10. The gear 10 is connected with a driving motor 500. By a control device 600 effecting such a control that the rotational moving direction of a driving motor 500 provided in the image forming apparatus 100 is periodically reversed, the locking member 9 reciprocates in the up and down directions in the Figure along the elongated hole 8*c*.

(Developer Supply Control of Developer Replenishing Apparatus)

Figure 6:
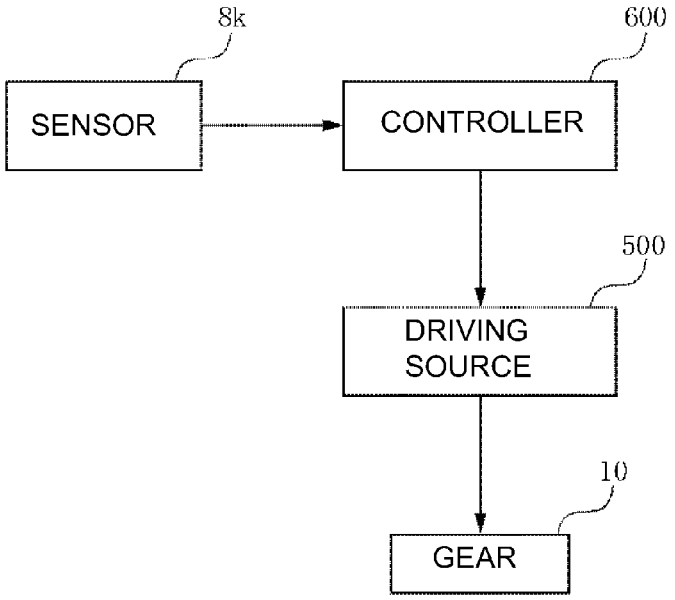
FIG. 6 is a block diagram illustrating a function and a structure of a control device.
Figure 7:
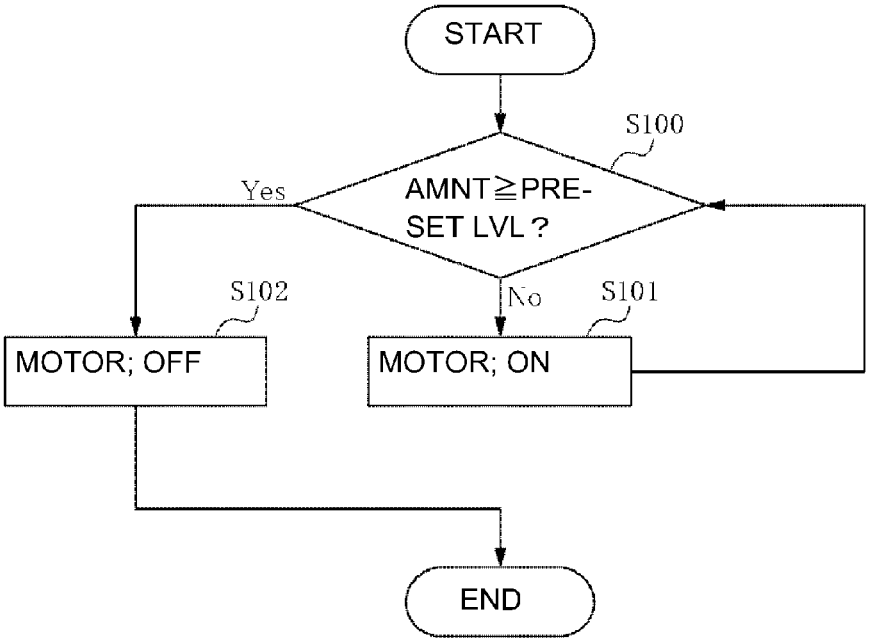
FIG. 7 is a flow chart illustrating a flow of a supplying operation.

Referring to FIGS. 6, 7, a developer supply control by the developer replenishing apparatus 8 will be described. FIG. 6 is a block diagram illustrating the function and the structure of the control device 600, and FIG. 7 is a flow chart illustrating a flow of the supplying operation.

In this example, an amount of the developer temporarily accumulated in the hopper 8*g* (height of the developer level) is limited so that the developer does not flow reversely into the developer supply container 1 from the developer replenishing apparatus 8 by the suction operation of the developer supply container 1 which will be described hereinafter. For this purpose, in this example, a developer sensor 8*k* (FIG. 5) is provided to detect the amount of the developer accommodated in the hopper 8*g*.

As shown in FIG. 6, the control device 600 controls the operation/non-operation of the driving motor 500 in accordance with an output of the developer sensor 8*k* by which the developer is not accommodated in the hopper 8*g* beyond a predetermined amount.

A flow of a control sequence therefor will be described. First, as shown in FIG. 7, the developer sensor 8*k* checks the accommodated developer amount in the hopper 8*g*. When the accommodated developer amount detected by the developer sensor 8*k* is discriminated as being less than a predetermined amount, that is, when no developer is detected by the developer sensor 8*k*, the driving motor 500 is actuated to execute a developer supplying operation for a predetermined time period (S101).

The accommodated developer amount detected with developer sensor 8*k* is discriminated as having reached the predetermined amount, that is, when the developer is detected by the developer sensor 8*k*, as a result of the developer supplying operation, the driving motor 500 is deactuated to stop the developer supplying operation (S102). By the stop of the supplying operation, a series of developer supplying steps is completed.

Such developer supplying steps are carried out repeatedly whenever the accommodated developer amount in the hopper 8*g* becomes less than a predetermined amount as a result of consumption of the developer by the image forming operations.

In this example, the developer discharged from the developer supply container 1 is stored temporarily in the hopper 8*g*, and then is supplied into the developing device, but the following structure of the developer replenishing apparatus can be employed.

Figure 8:
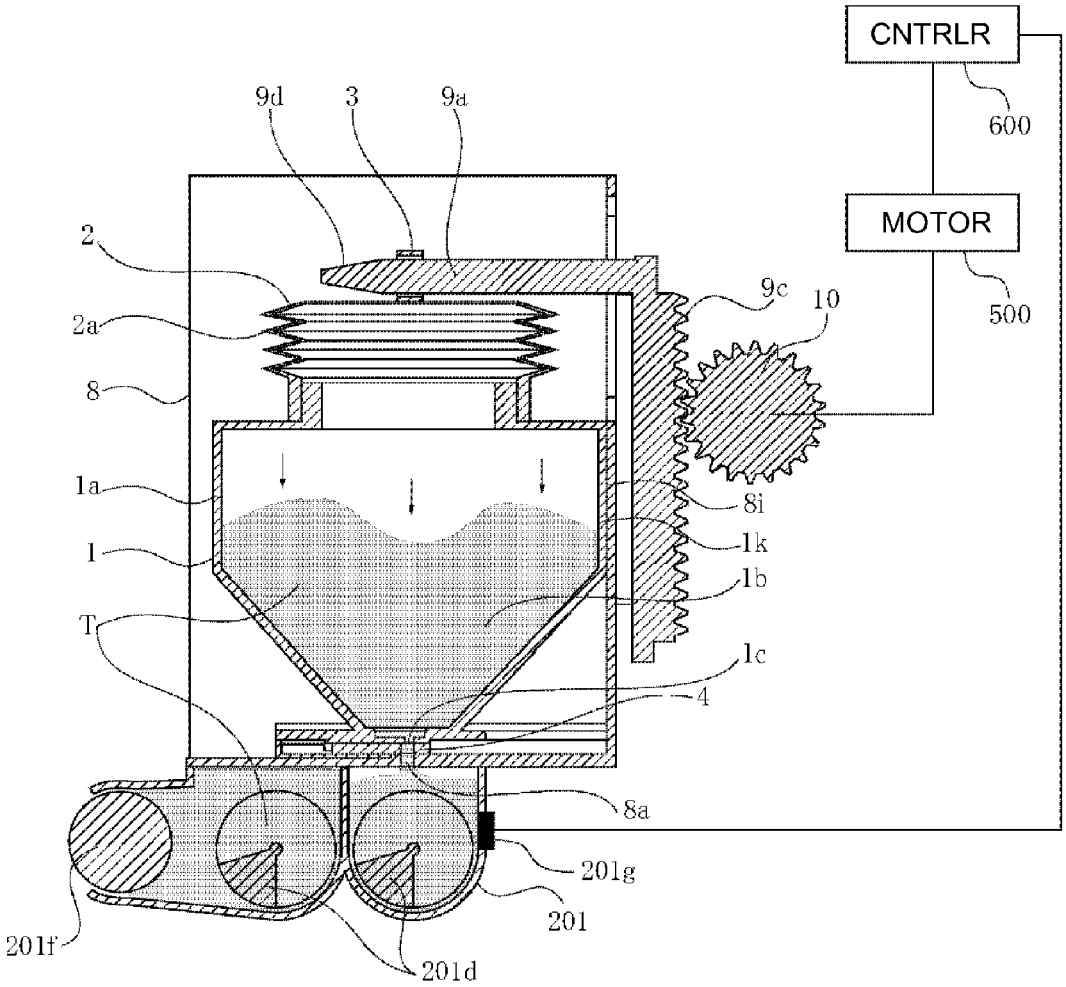
FIG. 8 is a sectional view illustrating a developer replenishing apparatus without a hopper and a mounting state of the developer supply container.

Particularly in the case of a low speed image forming apparatus, the main assembly is required to be compact and low in cost. In such a case, it is desirable that the developer is supplied directly to the developing device 201, as shown in FIG. 8.

More particularly, the above-described hopper 8*g* is omitted, and the developer is supplied directly into the developing device 201*a* from the developer supply container 1. FIG. 8 shows an example using a two component developing device 201 a developer replenishing apparatus. The developing device 201 comprises a stirring chamber into which the developer is supplied, and a developer chamber for supplying the developer to the developing roller 201*f*, wherein the stirring chamber and the developer chamber are provided with screws 201*d* rotatable in such directions that the developer is fed in the opposite directions from each other. The stirring chamber and the developer chamber are communicated with each other in the opposite longitudinal end portions, and the two component developer are circulated the two chambers. The stirring chamber is provided with a magnetometric sensor 201*g* for detecting a toner content of the developer, and on the basis of the detection result of the magnetometric sensor 201*g*, the control device 600 controls the operation of the driving motor 500. In such a case, the developer supplied from the developer supply container is non-magnetic toner or non-magnetic toner plus magnetic carrier.

In this example, as will be described hereinafter, the developer in the developer supply container 1 is hardly discharged through the discharge opening 1*c* only by the gravitation, but the developer is by a discharging operation by a pump 2, and therefore, variation in the discharge amount can be suppressed. Therefore, the developer supply container 1 which will be described hereinafter is usable for the example of FIG. 8 lacking the hopper 8*g*.

(Developer Supply Container)

Figure 9:
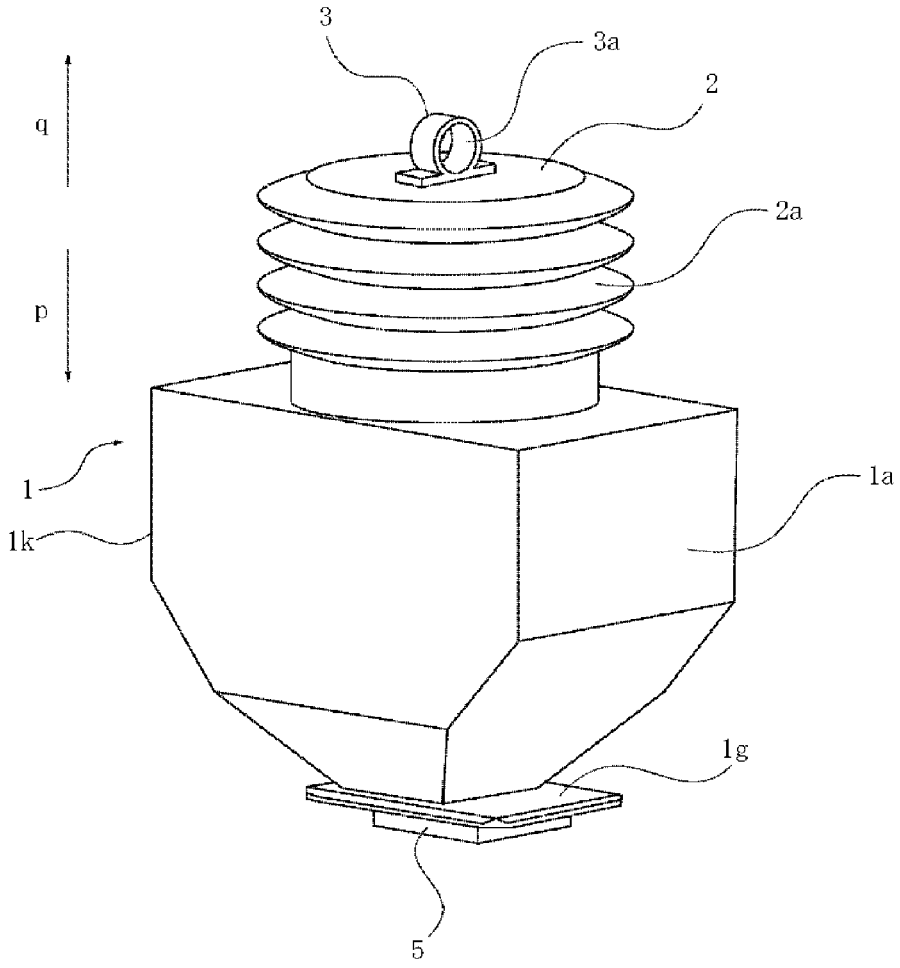
FIG. 9 is a perspective view illustrating a developer supply container according to an embodiment of the present invention
Figure 10:
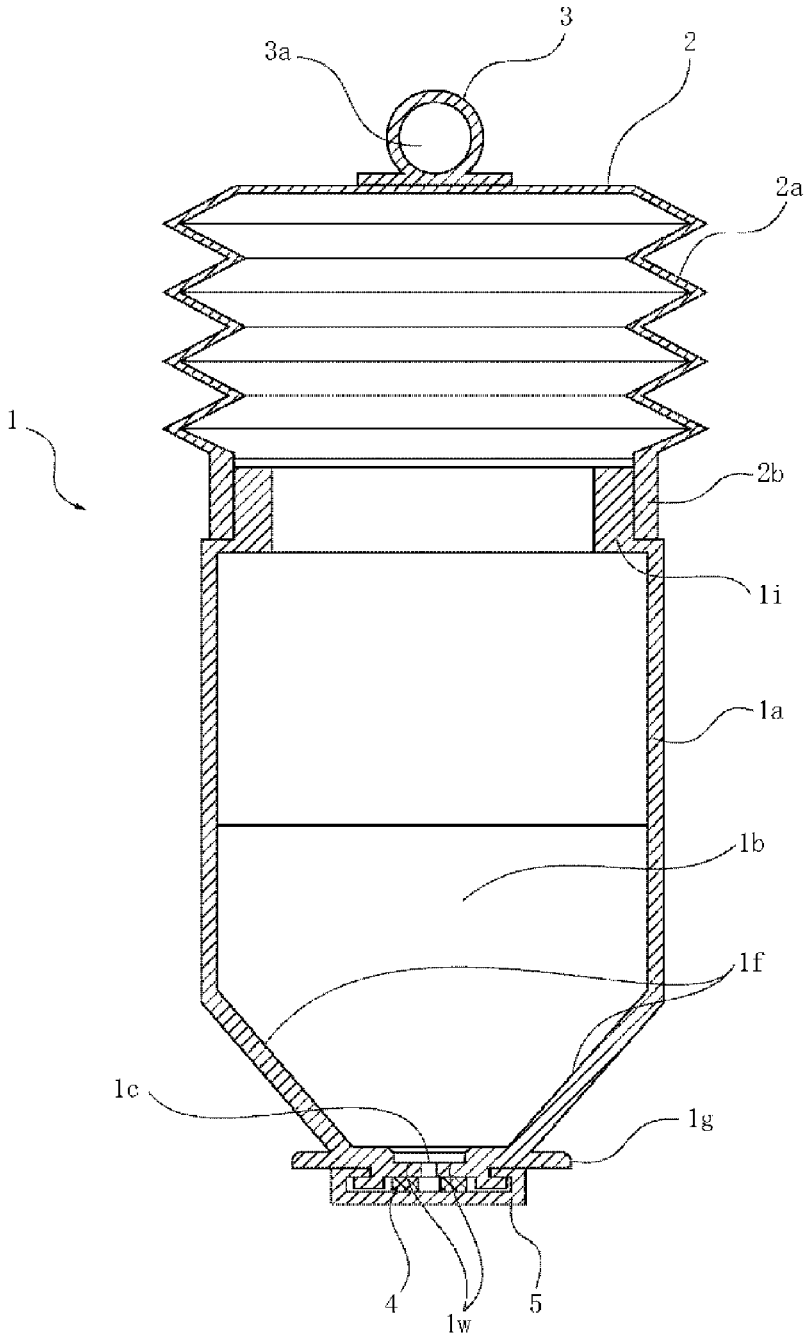
FIG. 10 is a sectional view illustrating a developer supply container according to an embodiment of the present invention.

Referring to FIGS. 9 and 10, the structure of the developer supply container 1 according to the embodiment will be described.

FIG. 9 is a schematic perspective view of the developer supply container 1. FIG. 10 is a schematic sectional view of the developer supply container 1.

As shown in FIG. 9, the developer supply container 1 has a container body 1*a* functioning as a developer accommodating portion for accommodating the developer. Designated by 1*b* in FIG. 10 is a developer accommodating space in which the developer is accommodated in the container body 1*a*. In the example, the developer accommodating space 1*b* functioning as the developer accommodating portion is the space in the container body 1*a* plus an inside space in the pump 2. In this example, the developer accommodating space 1*b* accommodates toner which is dry powder having a volume average particle size of 5-6 μm.

In this embodiment, the pump portion is a displacement type pump 2 in which the volume changes. More particularly, the pump 2 has a bellow-like expansion-and-contraction portion 2*a* (bellow portion, expansion-and-contraction member) which can be contracted and expanded by a driving force received from the developer replenishing apparatus 8.

As shown in FIGS. 9, 10, the bellow-like pump 2 of this example is folded to provide crests and bottoms which are provided alternately and periodically, and is contractable and expandable. When the bellow-like pump 2 as in this example, a variation in the volume change amount relative to the amount of expansion and contraction can be reduced, and therefore, a stable volume change can be accomplished.

In this embodiment, the all volume of the developer accommodating space 1*b* is 480 $cm^3$, of which the volume of the pump portion 2 is 160 $cm^3$ (in the free state of the expansion-and-contraction portion 2*a*), and in this example, the pumping operation is effected in the pump portion (2) expansion direction from the length in the free state.

The volume change amount by the expansion and contraction of the expansion-and-contraction portion 2*a* of the pump portion 2 is 15 $cm^3$, and the total volume at the time of maximum expansion of the pump 2 is 495 $cm^3$.

The developer supply container 1 filled with 240 g of developer.

The driving motor 500 for driving the locking member 9 is controlled by the control device 600 to provide a volume change speed of 90 $cm^3$/s. The volume change amount and the volume change speed may be properly selected in consideration of a required discharge amount of the developer replenishing apparatus 8.

The pump 2 in this example is a bellow-like pump, but another pump is usable if the air amount (pressure) in the developer accommodating space 1*b* can be changed. For example, the pump portion 2 may be a single-shaft eccentric screw pump. In such a case, an additional opening is required to permit suction and discharging by the single-shaft eccentric screw pump is necessary, and the provision of the opening requires means such as a filter for preventing leakage of the developer around the opening. In addition, a single-shaft eccentric screw pump requires a very high torque to operate, and therefore, the load to the main assembly of the image forming apparatus 100 increases. Therefore, the bellow-like pump is preferable since it is free of such problems.

The developer accommodating space 1*b* may be only the inside space of the pump portion 2. In such a case, the pump portion 2 functions simultaneously as the developer accommodating portion 1*b*.

A connecting portion 2*b* of the pump portion 2 and the connected portion 1*i* of the container body 1*a* are unified by welding to prevent leakage of the developer, that is, to keep the hermetical property of the developer accommodating space 1*b*.

The developer supply container 1 is provided with the locking portion 3 as a drive inputting portion (driving force receiving portion, drive connecting portion, engaging portion) which is engageable with the driving mechanism of the developer replenishing apparatus 8 and which receives a driving force for driving the pump portion 2 from the driving mechanism.

More particularly, the locking portion 3 engageable with the locking member 9 of the developer replenishing apparatus 8 is mounted by an adhesive material to an upper end of the pump portion 2. The locking portion 3 includes a locking hole 3*a* in the center portion thereof, as shown in FIG. 9. When the developer supply container 1 is mounted to the mounting portion 8*f* (FIG. 3), the locking member 9 is inserted into the locking hole 3*a*, so that they are unified (slight play is provided for easy insertion). As shown in FIG. 9, the relative position between the locking portion 3 and the locking member 9 in p direction and q direction which are expansion and contraction directions of the expansion-and-contraction portion 2*a*. It is preferable that the pump portion 2 and the locking portion 3 are molded integrally using an injection molding method or a blow molding method.

The locking portion 3 unified substantially with the locking member 9 in this manner receives a driving force for expanding and contracting the expansion-and-contraction portion 2*a* of the pump portion 2 from the locking member 9. As a result, with the vertical movement of the locking member 9, the expansion-and-contraction portion 2*a* of the pump portion 2 is expanded and contracted.

The pump portion 2 functions as an air flow generating mechanism for producing alternately and repeatedly the air flow into the developer supply container and the air flow to the outside of the developer supply container through the discharge opening 1*c* by the driving force received by the locking portion 3 functioning as the drive inputting portion.

In this embodiment, the use is made with the round bar locking member 9 and the round hole locking portion 3 to substantially unify them, but another structure is usable if the relative position therebetween can be fixed with respect to the expansion and contraction direction (p direction and q direction) of the expansion-and-contraction portion 2*a*. For example, the locking portion 3 is a rod-like member, and the locking member 9 is a locking hole; the cross-sectional configurations of the locking portion 3 and the locking member 9 may be triangular, rectangular or another polygonal, or may be ellipse, star shape or another shape. Or, another known locking structure is usable.

In a flange portion 1 *g* at the bottom end portion of the container body 1*a*, a discharge opening 1*c* for permitting discharging of the developer in the developer accommodating space 1*b* to the outside of the developer supply container 1 is provided. The discharge opening 1*c* will be described in detail hereinafter.

As shown in FIG. 10, an inclined surface if is formed toward the discharge opening 1*c* in a lower portion of the container body 1*a*, the developer accommodated in the developer accommodating space 1*b* slides down on the inclined surface if by the gravity toward a neighborhood of the discharge opening 1*c*. In this embodiment, the inclination angle of the inclined surface if (angle relative to a horizontal surface in the state that the developer supply container 1 is set in the developer replenishing apparatus 8) is larger than an angle of rest of the toner (developer).

Figure 11:
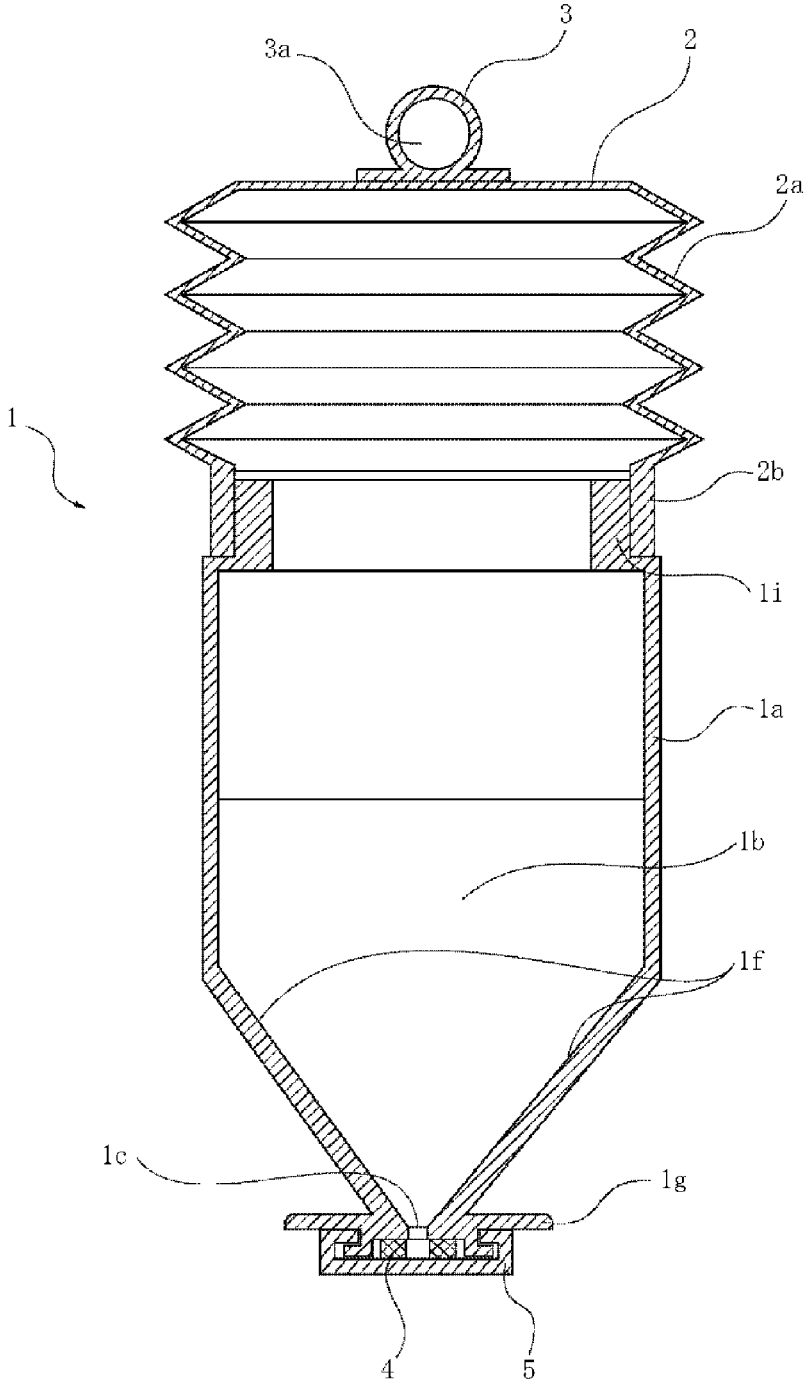
FIG. 11 is a sectional view illustrating the developer supply container in which a discharge opening and an inclined surface are connected with each other.

The configuration of the peripheral portion of the discharge opening 1*c* is not limited to the shape shown in FIG. 10, in which the configuration of the connecting portion between the discharge opening 1*c* and the inside of the container body 1*a* is flat (1 W in FIG. 10), but may be as shown in FIG. 11 in which the inclined surface if is extended to the discharge opening 1*c*.

The flat configuration shown in FIG. 10, a space efficiency is good with respect to the direction of height of the developer supply container 1, and the inclined surface if of FIG. 11 is advantageous in that the remaining amount is small since the developer remaining on the inclined surface if is promoted toward the discharge opening 1*c*. Therefore, the configuration of the peripheral portion of it discharge opening 1*c* may be selected as desired.

In this embodiment, the flat configuration shown in FIG. 10 is selected.

The developer supply container 1 is in fluid communication with the outside of the developer supply container 1 only through the discharge opening 1*c*, and is sealed substantially except for the discharge opening 1*c*.

Referring to FIGS. 3, 10, a shutter mechanism for opening and closing the discharge opening 1*c* will be described.

A sealing member 4 of an elastic material is fixed by bonding to a lower surface of the flange portion 1 *g* so as to surround the circumference of the discharge opening 1*c* to prevent developer leakage. A shutter 5 for sealing the discharge opening 1*c* is provided so as to compress the sealing member 4 between the shutter 5 and a lower surface of the flange portion 1*g*.

The shutter 5 is normally urged (by expanding force of a spring) in a close direction by a spring (not shown) which is an urging member. The shutter 5 is unsealed in interrelation with mounting operation of the developer supply container 1 by abutting to an end surface of the abutting portion 8*h* (FIG. 3) formed on the developer replenishing apparatus 8 and contracting the spring. At this time, the flange portion 1 *g* of the developer supply container 1 is inserted between an abutting portion 8*h* and the positioning guide 8*b* provided in the developer replenishing apparatus 8, so that a side surface 1*k* (FIG. 9) of the developer supply container 1 abuts to a stopper portion 8*i* of the developer replenishing apparatus 8. As a result, the position relative to the developer replenishing apparatus 8 in the mounting direction (A direction) is determined (FIG. 17).

The flange portion 1 *g* is guided by the positioning guide 8*b* in this manner, and at the time when the inserting operation of the developer supply container 1 is completed, the discharge opening 1*c* and the developer receiving port 8*a* are aligned with each other.

In addition, when the inserting operation of the developer supply container 1 is completed, the space between the discharge opening 1*c* and the receiving port 8*a* is sealed by the sealing member 4 (FIG. 17) to prevent leakage of the developer to the outside.

With the inserting operation of the developer supply container 1, the locking member 9 is inserted into the locking hole 3*a* of the locking portion 3 of the developer supply container 1 so that they are unified.

At this time, the position thereof is determined by the L shape portion of the positioning guide 8*b* in the direction (up and down direction in FIG. 3) perpendicular to the mounting direction (A direction), relative to the developer replenishing apparatus 8, of the developer supply container 1. The flange portion 1 *g* as the positioning portion also functions to prevent movement of the developer supply container 1 in the up and down direction (reciprocation direction of the pump 2).

The operations up to here are the series of mounting steps for the developer supply container 1. By the operator closing the front cover 40, the mounting step is finished.

The steps for dismounting the developer supply container 1 from the developer replenishing apparatus 8 are opposite from those in the mounting step.

More particularly, the exchange front cover 40 is opened, and the developer supply container 1 is dismounted from the mounting portion 8*f*. At this time, the interfering state by the abutting portion 8*h* is released, by which the shutter 5 is closed by the spring (not shown).

In this example, the state (decompressed state, negative pressure state) in which the internal pressure of the container body 1*a* (developer accommodating space 1*b*) is lower than the ambient pressure (external air pressure) and the state (compressed state, positive pressure state) in which the internal pressure is higher than the ambient pressure are alternately repeated at a predetermined cyclic period. Here, the ambient pressure (external air pressure) is the pressure under the ambient condition in which the developer supply container 1 is placed.

Thus, the developer is discharged through the discharge opening 1*c* by changing a pressure (internal pressure) of the container body 1*a*. In this example, it is changed (reciprocated) between 480-495 $cm^3$ at a cyclic period of 0.3 sec. The material of the container body 1 is preferably such that it provides an enough rigidity to avoid collision or extreme expansion.

In view of this, this example employs polystyrene resin material as the materials of the developer container body 1*a* and employs polypropylene resin material as the material of the pump 2.

As for the material for the container body 1*a*, other resin materials such as ABS (acrylonitrile, butadiene, styrene copolymer resin material), polyester, polyethylene, polypropylene, for example are usable if they have enough durability against the pressure. Alternatively, they may be metal.

As for the material of the pump 2, any material is usable if it is expansible and contractable enough to change the internal pressure of the space in the developer accommodating space 1*b* by the volume change. The examples includes thin formed ABS (acrylonitrile, butadiene, styrene copolymer resin material), polystyrene, polyester, polyethylene materials. Alternatively, other expandable-and-contractable materials such as rubber are usable.

They may be integrally molded of the same material through an injection molding method, a blow molding method or the like if the thicknesses are properly adjusted for the pump 2*b* and the container body 1*a*.

In this example, the developer supply container 1 is in fluid communication with the outside only through the discharge opening 1*c*, and therefore, it is substantially sealed from the outside except for the discharge opening 1*c*. That is, the developer is discharged through discharge opening 1*c* by compressing and decompressing the inside of the developer supply container 1, and therefore, the hermetical property is desired to maintain the stabilized discharging performance.

On the other hand, there is a liability that during transportation (air transportation) of the developer supply container 1 and/or in long term unused period, the internal pressure of the container may abruptly changes due to abrupt variation of the ambient conditions. For an example, when the apparatus is used in a region having a high altitude, or when the developer supply container 1 kept in a low ambient temperature place is transferred to a high ambient temperature room, the inside of the developer supply container 1 may be pressurized as compared with the ambient air pressure. In such a case, the container may deform, and/or the developer may splash when the container is unsealed.

In view of this, the developer supply container 1 is provided with an opening of a diameter φ 3 mm, and the opening is provided with a filter. The filter is TEMISH (registered Trademark) available from Nitto Denko Kabushiki Kaisha, Japan, which is provided with a property preventing developer leakage to the outside but permitting air passage between inside and outside of the container. Here, in this example, despite the fact that such a countermeasurement is taken, the influence thereof to the sucking operation and the discharging operation through the discharge opening 1*c* by the pump 2 can be ignored, and therefore, the hermetical property of the developer supply container 1 is kept in effect.

(Discharge Opening of Developer Supply Container)

In this example, the size of the discharge opening 1*c* of the developer supply container 1 is so selected that in the orientation of the developer supply container 1 for supplying the developer into the developer replenishing apparatus 8, the developer is not discharged to a sufficient extent, only by the gravitation. The opening size of the discharge opening 1*c* is so small that the discharging of the developer from the developer supply container is insufficient only by the gravitation, and therefore, the opening is called pin hole hereinafter. In other words, the size of the opening is determined such that the discharge opening 1*c* is substantially clogged. This is expectedly advantageous in the following points.

(1) the developer does not easily leak through the discharge opening 1*c*.

(2) excessive discharging of the developer at time of opening of the discharge opening 1*c* can be suppressed.

(3) the discharging of the developer can rely dominantly on the discharging operation by the pump portion.

The inventors have investigated as to the size of the discharge opening 1*c* not enough to discharge the toner to a sufficient extent only by the gravitation. The verification experiment (measuring method) and criteria will be described.

A rectangular parallelepiped container of a predetermined volume in which a discharge opening (circular) is formed at the center portion of the bottom portion is prepared, and is filled with 200 g of developer; then, the filling port is sealed, and the discharge opening is plugged; in this state, the container is shaken enough to loosen the developer. The rectangular parallelepiped container has a volume of 1000 $cm^3$, 90 mm in length, 92 mm width and 120 mm in height.

Thereafter, as soon as possible the discharge opening is unsealed in the state that the discharge opening is directed downwardly, and the amount of the developer discharged through the discharge opening is measured. At this time, the rectangular parallelepiped container is sealed completely except for the discharge opening. In addition, the verification experiments were carried out under the conditions of the temperature of 24□ and the relative humidity of 55%.

Using these processes, the discharge amounts are measured while changing the kind of the developer and the size of the discharge opening. In this example, when the amount of the discharged developer is not more than 2 g, the amount is negligible, and therefore, the size of the discharge opening at that time is deemed as being not enough to discharge the developer sufficiently only by the gravitation.

The developers used in the verification experiment are shown in Table 1. The kinds of the developer are one component magnetic toner, non-magnetic toner for two component developer developing device and a mixture of the non-magnetic toner and the magnetic carrier.

As for property values indicative of the property of the developer, the measurements are made as to angles of rest indicating flowabilities, and fluidity energy indicating easiness of loosing of the developer layer, which is measured by a powder flowability analyzing device (Powder Rheometer FT4 available from Freeman Technology)

TABLE 1

| Developers | Volume average particle size of toner (μm) | Developer component | Angle of rest (deg.) | Fluidity energy (Bulk density of 0.5 $g/cm^3$) |
|---|---|---|---|---|
| A | 7 | Two-component non-magnetic | 18 | $2.09 \times 10^{-3}$ J |
| B | 6.5 | Two-component non-magnetic toner + carrier | 22 | $6.80 \times 10^{-4}$ J |

TABLE 1-continued

| Developers | Volume average particle size of toner (μm) | Developer component | Angle of rest (deg.) | Fluidity energy (Bulk density of 0.5 g/cm$^3$) |
|---|---|---|---|---|
| C | 7 | One-component magnetic toner | 35 | $4.30 \times 10^{-4}$ J |
| D | 5.5 | Two-component non-magnetic toner + carrier | 40 | $3.51 \times 10^{-3}$ J |
| E | 5 | Two-component non-magnetic toner + carrier | 27 | $4.14 \times 10^{-3}$ J |

Referring to FIG. 12 a measuring method for the fluidity energy will be described. Here, FIG. 12 is a schematic view of a device for measuring the fluidity energy.

The principle of the powder flowability analyzing device is that a blade is moved in a powder sample, and the energy required for the blade to move in the powder, that is, the fluidity energy, is measured. The blade is of a propeller type, and when it rotates, it moves in the rotational axis direction simultaneously, and therefore, a free end of the blade moves helically.

The propeller type blade 51 is made of SUS (type=C210) and has a diameter of 48 mm, and is twisted smoothly in the counterclockwise direction. More specifically, from a center of the blade of 48 mm×10 mm, a rotation shaft extends in a normal line direction relative to a rotation plane of the blade, a twist angle of the blade at the opposite outermost edge portions (the positions of 24 mm from the rotation shaft) is 70°, and a twist angle at the positions of 12 mm from the rotation shaft is 35°.

The fluidity energy is total energy provided by integrating with time a total sum of a rotational torque and a vertical load when the helical rotating blade 51 enters the powder layer and advances in the powder layer. The value thus obtained indicates easiness of loosening of the developer powder layer, and large fluidity energy means less easiness and small fluidity energy means greater easiness.

In this measurement, as shown in FIG. 12, the developer T is filled up to a powder surface level of 70 mm (L2 in FIG. 12) into the cylindrical container 53 having a diameter φ of 50 mm (volume=200 cc, L1 (FIG. 12)=50 mm) which is the standard part of the device. The filling amount is adjusted in accordance with a bulk density of the developer to measure. The blade 54 of φ48 mm which is the standard part is advanced into the powder layer, and the energy required to advance from depth 10 mm to depth 30 mm is displayed.

The set conditions at the time of measurement are,

The rotational speed of the blade 51 (tip speed=peripheral speed of the outermost edge portion of the blade) is 60 mm/s:

The blade advancing speed in the vertical direction into the powder layer is such a speed that an angle θ (helix angle) formed between a track of the outermost edge portion of the blade 51 during advancement and the surface of the powder layer is 10°:

The advancing speed into the powder layer in the perpendicular direction is 11 mm/s (blade advancement speed in the powder layer in the vertical direction=(rotational speed of blade)×tan(helix angle×80)): and The measurement is carried out under the condition of temperature of 24□ and relative humidity of 55%.

The bulk density of the developer when the fluidity energy of the developer is measured is close to that when the experiments for verifying the relation between the discharge amount of the developer and the size of the discharge opening, is less changing and is stable, and more particularly is adjusted to be 0.5 g/cm$^3$.

The verification experiments were carried out for the developers (Table 1) with the measurements of the fluidity energy in such a manner. FIG. 13 is a graph showing relations between the diameters of the discharge openings and the discharge amounts with respect to the respective developers.

From the verification results shown in FIG. 13, it has been confirmed that the discharge amount through the discharge opening is not more than 2 g for each of the developers A-E, if the diameter φ of the discharge opening is not more than 4 mm (12.6 mm$^2$ in the opening area (circle ratio=3.14)). When the diameter φ discharge opening exceeds 4 mm, the discharge amount increases sharply.

The diameter φ of the discharge opening is preferably not more than 4 mm (12.6 mm$^2$ of the opening area) when the fluidity energy of the developer (0.5 g/cm$^3$ of the bulk density) is not less than $4.3\times10^{-4}$ kg-m$^2$/s$^2$ (J) and not more than $4.14\times10^{-3}$ kg-m$^2$/s$^2$ (J).

As for the bulk density of the developer, the developer has been loosened and fluidized sufficiently in the verification experiments, and therefore, the bulk density is lower than that expected in the normal use condition (left state), that is, the measurements are carried out in the condition in which the developer is more easily discharged than in the normal use condition.

The verification experiments were carries out as to the developer A with which the discharge amount is the largest in the results of FIG. 13, wherein the filling amount in the container were changed in the range of 30-300 g while the diameter φ of the discharge opening is constant at 4 mm. The verification results are shown in FIG. 10. From the results of FIG. 14, it has been confirmed that the discharge amount through the discharge opening hardly changes even if the filling amount of the developer changes.

From the foregoing, it has been confirmed that by making the diameter φ of the discharge opening not more than 4 mm (12.6 mm$^2$ in the area), the developer is not discharged sufficiently only by the gravitation through the discharge opening in the state that the discharge opening is directed downwardly (supposed supplying attitude into the developer replenishing apparatus 201) irrespective of the kind of the developer or the bulk density state.

On the other hand, the lower limit value of the size of the discharge opening 1*c* is preferably such that the developer to be supplied from the developer supply container 1 (one component magnetic toner, one component non-magnetic toner, two component non-magnetic toner or two component magnetic carrier) can at least pass therethrough. More particularly, the discharge opening is preferably larger than a particle size of the developer (volume average particle size in the case of toner, number average particle size in the case of carrier) contained in the developer supply container 1. For example, in the case that the supply developer comprises two component non-magnetic toner and two component magnetic carrier, it is preferable that the discharge opening is larger than a larger particle size, that is, the number average particle size of the two component magnetic carrier.

Specifically, in the case that the supply developer comprises two component non-magnetic toner having a volume average particle size of 5.5 μm and a two component magnetic carrier having a number average particle size of 40 μm, the diameter of the discharge opening 1*c* is preferably not less than 0.05 mm (0.002 mm$^2$ in the opening area).

If, however, the size of the discharge opening 1*c* is too close to the particle size of the developer, the energy required for discharging a desired amount from the developer supply container 1, that is, the energy required for operating the pump 2 is large. It may be the case that a restriction is imparted to the manufacturing of the developer supply container 1. In order to mold the discharge opening 1*c* in a resin material part using an injection molding method, a metal mold part for forming the discharge opening 1*c* is used, and the durability of the metal mold part will be a problem. From the foregoing, the diameter φ of the discharge opening 3*a* is preferably not less than 0.5 mm.

In this example, the configuration of the discharge opening 1*c* is circular, but this is not inevitable. A square, a rectangular, an ellipse or a combination of lines and curves or the like are usable if the opening area is not more than 12.6 $mm^2$ which is the opening area corresponding to the diameter of 4 mm.

However, a circular discharge opening has a minimum circumferential edge length among the configurations having the same opening area, the edge being contaminated by the deposition of the developer. Therefore, the amount of the developer dispersing with the opening and closing operation of the shutter 5 is small, and therefore, the contamination is decreased. In addition, with the circular discharge opening, a resistance during discharging is also small, and a discharging property is high. Therefore, the configuration of the discharge opening 1*c* is preferably circular which is excellent in the balance between the discharge amount and the contamination prevention.

From the foregoing, the size of the discharge opening 1*c* is preferably such that the developer is not discharged sufficiently only by the gravitation in the state that the discharge opening 1*c* is directed downwardly (supposed supplying attitude into the developer replenishing apparatus 8). More particularly, a diameter φ of the discharge opening 1*c* is not less than 0.05 mm (0.002 $mm^2$ in the opening area) and not more than 4 mm (12.6 $mm^2$ in the opening area). Furthermore, the diameter φ of the discharge opening 1*c* is preferably not less than 0.5 mm (0.2 $mm^2$ in the opening area and not more than 4 mm (12.6 $mm^2$ in the opening area). In this example, on the basis of the foregoing investigation, the discharge opening 1*c* is circular, and the diameter φ of the opening is 2 mm.

In this example, the number of discharge openings 1*c* is one, but this is not inevitable, and a plurality of discharge openings 1*c* a total opening area of the opening areas satisfies the above-described range. For example, in place of one developer receiving port 8*a* having a diameter φ of 2 mm, two discharge openings 3*a* each having a diameter φ of 0.7 mm are employed. However, in this case, the discharge amount of the developer per unit time tends to decrease, and therefore, one discharge opening 1*c* having a diameter φ of 2 mm is preferable.

(Developer Supplying Step)

Referring to FIGS. 15-18, a developer supplying step by the pump portion will be described.

FIG. 15 is a schematic perspective view in which the expansion-and-contraction portion 2*a* of the pump 2 is contracted. FIG. 16 is a schematic perspective view in which the expansion-and-contraction portion 2*a* of the pump 2 is expanded. FIG. 17 is a schematic sectional view in which the expansion-and-contraction portion 2*a* of the pump 2 is contracted. FIG. 18 is a schematic sectional view in which the expansion-and-contraction portion 2*a* of the pump 2 is expanded.

In this example, as will be described hereinafter, the drive conversion of the rotational force is carries out by the drive converting mechanism so that the suction step (suction operation through discharge opening 3*a*) and the discharging step (discharging operation through the discharge opening 3*a*) are repeated alternately. The suction step and the discharging step will be described.

The description will be made as to a developer discharging principle using a pump.

The operation principle of the expansion-and-contraction portion 2*a* of the pump 2 is as has been in the foregoing. Stating briefly, as shown in FIG. 10, the lower end of the expansion-and-contraction portion 2*a* is connected to the container body 1*a*. The container body 1*a* is prevented in the movement in the p direction and in the q direction (FIG. 9) by the positioning guide 8*b* of the developer supplying apparatus 8 through the flange portion 1 *g* at the lower end. Therefore, the vertical position of the lower end of the expansion-and-contraction portion 2*a* connected with the container body 1*a* is fixed relative to the developer replenishing apparatus 8.

On the other hand, the upper end of the expansion-and-contraction portion 2*a* is engaged with the locking member 9 through the locking portion 3, and is reciprocated in the p direction and in the q direction by the vertical movement of the locking member 9.

Since the lower end of the expansion-and-contraction portion 2*a* of the pump 2 is fixed, the portion thereabove expands and contracts.

The description will be made as to expanding-and-contracting operation (discharging operation and suction operation) of the expansion-and-contraction portion 2*a* of the pump 2 and the developer discharging.

(Discharging Operation)

First, the discharging operation through the discharge opening 1*c* will be described.

With the downward movement of the locking member 9, the upper end of the expansion-and-contraction portion 2*a* displaces in the p direction (contraction of the expansion-and-contraction portion), by which discharging operation is effected. More particularly, with the discharging operation, the volume of the developer accommodating space 1*b* decreases. At this time, the inside of the container body 1*a* is sealed except for the discharge opening 1*c*, and therefore, until the developer is discharged, the discharge opening 1*c* is substantially clogged or closed by the developer, so that the volume in the developer accommodating space 1*b* decreases to increase the internal pressure of the developer accommodating space 1*b*.

At this time, the internal pressure of the developer accommodating space 1*b* is higher than the pressure in the hopper 8*g* (equivalent to the ambient pressure), and therefore, as shown in FIG. 17, the developer is discharged by the air pressure, that is, the pressure difference between the developer accommodating space 1*b* and the hopper 8*g*. Thus, the developer T is discharged from the developer accommodating space 1*b* into the hopper 8*g*. An arrow in FIG. 17 indicates a direction of a force applied to the developer T in the developer accommodating space 1*b*. Thereafter, the air in the developer accommodating space 1*b* is also discharged together with the developer, and therefore, the internal pressure of the developer accommodating space 1*b* decreases (Suction Operation)

The suction operation through the discharge opening 1*c* will be described.

With upward movement of the locking member 9, the upper end of the expansion-and-contraction portion 2*a* of the pump 2 displaces in the q direction (the expansion-and-contraction portion expands) so that the suction operation is effected. More particularly, the volume of the developer accommodating space 1*b* increases with the suction operation. At this time, the inside of the container body 1*a* is sealed except of the discharge opening 1*c*, and the discharge opening 1*c* is clogged by the developer and is substantially closed. Therefore, with the increase of the volume in the developer accommodating space 1*b*, the internal pressure of the developer accommodating space 1*b* decreases.

The internal pressure of the developer accommodating space 1*b* at this time becomes lower than the internal pressure in the hopper 8*g* (equivalent to the ambient pressure). Therefore, as shown in FIG. 18, the air in the upper portion in the hopper 8*g* enters the developer accommodating space 1*b* through the discharge opening 1*c* by the pressure difference between the developer accommodating space 1*b* and the hopper 8*g*. An arrow in FIG. 18 indicates a direction of a force applied to the developer T in the developer accommodating space 1*b*. Ovals Z in FIG. 18 schematically show the air taken in from the hopper 8*g*.

At this time, the air is taken-in from the outside of the developer supply device 8, and therefore, the developer in the neighborhood of the discharge opening 1*c* can be loosened. More particularly, the air impregnated into the developer powder existing in the neighborhood of the discharge opening 1*c*, reduces the bulk density of the developer powder and fluidizing. In this manner, by the fluidization of the developer T, the developer T does not pack or clog in the discharge opening 3*a*, so that the developer can be smoothly discharged through the discharge opening 3*a* in the discharging operation which will be described hereinafter. Therefore, the amount of the developer T (per unit time) discharged through the discharge opening 3*a* can be maintained substantially at a constant level for a long term.

(Change of Internal Pressure of Developer Accommodating Portion)

Verification experiments were carried out as to a change of the internal pressure of the developer supply container 1. The verification experiments will be described.

The developer is filled such that the developer accommodating space 1*b* in the developer supply container 1 is filled with the developer; and the change of the internal pressure of the developer supply container 1 is measured when the pump 2 is expanded and contracted in the range of 15 $cm^3$ of volume change. The internal pressure of the developer supply container 1 is measured using a pressure gauge (AP-C40 available from Kabushiki Kaisha KEYENCE) connected with the developer supply container 1.

FIG. 19 shows a pressure change when the pump 2 is expanded and contracted in the state that the shutter 5 of the developer supply container 1 filled with the developer is open, and therefore, in the communicatable state with the outside air.

In FIG. 19, the abscissa represents the time, and the ordinate represents a relative pressure in the developer supply container 1 relative to the ambient pressure (reference (0)) (+ is a positive pressure side, and − is a negative pressure side).

When the internal pressure of the developer supply container 1 becomes negative relative to the outside ambient pressure by the increase of the volume of the developer supply container 1, the air is taken in through the discharge opening 1*c* by the pressure difference. When the internal pressure of the developer supply container 1 becomes positive relative to the outside ambient pressure by the decrease of the volume of the developer supply container 1, a pressure is imparted to the inside developer. At this time, the inside pressure eases corresponding to the discharged developer and air.

By the verification experiments, it has been confirmed that by the increase of the volume of the developer supply container 1, the internal pressure of the developer supply container 1 becomes negative relative to the outside ambient pressure, and the air is taken in by the pressure difference. In addition, it has been confirmed that by the decrease of the volume of the developer supply container 1, the internal pressure of the developer supply container 1 becomes positive relative to the outside ambient pressure, and the pressure is imparted to the inside developer so that the developer is discharged. In the verification experiments, an absolute value of the negative pressure is 1.3 kPa, and an absolute value of the positive pressure is 3.0 kPa.

As described in the foregoing, with the structure of the developer supply container 1 of this example, the internal pressure of the developer supply container 1 switches between the negative pressure and the positive pressure alternately by the suction operation and the discharging operation of the pump portion 2*b*, and the discharging of the developer is carried out properly.

As described in the foregoing, the example, a simple and easy pump capable of effecting the suction operation and the discharging operation of the developer supply container 1 is provided, by which the discharging of the developer by the air can be carries out stably while providing the developer loosening effect by the air.

In other words, with the structure of the example, even when the size of the discharge opening 1*c* is extremely small, a high discharging performance can be assured without imparting great stress to the developer since the developer can be passed through the discharge opening 1*c* in the state that the bulk density is small because of the fluidization.

In addition, in this example, the inside of the displacement type pump 2 is utilized as a developer accommodating space, and therefore, when the internal pressure is reduced by increasing the volume of the pump 2, a additional developer accommodating space can be formed. Therefore, even when the inside of the pump 2 is filled with the developer, the bulk density can be decreased (the developer can be fluidized) by impregnating the air in the developer powder. Therefore, the developer can be filled in the developer supply container 1 with a higher density than in the conventional art.

In the foregoing, the inside space in the pump 2 is used as a developer accommodating space 1*b*, but in an alternative, a filter which permits passage of the air but prevents passage of the toner may be provided to partition between the pump 2 and the developer accommodating space 1*b*. However, the embodiment described in the form of is preferable in that when the volume of the pump increases, an additional developer accommodating space can be provided.

(Developer Loosening Effect in Suction Step)

Verification has been carried out as to the developer loosening effect by the suction operation through the discharge opening 3*a* in the suction step. When the developer loosening effect by the suction operation through the discharge opening 3*a* is significant, a low discharge pressure (small volume change of the pump) is enough, in the subsequent discharging step, to start immediately the discharging of the developer from the developer supply container 1. This verification is to demonstrate remarkable enhancement of the developer loosening effect in the structure of this example. This will be described in detail.

Part (a) of FIG. 20 and part (a) of FIG. 21 are block diagrams schematically showing a structure of the developer supplying system used in the verification experiment. Part (b) of FIG. 20 and part (b) of FIG. 21 are schematic views showing a phenomenon-occurring in the developer supply container. The system of FIG. 20 is analogous to this example, and a developer supply container C is provided with a developer accommodating portion C1 and a pump portion P. By the expanding-and-contracting operation of the pump portion P, the suction operation and the discharging operation through a discharge opening (the discharge opening 1*c* of this example (unshown)) of the developer supply container C are carried out alternately to discharge the developer into a hopper H. On the other hand, the system of FIG. 21 is a comparison example wherein a pump portion P is provided in the developer replenishing apparatus side, and by the expanding-and-contracting operation of the pump portion P, an air-supply operation into the developer accommodating portion C1 and the suction operation from the developer accommodating portion C1 are carried out alternately to discharge the developer into a hopper H. In FIGS. 20, 21, the developer accommodating portions C1 have the same internal volumes, the hoppers H have the same internal volumes, and the pump portions P have the same internal volumes (volume change amounts).

First, 200 g of the developer is filled into the developer supply container C.

Then, the developer supply container C is shaken for 15 minutes in view of the state later transportation, and thereafter, it is connected to the hopper H.

The pump portion P is operated, and a peak value of the internal pressure in the suction operation is measured as a condition of the suction step required for starting the developer discharging immediately in the discharging step. In the case of FIG. 20, the start position of the operation of the pump portion P corresponds to 480 $cm^3$ of the volume of the developer accommodating portion C1, and in the case of FIG. 15, the start position of the operation of the pump portion P corresponds to 480 $cm^3$ of the volume of the hopper H.

In the experiments of the structure of FIG. 15, the hopper H is filled with 200 g of the developer beforehand to make the conditions of the air volume the same as with the structure of FIG. 14. The internal pressures of the developer accommodating portion C1 and the hopper H are measured by the pressure gauge (AP-C40 available from Kabushiki Kaisha KEYENCE) connected to the developer accommodating portion C1.

As a result of the verification, according to the system analogous to this example shown in FIG. 20, if the absolute value of the peak value (negative pressure) of the internal pressure at the time of the suction operation is at least 1.0 kPa, the developer discharging can be immediately started in the subsequent discharging step. In the comparison example system shown in FIG. 21, on the other hand, unless the absolute value of the peak value (positive pressure) of the internal pressure at the time of the suction operation is at least 1.7 kPa, the developer discharging cannot be immediately started in the subsequent discharging step.

It has been confirmed that using the system of FIG. 20 similar to the example, the suction is carries out with the volume increase of the pump portion P, and therefore, the internal pressure of the developer supply container C can be lower (negative pressure side) than the ambient pressure (pressure outside the container), so that the developer solution effect is remarkably high. This is because as shown in part (b) of FIG. 14, the volume increase of the developer accommodating portion C1 with the expansion of the pump portion P provides pressure reduction state (relative to the ambient pressure) of the upper portion air layer of the developer layer T. For this reason, the forces are applied in the directions to increase the volume of the developer layer T due to the decompression (wave line arrows), and therefore, the developer layer can be loosened efficiently. Furthermore, in the system of FIG. 20, the air is taken in from the outside into the developer supply container C1 by the decompression (white arrow), and the developer layer T is solved also when the air reaches the air layer R, and therefore, it is a very good system.

As a proof of the loosening of the developer in the developer supply container C in the, experiments, it has been confirmed that in the suction operation, the apparent volume of the whole developer increases (the level of the developer rises).

In the case of the system of the comparison example shown in FIG. 21, the internal pressure of the developer supply container C is raised by the air-supply operation to the developer supply container C up to a positive pressure (higher than the ambient pressure), and therefore, the developer is agglomerated, and the developer solution effect is not obtained. This is because as shown in part (b) of FIG. 21, the air is fed forcedly from the outside of the developer supply container C, and therefore, the air layer R above the developer layer T becomes positive relative to the ambient pressure. For this reason, the forces are applied in the directions to decrease the volume of the developer layer T due to the pressure (wave line arrows), and therefore, the developer layer T is packed. Actually, a phenomenon has been confirmed that the apparent volume of the whole developer in the developer supply container C increases upon the suction operation in the comparison example. Accordingly, with the system of FIG. 21, there is a liability that the packing of the developer layer T disables subsequent proper developer discharging step.

In order to prevent the packing of the developer layer T by the pressure of the air layer R, it would be considered that an air vent with a filter or the like is provided at a position corresponding to the air layer R thereby reducing the pressure rise. However, in such a case, the flow resistance of the filter or the like leads to a pressure rise of the air layer R. Even if the pressure rise were eliminated, the loosening effect by the pressure reduction state of the air layer R described above cannot be provided.

From the foregoing, the significance of the function of the suction operation a discharge opening with the volume increase of the pump portion by employing the system of this example has been confirmed.

As described above, by the repeated alternate suction operation and the discharging operation of the pump 2, the developer can be discharged through the discharge opening 1*c* of the developer supply container 1. That is, in this example, the discharging operation and the suction operation are not in parallel or simultaneous, but are alternately repeated, and therefore, the energy required for the discharging of the developer can be minimized.

On the other hand, in the case that the developer replenishing apparatus includes the air-supply pump and the suction pump, separately, it is necessary to control the operations of the two pumps, and in addition it is not easy to rapidly switch the air-supply and the suction alternately.

In this example, one pump is effective to efficiently discharge the developer, and therefore, the structure of the developer discharging mechanism can be simplified.

In the foregoing, the discharging operation and the suction operation of the pump are repeated alternately to efficiently discharge the developer, but in an alternative structure, the discharging operation or the suction operation is temporarily stopped and then resumed.

For example, the discharging operation of the pump is not effected monotonically, but the compressing operation may be once stopped partway and then resumed to discharge. The same applies to the suction operation. Each operation may be made in a multi-stage form as long as the discharge amount and the discharging speed are enough. It is still necessary that after the multi-stage discharging operation, the suction operation is effected, and they are repeated.

In this example, the internal pressure of the developer accommodating space 1*b* is reduced to take the air through the discharge opening 1*c* to loosen the developer. On the other hand, in the above-described conventional example, the developer is loosened by feeding the air into the developer accommodating space 1*b* from the outside of the developer supply container 1, but at this time, the internal pressure of the developer accommodating space 1*b* is in a compressed state with the result of agglomeration of the developer. This example is preferable since the developer is loosened in the pressure reduced state in which is the developer is not easily agglomerated.

Embodiment 2

Referring to FIGS. 22, 23, a structure of the Embodiment 2 will be described. FIG. 22 is a schematic perspective view of a developer supply container 1, and FIG. 23 is a schematic sectional view of the developer supply container 1. In this example, the structure of the pump is different from that of Embodiment 1, and the other structures are substantially the same as with Embodiment 1. In the description of this embodiment, the same reference numerals as in Embodiment 1 are assigned to the elements having the corresponding functions in this embodiment, and the detailed description thereof is omitted.

In this example, as shown in FIGS. 22, 23, a plunger type pump is used in place of the bellow-like displacement type pump as in Embodiment 1. The plunger type pump includes an inner cylindrical portion 1*h* and an outer cylindrical portion 6 extending outside the outer surface of the inner cylindrical portion 1*h* and movable relative to the inner cylindrical portion 1*h*. The upper surface of the outer cylindrical portion 6 is provided with locking portion 3 fixed by bonding similarly to Embodiment 1. More particularly, the locking portion 3 fixed to the upper surface of the outer cylindrical portion 6 receives a locking member 9 of the developer replenishing apparatus 8, by which they a substantially unified, the outer cylindrical portion 6 can move in the up and down directions (reciprocation) together with the locking member 9.

The inner cylindrical portion 1*h* is connected with the container body 1*a*, and the inside space thereof functions as a developer accommodating space 1*b*.

In order to prevent leakage of the air through a gap between the inner cylindrical portion 1*h* and the outer cylindrical portion 6 (to prevent leakage of the developer by keeping the hermetical property), an elastic seal 7 is fixed by bonding on the outer surface of the inner cylindrical portion 1*h*. The elastic seal 7 is compressed between the inner cylindrical portion 1*h* and the outer cylindrical portion 6.

Therefore, by reciprocating the outer cylindrical portion 6 in the p direction and the q direction relative to the container body 1*a* (inner cylindrical portion 1*h*) fixed non-movably to the developer replenishing apparatus 8, the volume in the developer accommodating space 1*b* can be changed. That is, the internal pressure of the developer accommodating space 1*b* can be repeated alternately between the negative pressure state and the positive pressure state.

Thus, also in this example, one pump is enough to effect the suction operation and the discharging operation, and therefore, the structure of the developer discharging mechanism can be simplified. In addition, by the suction operation through the discharge opening, a decompressed state (negative pressure state) can be provided in the developer accommodation supply container, and therefore, the developer can be efficiently loosened.

In this example, the configuration of the outer cylindrical portion 6 is cylindrical, but may be of another form, such as a rectangular section. In such a case, it is preferable that the configuration of the inner cylindrical portion 1*h* meets the configuration of the outer cylindrical portion 6. The pump is not limited to the plunger type pump, but may be a piston pump.

When the pump of this example is used, the seal structure is required to prevent developer leakage through the gap between the inner cylinder and the outer cylinder, resulting in a complicated structure and necessity for a large driving force for driving the pump portion, and therefore, Embodiment 1 is preferable.

Embodiment 3

Referring to FIGS. 24, 25, a structure of Embodiment 3 will be described. FIG. 24 is a perspective view of an outer appearance in which a pump 12 of a developer supply container 1 according to this embodiment is in an expanded state, and FIG. 25 is a perspective view of an outer appearance in which the pump 12 of the developer supply container 1 is in a contracted state. In this example, the structure of the pump is different from that of Embodiment 1, and the other structures are substantially the same as with Embodiment 1. In the description of this embodiment, the same reference numerals as in Embodiment 1 are assigned to the elements having the corresponding functions in this embodiment, and the detailed description thereof is omitted.

In this example, as shown in FIGS. 24, 25, in place of a bellow-like pump having folded portions of Embodiment 1, a film-like pump 12 capable of expansion and contraction not having a folded portion is used. The film-like portion of the pump 12 is made of rubber. The material of the film-like portion of the pump 12 may be a flexible material such as resin film rather than the rubber.

The film-like pump 12 is connected with the container body 1*a*, and the inside space thereof functions as a developer accommodating space 1*b*. The upper portion of the film-like pump 12 is provided with a locking portion 3 fixed thereto by bonding, similarly to the foregoing embodiments. Therefore, the pump 12 can alternately repeat the expansion and the contraction by the vertical movement of the locking member 9.

In this manner, also in this example, one pump is enough to effect both of the suction operation and the discharging operation, and therefore, the structure of the developer discharging mechanism can be simplified. In addition, by the suction operation through the discharge opening, a pressure reduction state (negative pressure state) can be provided in the developer supply container, and therefore, the developer can be efficiently loosened. In the case of this example, as shown in FIG. 26, it is preferable that a plate-like member 13 having a higher rigid than the film-like portion is mounted to the upper surface of the film-like portion of the pump 12, and the locking portion 3 is provided on the plate-like member 13. With such a structure, it can be suppressed that the amount of the volume change of the pump 12 decreases due to deformation of only the neighborhood of the locking portion 3 of the pump 12. That is, the followability of the pump 12 to the vertical movement of the locking member 9 can be improved, and therefore, the expansion and the contraction of the pump 12 can be effected efficiently. Thus, the discharging property of the developer can be improved.

Embodiment 4

Referring to FIGS. 27-29, a structure of the Embodiment 4 will be described. FIG. 27 is a perspective view of an outer appearance of a developer supply container 1, FIG. 28 is a sectional perspective view of the developer supply container 1, FIG. 29 is a partially sectional view of the developer supply container 1 In this example, the structure is different from that of Embodiment 1 only in the structure of a developer accommodating space, and the other structure is substantially the same. In the description of this embodiment, the same reference numerals as in Embodiment 1 are assigned to the elements having the corresponding functions in this embodiment, and the detailed description thereof is omitted. As shown in FIGS. 27, 28, the developer supply container 1 of this example comprises two components, namely, a portion X including a container body 1*a* and a pump 2 and a portion Y including a cylindrical portion 14. The structure of the portion X of the developer supply container 1 is substantially the same as that of Embodiment 1, and therefore, detailed description thereof is omitted.

(Structure of Developer Supply Container)

In the developer supply container 1 of this example, as contrasted to Embodiment 1, the cylindrical portion 14 is connected by a cylindrical portion 14 to a side of the portion X a discharging portion in which a discharge opening 1*c* is formed).

The cylindrical portion (developer accommodation rotatable portion) 14 has a closed end at one longitudinal end thereof and an open end at the other end which is connected with an opening of the portion X, and the space therebetween is a developer accommodating space 1*b*. In this example, an inside space of the container body 1*a*, an inside space of the pump 2 and the inside space of the cylindrical portion 14 are all developer accommodating space 1*b*, and therefore, a large amount of the developer can be accommodated. In this example, the cylindrical portion 14 as the developer accommodation rotatable portion has a circular cross-sectional configuration, but the circular shape is not restrictive to the present invention. For example, the cross-sectional configuration of the developer accommodation rotatable portion may be of non-circular configuration such as a polygonal configuration as long as the rotational motion is not obstructed during the developer feeding operation.

An inside of the cylindrical portion 14 is provided with a helical feeding projection (feeding portion) 14*a*, which has a function of feeding the developer accommodated therein toward the portion X (discharge opening 1*c*) when the cylindrical portion 14 rotates in a direction indicated by an arrow R.

In addition, the inside of the cylindrical portion 14 is provided with a receiving-and-feeding member (feeding portion) 16 for receiving the developer fed by the feeding projection 14*a* and supplying it to the portion X side by rotation of the cylindrical portion 14 in the direction R (the rotational axis is substantially extends in the horizontal direction), the moving member upstanding from the inside of the cylindrical portion 14. The receiving-and-feeding member 16 is provided with a plate-like portion 16*a* for scooping the developer up, and inclined projections 16*b* for feeding (guiding) the developer scooped up by the plate-like portion 16*a* toward the portion X, the inclined projections 16*b* being provided on respective sides of the plate-like portion 16*a*. The plate-like portion 16*a* is provided with a through-hole 16*c* for permitting passage of the developer in both directions to improve the stirring property for the developer.

In addition, a gear portion 14*b* as a drive inputting portion is fixed by bonding on an outer surface at one longitudinal end (with respect to the feeding direction of the developer) of the cylindrical portion 14. When the developer supply container 1 is mounted to the developer replenishing apparatus 8, the gear portion 14*b* engages with the driving gear 300 functioning as a driving mechanism provided in the developer replenishing apparatus 8. When the rotational force is inputted to the gear portion 14*b* as the rotational force receiving portion from the driving gear 300, the cylindrical portion 14 rotates in the direction R (FIG. 28). The gear portion 14*b* is not restrictive to the present invention, but another drive inputting mechanism such as a belt or friction wheel is usable as long as it can rotate the cylindrical portion 14.

As shown in FIG. 29, one longitudinal end of the cylindrical portion 14 (downstream end with respect to the developer feeding direction) is provided with a connecting portion 14*c* as a connecting tube for connection with portion X. The above-described inclined projection 16*b* extends to a neighborhood of the connecting portion 14*c*. Therefore, the developer fed by the inclined projection 16*b* is prevented as much as possible from falling toward the bottom side of the cylindrical portion 14 again, so that the developer is properly supplied to the connecting portion 14*c*.

The cylindrical portion 14 rotates as described above, but on the contrary, the container body 1*a* and the pump 2 are connected to the cylindrical portion 14 through a flange portion 1 *g* so that the container body 1*a* and the pump 2 are non-rotatable relative to the developer replenishing apparatus 8 (non-rotatable in the rotational axis direction of the cylindrical portion 14 and non-movable in the rotational moving direction), similarly to Embodiment 1. Therefore, the cylindrical portion 14 is rotatable relative to the container body 1*a*.

A ring-like elastic seal 15 is provided between the cylindrical portion 14 and the container body 1*a* and is compressed by a predetermined amount between the cylindrical portion 14 and the container body 1*a*. By this, the developer leakage there is prevented during the rotation of the cylindrical portion 14. In addition, the structure, the hermetical property can be maintained, and therefore, the loosening and discharging effects by the pump 2 are applied to the developer without loss. The developer supply container 1 does not have an opening for substantial fluid communication between the inside and the outside except for the discharge opening 1*c*.

(Developer Supplying Step)

A developer supplying step will be described.

When the operator inserts the developer supply container 1 into the developer replenishing apparatus 8, similarly to Embodiment 1, the locking portion 3 of the developer supply container 1 is locked with the locking member 9 of the developer replenishing apparatus 8, and the gear portion 14*b* of the developer supply container 1 is engaged with the driving gear 300 of the developer replenishing apparatus 8.

Thereafter, the driving gear 300 is rotated by another driving motor (not shown) for rotation, and the locking member 9 is driven in the vertical direction by the above-described driving motor 500. Then, the cylindrical portion 14 rotates in the direction R, by which the developer therein is fed to the receiving-and-feeding member 16 by the feeding projection 14*a*. In addition, by the rotation of the cylindrical portion 14 in the direction R, the receiving-and-feeding member 16 scoops the developer, and feeds it to the connecting portion 14*c*. The developer fed into the container body 1*a* from the connecting portion 14*c* is discharged from the discharge opening 1*c* by the expanding-and-contracting operation of the pump 2, similarly to Embodiment 1.

These are a series of the developer supply container 1 mounting steps and developer supplying steps. Hen the developer supply container 1 is exchanged, the operator takes the developer supply container 1 out of the developer replenishing apparatus 8, and a new developer supply container 1 is inserted and mounted.

In the case of a vertical container having a developer accommodating space 1*b* which is long in the vertical direction, if the volume of the developer supply container 1 is increased to increase the filling amount, the developer results in concentrating to the neighborhood of the discharge opening 1*c* by the weight of the developer. As a result, the developer adjacent the discharge opening 1*c* tends to be compacted, leading to difficulty in suction and discharge through the discharge opening 1*c*. In such a case, in order to loosen the developer compacted by the suction through the discharge opening 1*c* or to discharge the developer by the discharging, the internal pressure (negative pressure/positive pressure) of the developer accommodating space 1*b* has to be enhanced by increasing the amount of the change of the pump 2 volume. Then, the driving forces or drive the pump 2 has to be increased, and the load to the main assembly of the image forming apparatus 100 may be excessive.

According to this embodiment, however, container body 1*a* and the portion X of the pump 2 are arranged in the horizontal direction, and therefore, the thickness of the developer layer above the discharge opening 1*c* in the container body 1*a* can be thinner than in the structure of FIG. 9 By doing so, the developer is not easily compacted by the gravity, and therefore, the developer can be stably discharged without load to the main assembly of the image forming apparatus 100.

As described, with the structure of this example, the provision of the cylindrical portion 14 is effective to accomplish a large capacity developer supply container 1 without load to the main assembly of the image forming apparatus.

In this manner, also in this example, one pump is enough to effect both of the suction operation and the discharging operation, and therefore, the structure of the developer discharging mechanism can be simplified.

The developer feeding mechanism in the cylindrical portion 14 is not restrictive to the present invention, and the developer supply container 1 may be vibrated or swung, or may be another mechanism. Specifically, the structure of FIG. 30 is usable.

As shown in FIG. 30, the cylindrical portion 14 per se is not movable substantially relative to the developer replenishing apparatus 8 (with slight play), and a feeding member 17 is provided in the cylindrical portion in place of the feeding projection 14*a*, the feeding member 17 being effective to feed the developer by rotation relative to the cylindrical portion 14.

The feeding member 17 includes a shaft portion 17*a* and flexible feeding blades 17*b* fixed to the shaft portion 17*a*. The feeding blade 17*b* is provided at a free end portion with an inclined portion S inclined relative to an axial direction of the shaft portion 17*a*. Therefore, it can feed the developer toward the portion X while stirring the developer in the cylindrical portion 14.

One longitudinal end surface of the cylindrical portion 14 is provided with a coupling portion 14*e* as the rotational force receiving portion, and the coupling portion 14*e* is operatively connected with a coupling member (not shown) of the developer replenishing apparatus 8, by which the rotational force can be transmitted. The coupling portion 14*e* is coaxially connected with the shaft portion 17*a* of the feeding member 17 to transmit the rotational force to the shaft portion 17*a*.

By the rotational force applied from the coupling member (not shown) of the developer replenishing apparatus 8, the feeding blade 17*b* fixed to the shaft portion 17*a* is rotated, so that the developer in the cylindrical portion 14 is fed toward the portion X while being stirred.

However, with the modified example shown in FIG. 30, the stress applied to the developer in the developer feeding step tends to be large, and the driving torque is also large, and for this reason, the structure of the this embodiment is preferable.

Thus, also in this example, one pump is enough to effect the suction operation and the discharging operation, and therefore, the structure of the developer discharging mechanism can be simplified. In addition, by the suction operation through the discharge opening, a pressure reduction state (negative pressure state) can be provided in the developer supply container, and therefore, the developer can be efficiently loosened.

Embodiment 5

Referring to FIGS. 31-33, a structure of Embodiment 5 will be described. Part (a) of FIG. 31 is a front view of a developer replenishing apparatus 8, as seen in a mounting direction of a developer supply container 1, and (b) is a perspective view of an inside of the developer replenishing apparatus 8. Part (a) of FIG. 32 is a perspective view of the entire developer supply container 1, (b) is a partial enlarged view of a neighborhood of a discharge opening 21*a* of the developer supply container 1, and (c)-(d) are a front view and a sectional view illustrating a state that the developer supply container 1 is mounted to a mounting portion 8*f*. Part (a) of FIG. 33 is a perspective view of the developer accommodating portion 20, (b) is a partially sectional view illustrating an inside of the developer supply container 1, (c) is a sectional view of a flange portion 21, and (d) is a sectional view illustrating the developer supply container 1.

In the above-described Embodiments 1-4, the pump is expanded and contracted by moving the locking member 9 of the developer replenishing apparatus 8 vertically, this example is significantly different in that the developer supply container 1 receives only the rotational force from the developer replenishing apparatus 8. In the other respects, the structure is similar to the foregoing embodiments, and therefore, the same reference numerals as in the foregoing embodiments are assigned to the elements having the corresponding functions in this embodiment, and the detailed description thereof is omitted for simplicity.

Specifically, in this example, the rotational force inputted from the developer replenishing apparatus 8 is converted to the force in the direction of reciprocation of the pump, and the converted force is transmitted to the pump.

In the following, the structure of the developer replenishing apparatus 8 and the developer supply container 1 will be described in detail.

(Developer Replenishing Apparatus)

Referring to FIG. 31, the developer replenishing apparatus will be first described. The developer replenishing apparatus 8 comprises a mounting portion (mounting space) 8*f* to which the developer supply container 1 is detachably mountable.

As shown in part (b) of FIG. 31, the developer supply container 1 is mountable in a direction indicated by M to the mounting portion 8*f*. Thus, a longitudinal direction (rotational axis direction) of the developer supply container 1 is substantially the same as the direction M. The direction M is substantially parallel with a direction indicated by X of part (b) of FIG. 33(*b*) which will be described hereinafter. In addition, a dismounting direction of the developer supply container 1 from the mounting portion 8*f* is opposite the direction M.

As shown in part (a) of FIG. 31, the mounting portion 8*f* is provided with a rotation regulating portion (holding mechanism) 29 for limiting movement of the flange portion 21 in the rotational moving direction by abutting to a flange portion 21 (FIG. 32) of the developer supply container 1 when the developer supply container 1 is mounted. In addition, as shown in part (b) of FIG. 31 a mounting portion 8*f* is provided with the regulating portion (the holding mechanism) 30 for limiting movement of the flange portion 21 in a rotational axis direction by locking engagement with the flange portion 21 of the developer supply container 1 when the developer supply container 1 is mounted. The regulating portion 30 is a snap locking mechanism of resin material which elastically deforms by interference with the flange portion 21, and thereafter, restores upon being released from the flange portion 21 to lock the flange portion 21.

Furthermore, the mounting portion 8*f* is provided with a developer receiving port (developer reception hole) 13 for receiving the developer discharged from the developer supply container 1, and the developer receiving port is brought into fluid communication with a discharge opening the discharging port) 21*a* (FIG. 32) of the developer supply container 1 which will be described hereinafter, when the developer supply container 1 is mounted thereto. The developer is supplied from the discharge opening 21*a* of the developer supply container 1 to the developing device 8 through the developer receiving port 31. In this embodiment, a diameter φ of the developer receiving port 31 is approx. 2 mm which is the same as that of the discharge opening 21*a*, for the purpose of preventing as much as possible the contamination by the developer in the mounting portion 8*f*.

As shown in part (a) of FIG. 31, the mounting portion 8*f* is provided with a driving gear 300 functioning as a driving mechanism (driver). The driving gear 300 receives a rotational force from a driving motor 500 through a driving gear train, and functions to apply a rotational force to the developer supply container 1 which is set in the mounting portion 8*f*.

As shown in FIG. 31, the driving motor 500 is controlled by a control device (CPU) 600.

In this example, the driving gear 300 is rotatable unidirectionally to simplify the control for the driving motor 500. The control device 600 controls only ON (operation) and OFF (non-operation) of the driving motor 500. This simplifies the driving mechanism for the developer replenishing apparatus 8 as compared with a structure in which forward and backward driving forces are provided by periodically rotating the driving motor 500 (driving gear 300) in the forward direction and backward direction.

(Developer Supply Container)

Referring to FIGS. 32 and 33, the structure of the developer supply container 1 which is a constituent-element of the developer supplying system will be described.

As shown in part (a) of FIG. 32, the developer supply container 1 includes a developer accommodating portion 20 (container body) having a hollow cylindrical inside space for accommodating the developer. In this example, a cylindrical portion 20*k* and the pump portion 20*b* functions as the developer accommodating portion 20. Furthermore, the developer supply container 1 is provided with a flange portion 21 (non-rotatable portion) at one end of the developer accommodating portion 20 with respect to the longitudinal direction (developer feeding direction). The developer accommodating portion 20 is rotatable relative to the flange portion 21.

In this example, as shown in part (d) of FIG. 33, a total length L1 of the cylindrical portion 20*k* functioning as the developer accommodating portion is approx. 300 mm, and an outer diameter R1 is approx. 70 mm. A total length L2 of the pump portion 2*b* (in the state that it is most expanded in the expansible range in use) is approx. 50 mm, and a length L3 of a region in which a gear portion 20*a* of the flange portion 21 is provided is approx. 20 mm A length L4 of a region of a discharging portion 21*h* functioning as a developer discharging portion is approx. 25 mm. A maximum outer diameter R2 (in the state that it is most expanded in the expansible range in use in the diametrical direction) is approx. 65 mm, and a total volume capacity accommodating the developer in the developer supply container 1 is the 1250 $cm^3$. In this example, the developer can be accommodated in the cylindrical portion 20*k* and the pump portion 20*b* and in addition the discharging portion 21*h*, that is, they function as a developer accommodating portion.

As shown in FIGS. 32, 33, in this example, in the state that the developer supply container 1 is mounted to the developer replenishing apparatus 8, the cylindrical portion 20*k* and the discharging portion 21*h* are substantially on line along a horizontal direction. That is, the cylindrical portion 20*k* has a sufficiently long length in the horizontal direction as compared with the length in the vertical direction, and one end part with respect to the horizontal direction is connected with the discharging portion 21*h*. For this reason, the suction and discharging operations can be carried out smoothly as compared with the case in which the cylindrical portion 20*k* is above the discharging portion 21*h* in the state that the developer supply container 1 is mounted to the developer replenishing apparatus 8. This is because the amount of the toner existing above the discharge opening 21*a* is small, and therefore, the developer in the neighborhood of the discharge opening 21*a* is less compressed.

As shown in part (b) of FIG. 32, the flange portion 21 is provided with a hollow discharging portion (developer discharging chamber) 21*h* for temporarily storing the developer having been fed from the inside of the developer accommodating portion (inside of the developer accommodating chamber) 20 (see parts (b) and (c) of FIG. 33 if necessary). A bottom portion of the discharging portion 21*h* is provided with the small discharge opening 21*a* for permitting discharge of the developer to the outside of the developer supply container 1, that is, for supplying the developer into the developer replenishing apparatus 8. The size of the discharge opening 21*a* is as has been described hereinbefore.

An inner shape of the bottom portion of the inner of the discharging portion 21*h* (inside of the developer discharging chamber) is like a funnel converging toward the discharge opening 21*a* in order to reduce as much as possible the amount of the developer remaining therein (parts (b) and (c) of FIG. 33, if necessary).

The flange portion 21 is provided with a shutter 26 for opening and closing the discharge opening 21*a*. The shutter 26 is provided at a position such that when the developer supply container 1 is mounted to the mounting portion 8*f*, it is abutted to an abutting portion 8*h* (see part (b) of FIG. 31 if necessary) provided in the mounting portion 8*f*. Therefore, the shutter 26 slides relative to the developer supply container 1 in the rotational axis direction (opposite from the M direction) of the developer accommodating portion 20 with the mounting operation of the developer supply container 1 to the mounting portion 8*f*. As a result, the discharge opening 21*a* is exposed through the shutter 26, thus completing the unsealing operation.

At this time, the discharge opening 21*a* is positionally aligned with the developer receiving port 31 of the mounting portion 8*f*, and therefore, they are brought into fluid communication with each other, thus enabling the developer supply from the developer supply container 1.

The flange portion 21 is constructed such that when the developer supply container 1 is mounted to the mounting portion 8*f* of the developer replenishing apparatus 8, it is stationary substantially.

More particularly, as shown in part (c) of FIG. 32, the flange portion 21 is regulated (prevented) from rotating in the rotational direction about the rotational axis of the developer accommodating portion 20 by a rotational moving direction regulating portion 29 provided in the mounting portion 8*f*. In other words, the flange portion 21 is retained such that it is substantially non-rotatable by the developer replenishing apparatus 8 (although the rotation within the play is possible).

Furthermore, the flange portion 21 is locked with the rotational axis direction regulating portion 30 provided in the mounting portion 8*f* with the mounting operation of the developer supply container 1. More particularly, a flange portion 21 is brought into abutment to the rotational axis direction regulating portion 30 in midstream of the mounting operation of the developer supply container 1 to elastically deform the rotational axis direction regulating portion 30. Thereafter, the flange portion 21 abuts to the inner wall portion 28*a* (part (d) of FIG. 32) which is a stopper provided in the mounting portion 8*f*, thus completing the mounting step of the developer supply container 1. Substantially simultaneously with the completion of the mounting, the interference with the flange portion 21 is released, so that the elastic deformation of the rotational axis direction regulating portion 30 restores.

As a result, as shown in part (d) of FIG. 32, the rotational axis direction regulating portion 30 is locked with an edge portion of the flange portion 21 (functioning as a locking portion), so that the state in which the movement in the rotational axis direction of the developer accommodating portion 20 is prevented (regulated) substantially is established. At this time, slight negligible movement due to the play is permitted.

As described in the foregoing, in this example, the flange portion 21 is prevented from moving in the rotational axis direction of the developer accommodating portion 20 by the regulating portion 30 of the developer replenishing apparatus 8.

In addition, the flange portion 21 is prevented from rotating in the rotational direction of the developer accommodating portion 20 by the regulating member 29 of the developer replenishing apparatus 8.

When the operator dismounts the developer supply container 1 from the mounting portion 8*f*, the rotational axis direction regulating portion 30 is elastically deformed by the flange portion 21 to be released from the flange portion 21. The rotational axis direction of the developer accommodating portion 20 is substantially the same as the rotational axis direction of the gear portion 20*a* (FIG. 33).

Therefore, in the state that the developer supply container 1 is mounted to the developer replenishing apparatus 8, the discharging portion 21*h* provided in the flange portion 21 is prevented substantially in the movement of the developer accommodating portion 20 both in the rotational axis direction and the rotational moving direction (movement within the play is permitted).

On the other hand, the developer accommodating portion 20 is not limited in the rotational moving direction by the developer replenishing apparatus 8, and therefore, is rotatable in the developer supplying step. However, the developer accommodating portion 20 is substantially prevented in the movement in the rotational axis direction by the flange portion 21 (although the movement within the play is permitted).

(Pump Portion)

Referring to FIGS. 33 and 34, the description will be made as to the pump portion (reciprocable pump) 20*b* in which the volume thereof changes with reciprocation. Part (a) of FIG. 34 a sectional view of the developer supply container 1 in which the pump portion 20*b* is expanded to the maximum extent in operation of the developer supplying step, and part (b) of FIG. 34 is a sectional view of the developer supply container 1 in which the pump portion 20*b* is compressed to the maximum extent in operation of the developer supplying step.

The pump portion 20*b* of this example functions as a suction and discharging mechanism for repeating the suction operation and the discharging operation alternately through the discharge opening 21*a*.

As shown in part (b) of FIG. 33, the pump portion 20*b* is provided between the discharging portion 21*h* and the cylindrical portion 20*k*, and is fixedly connected to the cylindrical portion 20*k*. Thus, the pump portion 20*b* is rotatable integrally with the cylindrical portion 20*k*.

In the pump portion 20*b* of this example, the developer can be accommodated therein. The developer accommodating space in the pump portion 20*b* has a significant function of fluidizing the developer in the suction operation, as will be described hereinafter.

In this example, the pump portion 20*b* is a displacement type pump (bellow-like pump) of resin material in which the volume thereof changes with the reciprocation. More particularly, as shown in (a)-(b) of FIG. 33, the bellow-like pump includes crests and bottoms periodically and alternately. The pump portion 20*b* repeats the compression and the expansion alternately by the driving force received from the developer replenishing apparatus 8. In this example, the volume change by the expansion and contraction is 15 $cm^3$ (cc). As shown in part (d) of FIG. 33, a total length L2 (most expanded state within the expansion and contraction range in operation) of the pump portion 20*b* is approx. 50 mm, and a maximum outer diameter (largest state within the expansion and contraction range in operation) R2 of the pump portion 20*b* is approx. 65 mm.

With use of such a pump portion 20*b*, the internal pressure of the developer supply container 1 (developer accommodating portion 20 and discharging portion 21*h*) higher than the ambient pressure and the internal pressure lower than the ambient pressure are produced alternately and repeatedly at a predetermined cyclic period (approx. 0.9 sec in this example). The ambient pressure is the pressure of the ambient condition in which the developer supply container 1 is placed. As a result, the developer in the discharging portion 21*h* can be discharged efficiently through the small diameter discharge opening 21*a* (diameter of approx. 2 mm).

As shown in part (b) of FIG. 33, the pump portion 20*b* is connected to the discharging portion 21*h* rotatably relative thereto in the state that a discharging portion 21*h* side end is compressed against a ring-like sealing member 27 provided on an inner surface of the flange portion 21.

By this, the pump portion 20*b* rotates sliding on the sealing member 27, and therefore, the developer does not leak from the pump portion 20*b*, and the hermetical property is maintained, during rotation. Thus, in and out of the air through the discharge opening 21*a* are carries out properly, and the internal pressure of the developer supply container 1 (pump portion 20*b*, developer accommodating portion 20 and discharging portion 21*h*) are changed properly, during supply operation.

(Drive Transmission Mechanism)

The description will be made as to a drive receiving mechanism (drive inputting portion, driving force receiving portion) of the developer supply container 1 for receiving the rotational force for rotating the feeding portion 20*c* from the developer replenishing apparatus 8.

As shown in part (a) of FIG. 33, the developer supply container 1 is provided with a gear portion 20*a* which functions as a drive receiving mechanism (drive inputting portion, driving force receiving portion) engageable (driving connection) with a driving gear 300 (functioning as driving mechanism) of the developer replenishing apparatus 8. The gear portion 20*a* is fixed to one longitudinal end portion of the pump portion 20*b*. Thus, the gear portion 20*a*, the pump portion 20*b*, and the cylindrical portion 20*k* are integrally rotatable.

Therefore, the rotational force inputted to the gear portion 20*a* from the driving gear 300 is transmitted to the cylindrical portion 20*k* (feeding portion 20*c*) a pump portion 20*b*.

In other words, in this example, the pump portion 20*b* functions as a drive transmission mechanism for transmitting the rotational force inputted to the gear portion 20*a* to the feeding portion 20*c* of the developer accommodating portion 20.

For this reason, the bellow-like pump portion 20*b* of this example is made of a resin material having a high property against torsion or twisting about the axis within a limit of not adversely affecting the expanding-and-contracting operation.

In this example, the gear portion 20*a* is provided at one longitudinal end (developer feeding direction) of the developer accommodating portion 20, that is, at the discharging portion 21*h* side end, but this is not inevitable, and the gear portion 20*a* may be provided at the other longitudinal end side of the developer accommodating portion 20, that is, the trailing end portion. In such a case, the driving gear 300 is provided at a corresponding position.

In this example, a gear mechanism is employed as the driving connection mechanism between the drive inputting portion of the developer supply container 1 and the driver of the developer replenishing apparatus 8, but this is not inevitable, and a known coupling mechanism, for example is usable. More particularly, in such a case, the structure may be such that a non-circular recess is provided in a bottom surface of one longitudinal end portion (righthand side end surface of (d) of FIG. 33) as a drive inputting portion, and correspondingly, a projection having a configuration corresponding to the recess as a driver for the developer replenishing apparatus 8, so that they are in driving connection with each other.

(Drive Converting Mechanism)

A drive converting mechanism (drive converting portion) for the developer supply container 1 will be described.

The developer supply container 1 is provided with the cam mechanism for converting the rotational force for rotating the feeding portion 20*c* received by the gear portion 20*a* to a force in the reciprocating directions of the pump portion 20*b*.

That is, in the example, the description will be made as to an example using a cam mechanism as the drive converting mechanism, but the present invention is not limited to this example, and other structures such as with Embodiments 6 et seqq. are usable.

In this example, one drive inputting portion (gear portion 20*a*) receives the driving force for driving the feeding portion 20*c* and the pump portion 20*b*, and the rotational force received by the gear portion 20*a* is converted to a reciprocation force in the developer supply container 1 side.

Because of this structure, the structure of the drive inputting mechanism for the developer supply container 1 is simplified as compared with the case of providing the developer supply container 1 with two separate drive inputting portions. In addition, the drive is received by a single driving gear of developer replenishing apparatus 8, and therefore, the driving mechanism of the developer replenishing apparatus 8 is also simplified.

In the case that the reciprocation force is received from the developer replenishing apparatus 8, there is a liability that the driving connection between the developer replenishing apparatus 8 and the developer supply container 1 is not proper, and therefore, the pump portion 20*b* is not driven. More particularly, when the developer supply container 1 is taken out of the image forming apparatus 100 and then is mounted again, the pump portion 20*b* may not be properly reciprocated.

For example, when the drive input to the pump portion 20*b* stops in a state that the pump portion 20*b* is compressed from the normal length, the pump portion 20*b* restores spontaneously to the normal length when the developer supply container is taken out. In this case, the position of the drive inputting portion for the pump portion 20*b* changes when the developer supply container 1 is taken out, despite the fact that a stop position of the drive outputting portion of the image forming apparatus 100 side remains unchanged. As a result, the driving connection is not properly established between the drive outputting portion of the image forming apparatus 100 sides and pump portion 20*b* drive inputting portion of the developer supply container 1 side, and therefore, the pump portion 20*b* cannot be reciprocated. Then, the developer supply is not carries out, and sooner or later, the image formation becomes impossible.

Such a problem may similarly arise when the expansion and contraction state of the pump portion 20*b* is changed by the user while the developer supply container 1 is outside the apparatus.

Such a problem similarly arises when developer supply container 1 is exchanged with a new one.

The structure of this example is substantially free of such a problem. This will be described in detail.

As shown in FIGS. 33 and 34, the outer surface of the cylindrical portion 20*k* of the developer accommodating portion 20 is provided with a plurality of cam projections 20*d* functioning as a rotatable portion substantially at regular intervals in the circumferential direction. More particularly, two cam projections 20*d* are disposed on the outer surface of the cylindrical portion 20*k* at diametrically opposite positions, that is, approx. 180° opposing positions.

The number of the cam projections 20*d* may be at least one. However, there is a liability that a moment is produced in the drive converting mechanism and so on by a drag at the time of expansion or contraction of the pump portion 20*b*, and therefore, smooth reciprocation is disturbed, and therefore, it is preferable that a plurality of them are provided so that the relation with the configuration of the cam groove 21*b* which will be described hereinafter is maintained.

On the other hand, a cam groove 21*b* engaged with the cam projections 20*d* is formed in an inner surface of the flange portion 21 over an entire circumference, and it functions as a follower portion. Referring to FIG. 35, the cam groove 21*b* will be described. In FIG. 35, an arrow A indicates a rotational moving direction of the cylindrical portion 20*k* (moving direction of cam projection 20*d*), an arrow B indicates a direction of expansion of the pump portion 20*b*, and an arrow C indicates a direction of compression of the pump portion 20*b*. Here, an angle α is formed between a cam groove 21*c* and a rotational moving direction A of the cylindrical portion 20*k*, and an angle β is formed between a cam groove 21*d* and the rotational moving direction A. In addition, an amplitude (=length of expansion and contraction of pump portion 20*b*) in the expansion and contracting directions B, C of the pump portion 20*b* of the cam groove is L.

As shown in FIG. 35 illustrating the cam groove 21*b* in a developed view, a groove portion 21*c* inclining from the cylindrical portion 20*k* side toward the discharging portion 21*h* side and a groove portion 21*d* inclining from the discharging portion 21*h* side toward the cylindrical portion 20*k* side are connected alternately. In this example, α=β.

Therefore, in this example, the cam projection 20*d* and the cam groove 21*b* function as a drive transmission mechanism to the pump portion 20*b*. More particularly, the cam projection 20*d* and the cam groove 21*b* function as a mechanism for converting the rotational force received by the gear portion 20*a* from the driving gear 300 to the force (force in the rotational axis direction of the cylindrical portion 20*k*) in the directions of reciprocal movement of the pump portion 20*b* and for transmitting the force to the pump portion 20*b*.

More particularly, the cylindrical portion 20*k* is rotated with the pump portion 20*b* by the rotational force inputted to the gear portion 20*a* from the driving gear 300, and the cam projections 20*d* are rotated by the rotation of the cylindrical portion 20*k*. Therefore, by the cam groove 21*b* engaged with the cam projection 20*d*, the pump portion 20*b* reciprocates in the rotational axis direction (X direction of FIG. 33) together with the cylindrical portion 20*k*. The X direction is substantially parallel with the M direction of FIGS. 31 and 32.

In other words, the cam projection 20*d* and the cam groove 21*b* convert the rotational force inputted from the driving gear 300 so that the state in which the pump portion 20*b* is expanded (part (a) of FIG. 34) and the state in which the pump portion 20*b* is contracted (part (b) of FIG. 34) are repeated alternately.

Thus, in this example, the pump portion 20*b* rotates with the cylindrical portion 20*k*, and therefore, when the developer in the cylindrical portion 20*k* moves in the pump portion 20*b*, the developer can be stirred (loosened) by the rotation of the pump portion 20*b*. In this example, the pump portion 20*b* is provided between the cylindrical portion 20*k* and the discharging portion 21*h*, and therefore, stirring action can be imparted on the developer fed to the discharging portion 21*h*, which is further advantageous.

Furthermore, as described above, in this example, the cylindrical portion 20*k* reciprocates together with the pump portion 20*b*, and therefore, the reciprocation of the cylindrical portion 20*k* can stir (loosen) the developer inside cylindrical portion 20*k*.

(Set Conditions of Drive Converting Mechanism)

In this example, the drive converting mechanism effects the drive conversion such that an amount (per unit time) of developer feeding to the discharging portion 21*h* by the rotation of the cylindrical portion 20*k* is larger than a discharging amount (per unit time) to the developer replenishing apparatus 8 from the discharging portion 21*h* by the pump function.

This is, because if the developer discharging power of the pump portion 20*b* is higher than the developer feeding power of the feeding portion 20*c* to the discharging portion 21*h*, the amount of the developer existing in the discharging portion 21*h* gradually decreases. In other words, it is avoided that the time period required for supplying the developer from the developer supply container 1 to the developer replenishing apparatus 8 is prolonged.

In the drive converting mechanism of this example, the feeding amount of the developer by the feeding portion 20*c* to the discharging portion 21*h* is 2.0 g/s, and the discharge amount of the developer by pump portion 20*b* is 1.2 g/s.

In addition, in the drive converting mechanism of this example, the drive conversion is such that the pump portion 20*b* reciprocates a plurality of times per one full rotation of the cylindrical portion 20*k*. This is for the following reasons.

In the case of the structure in which the cylindrical portion 20*k* is rotated inner the developer replenishing apparatus 8, it is preferable that the driving motor 500 is set at an output required to rotate the cylindrical portion 20*k* stably at all times. However, from the standpoint of reducing the energy consumption in the image forming apparatus 100 as much as possible, it is preferable to minimize the output of the driving motor 500. The output required by the driving motor 500 is calculated from the rotational torque and the rotational frequency of the cylindrical portion 20*k*, and therefore, in order to reduce the output of the driving motor 500, the rotational frequency of the cylindrical portion 20*k* is minimized.

However, in the case of this example, if the rotational frequency of the cylindrical portion 20*k* is reduced, a number of operations of the pump portion 20*b* per unit time decreases, and therefore, the amount of the developer (per unit time) discharged from the developer supply container 1 decreases. In other words, there is a possibility that the developer amount discharged from the developer supply container 1 is insufficient to quickly meet the developer supply amount required by the main assembly of the image forming apparatus 100.

If the amount of the volume change of the pump portion 20*b* is increased, the developer discharging amount per unit cyclic period of the pump portion 20*b* can be increased, and therefore, the requirement of the main assembly of the image forming apparatus 100 can be met, but doing so gives rise to the following problem.

If the amount of the volume change of the pump portion 20*b* is increased, a peak value of the internal pressure (positive pressure) of the developer supply container 1 in the discharging step increases, and therefore, the load required for the reciprocation of the pump portion 20*b* increases.

For this reason, in this example, the pump portion 20*b* operates a plurality of cyclic periods per one full rotation of the cylindrical portion 20*k*. By this, the developer discharge amount per unit time can be increased as compared with the case in which the pump portion 20*b* operates one cyclic period per one full rotation of the cylindrical portion 20*k*, without increasing the volume change amount of the pump portion 20*b*. Corresponding to the increase of the discharge amount of the developer, the rotational frequency of the cylindrical portion 20*k* can be reduced.

Verification experiments were carried out as to the effects of the plural cyclic operations per one full rotation of the cylindrical portion 20*k*. In the experiments, the developer is filled into the developer supply container 1, and a developer discharge amount and a rotational torque of the cylindrical portion 20*k* are measured. Then, the output (=rotational torque×rotational frequency) of the driving motor 500 required for rotation a cylindrical portion 20*k* is calculated from the rotational torque of the cylindrical portion 20*k* and the preset rotational frequency of the cylindrical portion 20*k*. The experimental conditions are that the number of operations of the pump portion 20*b* per one full rotation of the cylindrical portion 20*k* is two, the rotational frequency of the cylindrical portion 20*k* is 30 rpm, and the volume change of the pump portion 20*b* is 15 $cm^3$.

As a result of the verification experiment, the developer discharging amount from the developer supply container 1 is approx. 1.2 g/s. The rotational torque of the cylindrical portion 20*k* (average torque in the normal state) is 0.64 N·m, and the output of the driving motor 500 is approx. 2 W (motor load (W)=0.1047×rotational torque (N·m)×rotational frequency (rpm), wherein 0.1047 is the unit conversion coefficient) as a result of the calculation.

Comparative experiments were carried out in which the number of operations of the pump portion 20*b* per one full rotation of the cylindrical portion 20*k* was one, the rotational frequency of the cylindrical portion 20*k* was 60 rpm, and the other conditions were the same as the above-described experiments. In other words, the developer discharge amount was made the same as with the above-described experiments, i.e. approx. 1.2 g/s.

As a result of the comparative experiments, the rotational torque of the cylindrical portion 20*k* (average torque in the normal state) is 0.66 N·m, and the output of the driving motor 500 is approx. 4 W by the calculation.

From these experiments, it has been confirmed that the pump portion 20*b* carries out preferably the cyclic operation a plurality of times per one full rotation of the cylindrical portion 20*k*. In other words, it has been confirmed that by doing so, the discharging performance of the developer supply container 1 can be maintained with a low rotational frequency of the cylindrical portion 20*k*. With the structure of this example, the required output of the driving motor 500 may be low, and therefore, the energy consumption of the main assembly of the image forming apparatus 100 can be reduced.

(Position of Drive Converting Mechanism)

As shown in FIGS. 33 and 34, in this example, the drive converting mechanism (cam mechanism constituted by the cam projection 20*d* and the cam groove 21*b*) is provided outside of developer accommodating portion 20. More particularly, the drive converting mechanism is disposed at a position separated from the inside spaces of the cylindrical portion 20*k*, the pump portion 20*b* and the flange portion 21, so that the drive converting mechanism does not contact the developer accommodated inside the cylindrical portion 20*k*, the pump portion 20*b* and the flange portion 21.

By this, a problem which may arise when the drive converting mechanism is provided in the inside space of the developer accommodating portion 20 can be avoided. More particularly, the problem is that by the developer entering portions of the drive converting mechanism where sliding motions occur, the particles of the developer are subjected to heat and pressure to soften and therefore, they agglomerate into masses (coarse particle), or they enter into a converting mechanism with the result of torque increase. The problem can be avoided.

(Developer Discharging Principle by Pump Portion)

Referring to FIG. 34, a developer supplying step by the pump portion will be described.

In this example, as will be described hereinafter, the drive conversion of the rotational force is carries out by the drive converting mechanism so that the suction step (suction operation through discharge opening 21*a*) and the discharging step (discharging operation through the discharge opening 21*a*) are repeated alternately. The suction step and the discharging step will be described.

(Suction Step)

First, the suction step (suction operation through discharge opening 21*a*) will be described.

As shown in part (a) of FIG. 34, the suction operation is effected by the pump portion 20*b* being expanded in a direction indicated by w by the above-described drive converting mechanism (cam mechanism). More particularly, by the suction operation, a volume of a portion of the developer supply container 1 (pump portion 20*b*, cylindrical portion 20*k* and flange portion 21) which can accommodate the developer increases.

At this time, the developer supply container 1 is substantially hermetically sealed except for the discharge opening 21*a*, and the discharge opening 21*a* is plugged substantially by the developer T. Therefore, the internal pressure of the developer supply container 1 decreases with the increase of the volume of the portion of the developer supply container 1 capable of containing the developer T.

At this time, the internal pressure of the developer supply container 1 is lower than the ambient pressure (external air pressure). For this reason, the air outside the developer supply container 1 enters the developer supply container 1 through the discharge opening 21*a* by a pressure difference between the inside and the outside of the developer supply container 1.

At this time, the air is taken-in from the outside of the developer supply container 1, and therefore, the developer T in the neighborhood of the discharge opening 21*a* can be loosened (fluidized). More particularly, the air impregnated into the developer powder existing in the neighborhood of the discharge opening 21*a*, thus reducing the bulk density of the developer powder T and fluidizing.

Since the air is taken into the developer supply container 1 through the discharge opening 21*a* as a result, the internal pressure of the developer supply container 1 changes in the neighborhood of the ambient pressure (external air pressure) despite the increase of the volume of the developer supply container 1.

In this manner, by the fluidization of the developer T, the developer T does not pack or clog in the discharge opening 21*a*, so that the developer can be smoothly discharged through the discharge opening 21*a* in the discharging operation which will be described hereinafter. Therefore, the amount of the developer T (per unit time) discharged through the discharge opening 21*a* can be maintained substantially at a constant level for a long term.

(Discharging Step)

The discharging step (discharging operation through the discharge opening 21*a*) will be described.

As shown in part (b) of FIG. 34, the discharging operation is effected by the pump portion 20*b* being compressed in a direction indicated by γ by the above-described drive converting mechanism (cam mechanism). More particularly, by the discharging operation, a volume of a portion of the developer supply container 1 (pump portion 20*b*, cylindrical portion 20*k* and flange portion 21) which can accommodate the developer decreases. At this time, the developer supply container 1 is substantially hermetically sealed except for the discharge opening 21*a*, and the discharge opening 21*a* is plugged substantially by the developer T until the developer is discharged. Therefore, the internal pressure of the developer supply container 1 rises with the decrease of the volume of the portion of the developer supply container 1 capable of containing the developer T.

Since the internal pressure of the developer supply container 1 is higher than the ambient pressure (the external air pressure), the developer T is pushed out by the pressure difference between the inside and the outside of the developer supply container 1, as shown in part (b) of FIG. 34. That is, the developer T is discharged from the developer supply container 1 into the developer replenishing apparatus 8.

Thereafter, the air in the developer supply container 1 is also discharged with the developer T, and therefore, the internal pressure of the developer supply container 1 decreases.

As described in the foregoing, according to this example, the discharging of the developer can be effected efficiently using one reciprocation type pump, and therefore, the mechanism for the developer discharging can be simplified.

(Set Condition of Cam Groove)

Referring to FIGS. 36-41, modified examples of the set condition of the cam groove 21*b* will be described. FIGS. 36-41 are developed views of cam grooves 3*b*. Referring to the developed views of FIGS. 36-41, the description will be made as to the influence to the operational condition of the pump portion 20*b* when the configuration of the cam groove 21*b* is changed.

Here, in each of FIGS. 36-41, an arrow A indicates a rotational moving direction of the developer accommodating portion 20 (moving direction of the cam projection 20*d*); an arrow B indicates the expansion direction of the pump portion 20*b*; and an arrow C indicates a compression direction of the pump portion 20*b*. In addition, a groove portion of the cam groove 21*b* for compressing the pump portion 20*b* is indicated as a cam groove 21*c*, and a groove portion for expanding the pump portion 20*b* is indicated as a cam groove 21*d*. Furthermore, an angle formed between the cam groove 21*c* and the rotational moving direction A of the developer accommodating portion 20 is a; an angle formed between the cam groove 21*d* and the rotational moving direction A is β; and an amplitude (expansion and contraction length of the pump portion 20*b*), in the expansion and contracting directions B, C of the pump portion 20*b*, of the cam groove is L.

First, the description will be made as to the expansion and contraction length L of the pump portion 20*b*.

When the expansion and contraction length L is shortened, the volume change amount of the pump portion 20*b* decreases, and therefore, the pressure difference from the external air pressure is reduced. Then, the pressure imparted to the developer in the developer supply container 1 decreases, with the result that the amount of the developer discharged from the developer supply container 1 per one cyclic period (one reciprocation, that is, one expansion and contracting operation of the pump portion 20*b*) decreases.

From this consideration, as shown in FIG. 36, the amount of the developer discharged when the pump portion 20*b* is reciprocated once, can be decreased as compared with the structure of FIG. 35, if an amplitude L' is selected so as to satisfy L'<L under the condition that the angles α and β are constant. On the contrary, if L'>L, the developer discharge amount can be increased.

As regards the angles α and β of the cam groove, when the angles are increased, for example, the movement distance of the cam projection 20*d* when the developer accommodating portion 20 rotates for a constant time increases if the rotational speed of the developer accommodating portion 20 is constant, and therefore, as a result, the expansion-and-contraction speed of the pump portion 20*b* increases.

On the other hand, when the cam projection 20*d* moves in the cam groove 21*b*, the resistance received from the cam groove 21*b* is large, and therefore, a torque required for rotating the developer accommodating portion 20 increases as a result.

For this reason, as shown in FIG. 37, if the angle β' of the cam groove 21*d* of the cam groove 21*d* is selected so as to satisfy α'>α and β'>β without changing the expansion and contraction length L, the expansion-and-contraction speed of the pump portion 20*b* can be increased as compared with the structure of the FIG. 35. As a result, the number of expansion and contracting operations of the pump portion 20*b* per one rotation of the developer accommodating portion 20 can be increased. Furthermore, since a flow speed of the air entering the developer supply container 1 through the discharge opening 21*a* increases, the loosening effect to the developer existing in the neighborhood of the discharge opening 21*a* is enhanced.

On the contrary, if the selection satisfies α'<α and β'<β, the rotational torque of the developer accommodating portion 20 can be decreased. When a developer having a high flowability is used, for example, the expansion of the pump portion 20*b* tends to cause the air entered through the discharge opening 21*a* to blow out the developer existing in the neighborhood of the discharge opening 21*a*. As a result, there is a possibility that the developer cannot be accumulated sufficiently in the discharging portion 21*h*, and therefore, the developer discharge amount decreases. In this case, by decreasing the expanding speed of the pump portion 20*b* in accordance with this selection, the blowing-out of the developer can be suppressed, and therefore, the discharging power can be improved.

If, as shown in FIG. 38, the angle of the cam groove 21*b* is selected so as to satisfy α<β, the expanding speed of the pump portion 20*b* can be increased as compared with a compressing speed. On the contrary, as shown in FIG. 40, if the angle α>the angle β, the expanding speed of the pump portion 20*b* can be reduced as compared with the compressing speed.

When the developer is in a highly packed state, for example, the operation force of the pump portion 20*b* is larger in a compression stroke of the pump portion 20*b* than in an expansion stroke thereof, with the result that the rotational torque for the developer accommodating portion 20 tends to be higher in the compression stroke of the pump portion 20*b*. However, in this case, if the cam groove 21*b* is constructed as shown in FIG. 38, the developer loosening effect in the expansion stroke of the pump portion 20*b* can be enhanced as compared with the structure of FIG. 35. In addition, the resistance received by the cam projection 20*d* from the cam groove 21*b* in the compression stroke is small, and therefore, the increase of the rotational torque in the compression of the pump portion 20*b* can be suppressed.

As shown in FIG. 39, a cam groove 21*e* substantially parallel with the rotational moving direction (arrow A in the Figure) of the developer accommodating portion 20 may be provided between the cam grooves 21*c*, 21*d*. In this case, the cam does not function while the cam projection 20*d* is moving in the cam groove 21*e*, and therefore, a step in which the pump portion 20*b* does not carry out the expanding-and-contracting operation can be provided.

By doing so, if a process in which the pump portion 20*b* is at rest in the expanded state is provided, the developer loosening effect is improved, since then in an initial stage of the discharging in which the developer is present always in the neighborhood of the discharge opening 21*a*, the pressure reduction state in the developer supply container 1 is maintained during the rest period.

On the other hand, in a last part of the discharging, the developer is not stored sufficiently in the discharging portion 21*h*, because the amount of the developer inside the developer supply container 1 is small and because the developer existing in the neighborhood of the discharge opening 21*a* is blown out by the air entered through the discharge opening 21*a*.

In other words, the developer discharge amount tends to gradually decrease, but even in such a case, by continuing to feed the developer by rotating is developer accommodating portion 20 during the rest period with the expanded state, the discharging portion 21*h* can be filled sufficiently with the developer. Therefore, a stabilization developer discharge amount can be maintained until the developer supply container 1 becomes empty.

In addition, in the structure of FIG. 35, by making the expansion and contraction length L of the cam groove longer, the developer discharging amount per one cyclic period of the pump portion 20*b* can be increased. However, in this case, the amount of the volume change of the pump portion 20*b* increases, and therefore, the pressure difference from the external air pressure also increases. For this reason, the driving force required for driving the pump portion 20*b* also increases, and therefore, there is a liability that a drive load required by the developer replenishing apparatus 8 is excessively large.

Under the circumstances, in order to increase the developer discharge amount per one cyclic period of the pump portion 20*b* without giving rise to such a problem, the angle of the cam groove 21*b* is selected so as to satisfy $\alpha>\beta$, by which the compressing speed of a pump portion 20*b* can be increased as compared with the expanding speed, as shown in FIG. 40.

Verification experiments were carried out as to the structure of FIG. 40.

In the experiments, the developer is filled in the developer supply container 1 having the cam groove 21*b* shown in FIG. 40; the volume change of the pump portion 20*b* is carried out in the order of the compressing operation and then the expanding operation to discharge the developer; and the discharge amounts are measured. The experimental conditions are that the amount of the volume change of the pump portion 20*b* is 50 $cm^3$, the compressing speed of the pump portion 20*b* the 180 $cm^3/s$, and the expanding speed of the pump portion 20*b* is 60 $cm^3/s$. The cyclic period of the operation of the pump portion 20*b* is approx. 1.1 seconds.

The developer discharge amounts are measured in the case of the structure of FIG. 35. However, the compressing speed and the expanding speed of the pump portion 20*b* are 90 $cm^3/s$, and the amount of the volume change of the pump portion 20*b* and one cyclic period of the pump portion 20*b* is the same as in the example of FIG. 40.

The results of the verification experiments will be described. Part (a) of FIG. 42 shows the change of the internal pressure of the developer supply container 1 in the volume change of the pump 2*b*. In part (a) of FIG. 42, the abscissa represents the time, and the ordinate represents a relative pressure in the developer supply container 1 (+ is positive pressure side, is negative pressure side) relative to the ambient pressure (reference (0)). Solid lines and broken lines are for the developer supply container 1 having the cam groove 21*b* of FIG. 40, and that of FIG. 35, respectively.

In the compressing operation of the pump portion 20*b*, the internal pressures rise with elapse of time and reach the peaks upon completion of the compressing operation, in both examples. At this time, the pressure in the developer supply container 1 changes within a positive range relative to the ambient pressure (external air pressure), and therefore, the inside developer is pressurized, and the developer is discharged through the discharge opening 21*a*.

Subsequently, in the expanding operation of the pump portion 20*b*, the volume of the pump portion 20*b* increases for the internal pressures of the developer supply container 1 decrease, in both examples. At this time, the pressure in the developer supply container 1 changes from the positive pressure to the negative pressure relative to the ambient pressure (external air pressure), and the pressure continues to apply to the inside developer until the air is taken in through the discharge opening 21*a*, and therefore, the developer is discharged through the discharge opening 21*a*.

That is, in the volume change of the pump portion 20*b*, when the developer supply container 1 is in the positive pressure state, that is, when the inside developer is pressurized, the developer is discharged, and therefore, the developer discharge amount in the volume change of the pump portion 20*b* increases with a time-integration amount of the pressure.

As shown in part (a) of FIG. 42, the peak pressure at the time of completion of the compressing operation of the pump 2*b* is 5.7 kPa with the structure of FIG. 40 and is 5.4 kPa with the structure of the FIG. 35, and it is higher in the structure of FIG. 40 despite the fact that the volume change amounts of the pump portion 20*b* are the same. This is because by increasing the compressing speed of the pump portion 20*b*, the inside of the developer supply container 1 is pressurized abruptly, and the developer is concentrated to the discharge opening 21*a* at once, with the result that a discharge resistance in the discharging of the developer through the discharge opening 21*a* becomes large. Since the discharge openings 3*a* have small diameters in both examples, the tendency is remarkable. Since the time required for one cyclic period of the pump portion is the same in both examples as shown in (a) of FIG. 42, the time integration amount of the pressure is larger in the example of the FIG. 40.

Following Table 2 shows measured data of the developer discharge amount per one cyclic period operation of the pump portion 20*b*.

TABLE 2

| | Amount of developer discharge (g) |
|---|---|
| FIG. 35 | 3.4 |
| FIG. 40 | 3.7 |
| FIG. 41 | 4.5 |

As shown in Table 2, the developer discharge amount is 3.7 g in the structure of FIG. 40, and is 3.4 g in the structure of FIG. 35, that is, it is larger in the case of FIG. 40 structure. From these results and, the results of part (a) of the FIG. 42, it has been confirmed that the developer discharge amount per one cyclic period of the pump portion 20*b* increases with the time integration amount of the pressure.

From the foregoing, the developer discharging amount per one cyclic period of the pump portion 20*b* can be increased by making the compressing speed of the pump portion 20*b* higher as compared with the expansion speed and making the peak pressure in the compressing operation of the pump portion 20*b* higher as shown in FIG. 40.

The description will be made as to another method for increasing the developer discharging amount per one cyclic period of the pump portion 20*b*.

With the cam groove 21*b* shown in FIG. 41, similarly to the case of FIG. 39, a cam groove 21*e* substantially parallel with the rotational moving direction of the developer accommodating portion 20 is provided between the cam groove 21*c* and the cam groove 21*d*. However, in the case of the cam groove 21*b* shown in FIG. 41, the cam groove 21*e* is provided at such a position that in a cyclic period of the pump portion 20*b*, the operation of the pump portion 20*b* stops in the state that the pump portion 20*b* is compressed, after the compressing operation of the pump portion 20*b*.

With the structure of the FIG. 41, the developer discharge amount was measured similarly. In the verification experiments for this, the compressing speed and the expanding speed of the pump portion 20*b* is 180 $cm^3/s$, and the other conditions are the same as with FIG. 40 example.

The results of the verification experiments will be described. Part (b) of the FIG. 42 shows changes of the internal pressure of the developer supply container 1 in the expanding-and-contracting operation of the pump portion 2*b*. Solid lines and broken lines are for the developer supply container 1 having the cam groove 21*b* of FIG. 41 and that of FIG. 40, respectively.

Also in the case of FIG. 41, the internal pressure rises with elapse of time during the compressing operation of the pump portion 20*b*, and reaches the peak upon completion of the compressing operation. At this time, similarly to FIG. 40, the pressure in the developer supply container 1 changes within the positive range, and therefore, the inside developer are discharged. The compressing speed of the pump portion 20*b* in the example of the FIG. 41 is the same as with FIG. 40 example, and therefore, the peak pressure upon completion of the compressing operation of the pump portion 2*b* is 5.7 kPa which is equivalent to the FIG. 40 example.

Subsequently, when the pump portion 20*b* stops in the compression state, the internal pressure of the developer supply container 1 gradually decreases. This is because the pressure produced by the compressing operation of the pump 2*b* remains after the operation stop of the pump 2*b*, and the inside developer and the air are discharged by the pressure. However, the internal pressure can be maintained at a level higher than in the case that the expanding operation is started immediately after completion of the compressing operation, and therefore, a larger amount of the developer is discharged during it.

When the expanding operation starts thereafter, similarly to the example of the FIG. 40, the internal pressure of the developer supply container 1 decreases, and the developer is discharged until the pressure in the developer supply container 1 becomes negative, since the inside developer is pressed continuously.

As time integration values of the pressure are compared as shown is part (b) of FIG. 42, it is larger in the case of FIG. 41, because the high internal pressure is maintained during the rest period of the pump portion 20*b* under the condition that the time durations in unit cyclic periods of the pump portion 20*b* in these examples are the same.

As shown in Table 2, the measured developer discharge amounts per one cyclic period of the pump portion 20*b* is 4.5 g in the case of FIG. 41, and is larger than in the case of FIG. 40 (3.7 g). From the results of the Table 2 and the results shown in part (b) of FIG. 42, it has been confirmed that the developer discharge amount per one cyclic period of the pump portion 20*b* increases with time integration amount of the pressure.

Thus, in the example of FIG. 41, the operation of the pump portion 20*b* is stopped in the compressed state, after the compressing operation. For this reason, the peak pressure in the developer supply container 1 in the compressing operation of the pump 2*b* is high, and the pressure is maintained at a level as high as possible, by which the developer discharging amount per one cyclic period of the pump portion 20*b* can be further increased.

As described in the foregoing, by changing the configuration of the cam groove 21*b*, the discharging power of the developer supply container 1 can be adjusted, and therefore, the apparatus of this embodiment can respond to a developer amount required by the developer replenishing apparatus 8 and to a property or the like of the developer to use.

In FIGS. 35-41, the discharging operation and the suction operation of the pump portion 20*b* are alternately carried out, but the discharging operation and/or the suction operation may be temporarily stopped partway, and a predetermined time after the discharging operation and/or the suction operation may be resumed.

For example, it is a possible alternative that the discharging operation of the pump portion 20*b* is not carried out monotonically, but the compressing operation of the pump portion is temporarily stopped partway, and then, the compressing operation is compressed to effect discharge. The same applies to the suction operation. Furthermore, the discharging operation and/or the suction operation may be multi-step type, as long as the developer discharge amount and the discharging speed are satisfied. Thus, even when the discharging operation and/or the suction operation are divided into multi-steps, the situation is still that the discharging operation and the suction operation are alternately repeated.

As described in the foregoing, also in this embodiment, one pump is enough to effect the suction operation and the discharging operation, and therefore, the structure of the developer discharging mechanism can be simplified. Furthermore, by the suction operation through the discharge opening, the decompressed state (negative pressure state) can be provided in the developer supply container, and therefore, the developer can be efficiently loosened.

In addition, in this example, the driving force for rotating the feeding portion (helical projection 20*c*) and the driving force for reciprocating the pump portion (bellow-like pump 2*b*) are received by a single drive inputting portion (gear portion 20*a*). Therefore, the structure of the drive inputting mechanism of the developer supply container can be simplified. In addition, by the single driving mechanism (driving gear 300) provided in the developer replenishing apparatus, the driving force is applied to the developer supply container, and therefore, the driving mechanism for the developer replenishing apparatus can be simplified. Furthermore, a simple and easy mechanism can be employed positioning the developer supply container relative to the developer replenishing apparatus.

With the structure of the example, the rotational force for rotating the feeding portion received from the developer replenishing apparatus is converted by the drive converting mechanism of the developer supply container, by which the pump portion can be reciprocated properly. In other words, in a system in which the developer supply container receives the reciprocating force from the developer replenishing apparatus, the appropriate drive of the pump portion is assured.

Embodiment 6

Referring to FIG. 43 (parts (a) and (b)), structures of the Embodiment 6 will be described. Part (a) of the FIG. 43 is a schematic perspective view of the developer supply container 1, and part (b) of the FIG. 43 is a schematic sectional view illustrating a state in which a pump portion 20*b* expands. In this example, the same reference numerals as in Embodiment 1 are assigned to the elements having the corresponding functions in this embodiment, and the detailed description thereof is omitted.

In this example, a drive converting mechanism (cam mechanism) is provided together with a pump portion 20*b* in a position dividing a cylindrical portion 20*k* with respect to a rotational axis direction of the developer supply container 1, as is significantly different from Embodiment 5. The other structures are substantially similar to the structures of Embodiment 5.

As shown in part (a) of FIG. 43, in this example, the cylindrical portion 20*k* which feeds the developer toward a discharging portion 21*h* with rotation comprises a cylindrical portion 20*k*1 and a cylindrical portion 20*k*2. The pump portion 20*b* is provided between the cylindrical portion 20*k*1 and the cylindrical portion 20*k*2.

A cam flange portion 15 functioning as a drive converting mechanism is provided at a position corresponding to the pump portion 20*b*. An inner surface of the cam flange portion 15 is provided with a cam groove 15*a* extending over the entire circumference as in Embodiment 5. On the other hand, an outer surface of the cylindrical portion 20*k*2 is provided a cam projection 20*d* functioning as a drive converting mechanism and is locked with the cam groove 15*a*.

The developer replenishing apparatus 8 is provided with a portion similar to the rotational moving direction regulating portion 11 (FIG. 31), and is held substantially non-rotatably by this portion. Furthermore, the developer replenishing apparatus 8 is provided with a portion similar to the rotational axis direction regulating portion 30 (FIG. 31), and the flange portion 15 is held substantially non-rotatably by this portion.

Therefore, when a rotational force is inputted to a gear portion 20*a*, the pump portion 20*b* reciprocates together with the cylindrical portion 20*k*2 in the directions ω and γ.

As described in the foregoing, in this example, the suction operation and the discharging operation can be effected by a single pump, and therefore, the structure of the developer discharging mechanism can be simplified. By the suction operation through the suction operation, the decompressed state (negative pressure state) can be provided in the developer supply container, and therefore the developer can be efficiently loosened. In addition, also in the case that the pump portion 20*b* is disposed at a position dividing the cylindrical portion, the pump portion 20*b* can be reciprocated by the rotational driving force received from the developer replenishing apparatus 8, as in Embodiment 5.

Here, the structure of Embodiment 5 in which the pump portion 20*b* is directly connected with the discharging portion 21*h* is preferable from the standpoint that the pumping action of the pump portion 20*b* can be efficiently applied to the developer stored in the discharging portion 21*h*.

In addition, this embodiment requires an additional cam flange portion (drive converting mechanism) which are has to be held substantially stationarily by the developer replenishing apparatus 8. Furthermore, this embodiment requires an additional mechanism, in the developer replenishing apparatus 8, for limiting movement of the cam flange portion 15 in the rotational axis direction of the cylindrical portion 20*k*. Therefore, in view of such a complication, the structure of Embodiment 5 using the flange portion 21 is preferable.

This is because in Embodiment 5, the flange portion 21 is supported by the developer replenishing apparatus 8 in order to make the position of the discharge opening 21*a* substantially stationary, and one of the cam mechanisms constituting the drive converting mechanism is provided in the flange portion 21. That is the drive converting mechanism is simplified in this manner.

Embodiment 7

Referring to FIG. 44, the structures of Embodiment 7 will be described. In this example, the same reference numerals as in the foregoing embodiments are assigned to the elements having the corresponding functions in this embodiment, and the detailed description thereof is omitted.

This example is significantly different from Embodiment 5 in that a drive converting mechanism (cam mechanism) is provided at an upstream end of the developer supply container 1 with respect to the feeding direction for the developer and in that the developer in the cylindrical portion 20*k* is fed using a stirring member 20*m*. The other structures are substantially similar to the structures of Embodiment 5.

As shown in FIG. 44, in this example, the stirring member 20*m* is provided in the cylindrical portion 20*k* as the feeding portion and rotates relative to the cylindrical portion 20*k*. The stirring member 20*m* rotates by the rotational force received by the gear portion 20*a*, relative to the cylindrical portion 20*k* fixed to the developer replenishing apparatus 8 non-rotatably, by which the developer is fed in a rotational axis direction toward the discharging portion 21*h* while being stirred. More particularly, the stirring member 20*m* is provided with a shaft portion and a feeding blade portion fixed to the shaft portion.

In this example, the gear portion 20*a* as the drive inputting portion is provided at one longitudinal end portion of the developer supply container 1 (righthand side in FIG. 44), and the gear portion 20*a* is connected co-axially with the stirring member 20*m*.

In addition, a hollow cam flange portion 21*i* which is integral with the gear portion 20*a* is provided at one longitudinal end portion of the developer supply container (right-hand side in FIG. 44) so as to rotate co-axially with the gear portion 20*a*. The cam flange portion 21*i* is provided with a cam groove 21*b* which extends in an inner surface over the entire inner circumference, and the cam groove 21*b* is engaged with two cam projections 20*d* provided on an outer surface of the cylindrical portion 20*k* at substantially diametrically opposite positions, respectively.

One end portion (discharging portion 21*h* side) of the cylindrical portion 20*k* is fixed to the pump portion 20*b*, and the pump portion 20*b* is fixed to a flange portion 21 at one end portion (discharging portion 21*h* side) thereof. They are fixed by welding method. Therefore, in the state that it is mounted to the developer replenishing apparatus 8, the pump portion 20*b* and the cylindrical portion 20*k* are substantially non-rotatable relative to the flange portion 21.

Also in this example, similarly to the Embodiment 5, when the developer supply container 1 is mounted to the developer replenishing apparatus 8, the flange portion 21 (discharging portion 21*h*) is prevented from the movements in the rotational moving direction and the rotational axis direction by the developer replenishing apparatus 8.

Therefore, when the rotational force is inputted from the developer replenishing apparatus 8 to the gear portion 20*a*, the cam flange portion 21*i* rotates together with the stirring member 20*m*. As a result, the cam projection 20*d* is driven by the cam groove 21*b* of the cam flange portion 21*i* so that the cylindrical portion 20*k* reciprocates in the rotational axis direction to expand and contract the pump portion 20*b*.

In this manner, by the rotation of the stirring member 20*m*, the developer is fed to the discharging portion 21*h*, and the developer in the discharging portion 21*h* is finally discharged through a discharge opening 21*a* by the suction and discharging operation of the pump portion 20*b*.

As described in the foregoing, also in this embodiment, one pump is enough to effect the suction operation and the discharging operation, and therefore, the structure of the developer discharging mechanism can be simplified. Furthermore, by the suction operation through the discharge opening, the decompressed state (negative pressure state) can be provided in the developer supply container, and therefore, the developer can be efficiently loosened.

In addition, in the structure of this example, similarly to the Embodiments 5-6, both of the rotating operation of the stirring member 20*m* provided in the cylindrical portion 20*k* and the reciprocation of the pump portion 20*b* can be performed by the rotational force received by the gear portion 20*a* from the developer replenishing apparatus 8.

In the case of this example, the stress applied to the developer in the developer feeding step at the cylindrical portion 20*k* tends to be relatively large, and the driving torque is relatively large, and from this standpoint, the structures of Embodiments 5 and 6 are preferable.

Embodiment 8

Referring to FIG. 45 (parts (a)-(d)), structures of the Embodiment 8 will be described. Part (a) of FIG. 45 is a schematic perspective view of a developer supply container 1, (b) is an enlarged sectional view of the developer supply container 1, and (c)-(d) are enlarged perspective views of the cam portions. In this example, the same reference numerals as in the foregoing Embodiments are assigned to the elements having the corresponding functions in this embodiment, and the detailed description thereof is omitted.

This example is substantially the same as Embodiment 5 except that the pump portion 20*b* is made non-rotatable by a developer replenishing apparatus 8.

In this example, as shown in parts (a) and (b) of FIG. 45, relaying portion 20*f* is provided between a pump portion 20*b* and a cylindrical portion 20*k* of a developer accommodating portion 20. The relaying portion 20*f* is provided with two cam projections 20*d* on the outer surface thereof at the positions substantially diametrically opposed to each other, and one end thereof (discharging portion 21*h* side) is connected to and fixed to the pump portion 20*b* (welding method).

Another end (discharging portion 21*h* side) of the pump portion 20*b* is fixed to a flange portion 21 (welding method), and in the state that it is mounted to the developer replenishing apparatus 8, it is substantially non-rotatable.

A sealing member 27 is compressed between the cylindrical portion 20*k* and the relaying portion 20*f*, and the cylindrical portion 20*k* is unified so as to be rotatable relative to the relaying portion 20*f*. The outer peripheral portion of the cylindrical portion 20*k* is provided with a rotation receiving portion (projection) 20*g* for receiving a rotational force from a cam gear portion 7, as will be described hereinafter.

On the other hand, the cam gear portion 7 which is cylindrical is provided so as to cover the outer surface of the relaying portion 20*f*. The cam gear portion 7 is engaged with the flange portion 21 so as to be substantially stationary (movement within the limit of play is permitted), and is rotatable relative to the flange portion 21.

As shown in part (c) of FIG. 45, the cam gear portion 7 is provided with a gear portion 7*a* as a drive inputting portion for receiving the rotational force from the developer replenishing apparatus 8, and a cam groove 7*b* engaged with the cam projection 20*d*. In addition, as shown in part (d) of FIG. 45, the cam gear portion 7 is provided with a rotational engaging portion (recess) 7*c* engaged with the rotation receiving portion 20*g* to rotate together with the cylindrical portion 20*k*. Thus, by the above-described engaging relation, the rotational engaging portion (recess) 7*c* is permitted to move relative to the rotation receiving portion 20*g* in the rotational axis direction, but it can rotate integrally in the rotational moving direction.

The description will be made as to a developer supplying step of the developer supply container 1 in this example.

When the gear portion 7*a* receives a rotational force from the driving gear 300 of the developer replenishing apparatus 8, and the cam gear portion 7 rotates, the cam gear portion 7 rotates together with the cylindrical portion 20*k* because of the engaging relation with the rotation receiving portion 20*g* by the rotational engaging portion 7*c*. That is, the rotational engaging portion 7*c* and the rotation receiving portion 20*g* function to transmit the rotational force which is received by the gear portion 7*a* from the developer replenishing apparatus 8, to the cylindrical portion 20*k* (feeding portion 20*c*).

On the other hand, similarly to Embodiments 5-7, when the developer supply container 1 is mounted to the developer replenishing apparatus 8, the flange portion 21 is non-rotatably supported by the developer replenishing apparatus 8, and therefore, the pump portion 20*b* and the relaying portion 20*f* fixed to the flange portion 21 is also non-rotatable. In addition, the movement of the flange portion 21 in the rotational axis direction is prevented by the developer replenishing apparatus 8.

Therefore, when the cam gear portion 7 rotates, a cam function occurs between the cam groove 7*b* of the cam gear portion 7 and the cam projection 20*d* of the relaying portion 20*f*. Thus, the rotational force inputted to the gear portion 7*a* from the developer replenishing apparatus 8 is converted to the force reciprocating the relaying portion 20*f* and the cylindrical portion 20*k* in the rotational axis direction of the developer accommodating portion 20. As a result, the pump portion 20*b* which is fixed to the flange portion 21 at one end position (left side in part (b) of the FIG. 45) with respect to the reciprocating direction expands and contracts in interrelation with the reciprocation of the relaying portion 20*f* and the cylindrical portion 20*k*, thus effecting a pump operation.

In this manner, with the rotation of the cylindrical portion 20*k*, the developer is fed to the discharging portion 21*h* by the feeding portion 20*c*, and the developer in the discharging portion 21*h* is finally discharged through a discharge opening 21*a* by the suction and discharging operation of the pump portion 20*b*.

As described in the foregoing, also in this embodiment, one pump is enough to effect the suction operation and the discharging operation, and therefore, the structure of the developer discharging mechanism can be simplified. Furthermore, by the suction operation through the discharge opening, the decompressed state (negative pressure state) can be provided in the developer supply container, and therefore, the developer can be efficiently loosened.

In addition, in this example, the rotational force received from the developer replenishing apparatus 8 is transmitted and converted simultaneously to the force rotating the cylindrical portion 20*k* and to the force reciprocating (expanding-and-contracting operation) the pump portion 20*b* in the rotational axis direction.

Therefore, also in this example, similarly to Embodiments 5-7, by the rotational force received from the developer replenishing apparatus 8, both of the rotating operation of the cylindrical portion 20*k* (feeding portion 20*c*) and the reciprocation of the pump portion 20*b* can be effected.

Embodiment 9

Referring to parts (a) and (b) of the FIG. 46, Embodiment 9 will be described. Part (a) of the FIG. 46 is a schematic perspective view of a developer supply container 1, and part (b) is an enlarged sectional view of the developer supply container 1. In this example, the same reference numerals as in the foregoing Embodiments are assigned to the elements having the corresponding functions in this embodiment, and the detailed description thereof is omitted.

This example is significantly different from Embodiment 5 in that a rotational force received from a driving mechanism 300 of a developer replenishing apparatus 8 is converted to a reciprocating force for reciprocating a pump portion 20*b*, and then the reciprocating force is converted to a rotational force, by which a cylindrical portion 20*k* is rotated.

In this example, as shown in part (b) of the FIG. 46, a relaying portion 20*f* is provided between the pump portion 20*b* and the cylindrical portion 20*k*. The relaying portion 20*f* includes two cam projections 20*d* at substantially diametrically opposite positions, respectively, and one end sides thereof (discharging portion 21*h* side) are connected and fixed to the pump portion 20*b* by welding method.

Another end (discharging portion 21*h* side) of the pump portion 20*b* is fixed to a flange portion 21 (welding method), and in the state that it is mounted to the developer replenishing apparatus 8, it is substantially non-rotatable.

Between the one end portion of the cylindrical portion 20*k* and the relaying portion 20*f*, a sealing member 27 is compressed, and the cylindrical portion 20*k* is unified such that it is rotatable relative to the relaying portion 20*f*. An outer periphery portion of the cylindrical portion 20*k* is provided with two cam projections 20*i* at substantially diametrically opposite positions, respectively.

On the other hand, a cylindrical cam gear portion 7 is provided so as to cover the outer surfaces of the pump portion 20*b* and the relaying portion 20*f*. The cam gear portion 7 is engaged so that it is non-movable relative to the flange portion 21 in a rotational axis direction of the cylindrical portion 20*k* but it is rotatable relative thereto. The cam gear portion 7 is provided with a gear portion 7*a* as a drive inputting portion for receiving the rotational force from the developer replenishing apparatus 8, and a cam groove 7*b* engaged with the cam projection 20*d*.

Furthermore, there is provided a cam flange portion 15 covering the outer surfaces of the relaying portion 20*f* and the cylindrical portion 20*k*. When the developer supply container 1 is mounted to a mounting portion 8*f* of the developer replenishing apparatus 8, cam flange portion 15 is substantially non-movable. The cam flange portion 15 is provided with a cam projection 20*i* and a cam groove 15*a*.

A developer supplying step in this example will be described.

The gear portion 7*a* receives a rotational force from a driving gear 300 of the developer replenishing apparatus 8 by which the cam gear portion 7 rotates. Then, since the pump portion 20*b* and the relaying portion 20*f* are held non-rotatably by the flange portion 21, a cam function occurs between the cam groove 7*b* of the cam gear portion 7 and the cam projection 20*d* of the relaying portion 20*f*.

More particularly, the rotational force inputted to the gear portion 7*a* from the developer replenishing apparatus 8 is converted to a reciprocation force the relaying portion 20*f* in the rotational axis direction of the cylindrical portion 20*k*. As a result, the pump portion 20*b* which is fixed to the flange portion 21 at one end with respect to the reciprocating direction the left side of the part (b) of the FIG. 46) expands and contracts in interrelation with the reciprocation of the relaying portion 20*f*, thus effecting the pump operation.

When the relaying portion 20*f* reciprocates, a cam function works between the cam groove 15*a* of the cam flange portion 15 and the cam projection 20*i* by which the force in the rotational axis direction is converted to a force in the rotational moving direction, and the force is transmitted to the cylindrical portion 20*k*. As a result, the cylindrical portion 20*k* (feeding portion 20*c*) rotates. In this manner, with the rotation of the cylindrical portion 20*k*, the developer is fed to the discharging portion 21*h* by the feeding portion 20*c*, and the developer in the discharging portion 21*h* is finally discharged through a discharge opening 21*a* by the suction and discharging operation of the pump portion 20*b*.

As described in the foregoing, also in this embodiment, one pump is enough to effect the suction operation and the discharging operation, and therefore, the structure of the developer discharging mechanism can be simplified. Furthermore, by the suction operation through the discharge opening, the decompressed state (negative pressure state) can be provided in the developer supply container, and therefore, the developer can be efficiently loosened.

In addition, in this example, the rotational force received from the developer replenishing apparatus 8 is converted to the force reciprocating the pump portion 20*b* in the rotational axis direction (expanding-and-contracting operation), and then the force is converted to a force rotation the cylindrical portion 20*k* and is transmitted.

Therefore, also in this example, similarly to Embodiments 5-8, by the rotational force received from the developer replenishing apparatus 8, both of the rotating operation of the cylindrical portion 20*k* (feeding portion 20*c*) and the reciprocation of the pump portion 20*b* can be effected.

However, in this example, the rotational force inputted from the developer replenishing apparatus 8 is converted to the reciprocating force and then is converted to the force in the rotational moving direction with the result of complicated structure of the drive converting mechanism, and therefore, Embodiments 5-8 in which the re-conversion is unnecessary are preferable.

Embodiment 10

Referring to parts (a)-(b) of FIG. 47 and parts (a)-(d) of FIG. 48, Embodiment 10 will be described. Part (a) of FIG. 47 is a schematic perspective view of a developer supply container, part (b) is an enlarged sectional view of the developer supply container 1, and parts (a)-(d) of FIG. 48 are enlarged views of a drive converting mechanism. In parts (a)-(d) of FIG. 48, a gear ring 60 and a rotational engaging portion 8*b* are shown as always taking top positions for better illustration of the operations thereof. In this example, the same reference numerals as in the foregoing embodiments are assigned to the elements having the corresponding functions in this embodiment, and the detailed description thereof is omitted.

In this example, the drive converting mechanism employs a bevel gear, as is contrasted to the foregoing examples.

As shown in part (b) of FIG. 47, a relaying portion 20*f* is provided between a pump portion 20*b* and a cylindrical portion 20*k*. The relaying portion 20*f* is provided with an engaging projection 20*h* engaged with a connecting portion 62 which will be described hereinafter.

Another end (discharging portion 21*h* side) of the pump portion 20*b* is fixed to a flange portion 21 (welding method), and in the state that it is mounted to the developer replenishing apparatus 8, it is substantially non-rotatable.

A sealing member 27 is compressed between the discharging portion 21*h* side end of the cylindrical portion 20*k* and the relaying portion 20*f*, and the cylindrical portion 20*k* is unified so as to be rotatable relative to the relaying portion 20*f*. An outer periphery portion of the cylindrical portion 20*k* is provided with a rotation receiving portion (projection) 20*g* for receiving a rotational force from the gear ring 60 which will be described hereinafter.

On the other hand, a cylindrical gear ring 60 is provided so as to cover the outer surface of the cylindrical portion 20*k*. The gear ring 60 is rotatable relative to the flange portion 21.

As shown in parts (a) and (b) of FIG. 47, the gear ring 60 includes a gear portion 60*a* for transmitting the rotational force to the bevel gear 61 which will be described hereinafter and a rotational engaging portion (recess) 60*b* for engaging with the rotation receiving portion 20*g* to rotate together with the cylindrical portion 20*k*. By the above-described engaging relation, the rotational engaging portion (recess) 60*b* is permitted to move relative to the rotation receiving portion 20*g* in the rotational axis direction, but it can rotate integrally in the rotational moving direction.

On the outer surface of the flange portion 21, the bevel 61 is provided so as to be rotatable relative to the flange portion 21. Furthermore, the bevel 61 and the engaging projection 20*h* are connected by a connecting portion 62.

A developer supplying step of the developer supply container 1 will be described.

When the cylindrical portion 20*k* rotates by the gear portion 20*a* of the developer accommodating portion 20 receiving the rotational force from the driving gear 300 of the developer replenishing apparatus 8, gear ring 60 rotates with the cylindrical portion 20*k* since the cylindrical portion 20*k* is in engagement with the gear ring 60 by the receiving portion 20*g*. That is, the rotation receiving portion 20*g* and the rotational engaging portion 60*b* function to transmit the rotational force inputted from the developer replenishing apparatus 8 to the gear portion 20*a* to the gear ring 60.

On the other hand, when the gear ring 60 rotates, the rotational force is transmitted to the bevel gear 61 from the gear portion 60*a* so that the bevel gear 61 rotates. The rotation of the bevel gear 61 is converted to reciprocating motion of the engaging projection 20*h* through the connecting portion 62, as shown in parts (a)-(d) of the FIG. 48. By this, the relaying portion 20*f* having the engaging projection 20*h* is reciprocated. As a result, the pump portion 20*b* expands and contracts in interrelation with the reciprocation of the relaying portion 20*f* to effect a pump operation.

In this manner, with the rotation of the cylindrical portion 20*k*, the developer is fed to the discharging portion 21*h* by the feeding portion 20*c*, and the developer in the discharging portion 21*h* is finally discharged through a discharge opening 21*a* by the suction and discharging operation of the pump portion 20*b*.

As described in the foregoing, also in this embodiment, one pump is enough to effect the suction operation and the discharging operation, and therefore, the structure of the developer discharging mechanism can be simplified. Furthermore, by the suction operation through the discharge opening, the decompressed state (negative pressure state) can be provided in the developer supply container, and therefore, the developer can be efficiently loosened.

Therefore, also in this example, similarly to Embodiments 5-9, by the rotational force received from the developer replenishing apparatus 8, both of the rotating operation of the cylindrical portion 20*k* (feeding portion 20*c*) and the reciprocation of the pump portion 20*b* can be effected.

In the case of the drive converting mechanism using the bevel gear, the number of the parts increases, and therefore, the structures of Embodiments 5-9 are preferable.

Embodiment 11

Referring to FIG. 49 (parts (a)-(c)), structures of the Embodiment 11 will be described. Part (a) of FIG. 49 is an enlarged perspective view of a drive converting mechanism, and (b)-(c) are enlarged views thereof as seen from the top. In this example, the same reference numerals as in the foregoing embodiments are assigned to the elements having the corresponding functions in this embodiment, and the detailed description thereof is omitted. In parts (b) and (c) of FIG. 49, a gear ring 60 and a rotational engaging portion 60*b* are schematically shown as being at the top for the convenience of illustration of the operation.

In this embodiment, the drive converting mechanism includes a magnet (magnetic field generating means) as is significantly different from Embodiments.

As shown in FIG. 49 (FIG. 48 if necessary), the bevel gear 61 is provided with a rectangular parallelepiped shape magnet, and an engaging projection 20*h* of a relaying portion 20*f* is provided with a bar-like magnet 64 having a magnetic pole directed to the magnet 63. The rectangular parallelepiped shape magnet 63 has an N pole at one longitudinal end thereof and an S pole as the other end, and the orientation thereof changes with the rotation of the bevel gear 61. The bar-like magnet 64 has an S pole at one longitudinal end adjacent an outside of the container and an N pole at the other end, and it is movable in the rotational axis direction. The magnet 64 is non-rotatable by an elongated guide groove formed in the outer peripheral surface of the flange portion 21.

With such a structure, when the magnet 63 is rotated by the rotation of the bevel gear 61, the magnetic pole facing the magnet and exchanges, and therefore, attraction and repelling between the magnet 63 and the magnet 64 are repeated alternately. As a result, a pump portion 20*b* fixed to the relaying portion 20*f* is reciprocated in the rotational axis direction.

As described in the foregoing, also in this embodiment, one pump is enough to effect the suction operation and the discharging operation, and therefore, the structure of the developer discharging mechanism can be simplified. Furthermore, by the suction operation through the discharge opening, the decompressed state (negative pressure state) can be provided in the developer supply container, and therefore, the developer can be efficiently loosened.

As described in the foregoing, similarly to Embodiments 5-10, the rotating operation of the feeding portion 20*c* (cylindrical portion 20*k*) and the reciprocation of the pump portion 20*b* are both effected by the rotational force received from the developer replenishing apparatus 8, in this embodiment.

In this example, the bevel gear 61 is provided with the magnet, but this is not inevitable, and another way of use of magnetic force (magnetic field) is applicable.

From the standpoint of certainty of the drive conversion, Embodiments 5-10 are preferable. In the case that the developer accommodated in the developer supply container 1 is a magnetic developer (one component magnetic toner, two component magnetic carrier), there is a liability that the developer is trapped in an inner wall portion of the container adjacent to the magnet. Then, an amount of the developer remaining in the developer supply container 1 may be large, and from this standpoint, the structures of Embodiments 5-10 are preferable.

Embodiment 12

Referring to parts (a)-(b) of FIG. 50 and parts (a)-(b) of FIG. 51, Embodiment 6 will be described. Part (a) of the FIG. 50 is a schematic view illustrating an inside of a developer supply container 1, (b) is a sectional view in a state that the pump portion 20*b* is expanded to the maximum in the developer supplying step, showing (c) is a sectional view of the developer supply container 1 in a state that the pump portion 20*b* is compressed to the maximum in the developer supplying step. Part (a) of FIG. 51 is a schematic view illustrating an inside of the developer supply container 1, and (b) is a perspective view of a rear end portion of the cylindrical portion 20*k*. In this example, the same reference numerals as in Embodiments are assigned to the elements having the corresponding functions in this embodiment, and the detailed description thereof is omitted.

This embodiment is significantly different from the structures of the above-described embodiments in that the pump portion 20*b* is provided at a leading end portion of the developer supply container 1 and in that the pump portion 20*b* does not have the functions of transmitting the rotational force received from the driving gear 300 to the cylindrical portion 20*k*. More particularly, the pump portion 20*b* is provided outside a drive conversion path of the drive converting mechanism, that is, outside a drive transmission path extending from the coupling portion 20*a* (part (b) of FIG. 51) received the rotational force from the driving gear 300 to the cam groove 20*n*.

This structure is employed in consideration of the fact that with the structure of Embodiment 5, after the rotational force inputted from the driving gear 300 is transmitted to the cylindrical portion 20*k* through the pump portion 20*b*, it is converted to the reciprocation force, and therefore, the pump portion 20*b* receives the rotational moving direction always in the developer supplying step operation. Therefore, there is a liability that in the developer supplying step the pump portion 20*b* is twisted in the rotational moving direction with the results of deterioration of the pump function. This will be described in detail.

As shown in part (a) of FIG. 50, an opening portion of one end portion (discharging portion 21*h* side) of the pump portion 20*b* is fixed to a flange portion 21 (welding method), and when the container is mounted to the developer replenishing apparatus 8, the pump portion 20*b* is substantially non-rotatable with the flange portion 21.

On the other hand, a cam flange portion 15 is provided covering the outer surface of the flange portion 21 and/or the cylindrical portion 20*k*, and the cam flange portion 15 functions as a drive converting mechanism. As shown in FIG. 50, the inner surface of the cam flange portion 15 is provided with two cam projections 15*a* at diametrically opposite positions, respectively. In addition, the cam flange portion 15 is fixed to the closed side (opposite the discharging portion 21*h* side) of the pump portion 20*b*.

On the other hand, the outer surface of the cylindrical portion 20*k* is provided with a cam groove 20*n* functioning as the drive converting mechanism, the cam groove 20*n* extending over the entire circumference, and the cam projection 15*a* is engaged with the cam groove 20*n*.

Furthermore, in this embodiment, as is different from Embodiment 5, as shown in part (b) of the FIG. 51, one end surface of the cylindrical portion 20*k* (upstream side with respect to the feeding direction of the developer) is provided with a non-circular (rectangular in this example) male coupling portion 20*a* functioning as the drive inputting portion. On the other hand, the developer replenishing apparatus 8 includes non-circular (rectangular) female coupling portion) for driving connection with the male coupling portion 20*a* to apply a rotational force. The female coupling portion, similarly to Embodiment 5, is driven by a driving motor 500.

In addition, the flange portion 21 is prevented, similarly to Embodiment 5, from moving in the rotational axis direction and in the rotational moving direction by the developer replenishing apparatus 8. On the other hand, the cylindrical portion 20*k* is connected with the flange portion 21 through a seal portion 27, and the cylindrical portion 20*k* is rotatable relative to the flange portion 21. The seal portion 27 is a sliding type seal which prevents incoming and outgoing leakage of air (developer) between the cylindrical portion 20*k* and the flange portion 21 within a range not influential to the developer supply using the pump portion 20*b* and which permits rotation of the cylindrical portion 20*k*.

The developer supplying step of the developer supply container 1 will be described.

The developer supply container 1 is mounted to the developer replenishing apparatus 8, and then the cylindrical portion 20*k* receptions the rotational force from the female coupling portion of the developer replenishing apparatus 8, by which the cam groove 20*n* rotates.

Therefore, the cam flange portion 15 reciprocates in the rotational axis direction relative to the flange portion 21 and the cylindrical portion 20*k* by the cam projection 15*a* engaged with the cam groove 20*n*, while the cylindrical portion 20*k* and the flange portion 21 are prevented from movement in the rotational axis direction by the developer replenishing apparatus 8.

Since the cam flange portion 15 and the pump portion 20*b* are fixed with each other, the pump portion 20*b* reciprocates with the cam flange portion 15 (ω direction and γ direction). As a result, as shown in parts (b) and (c) of FIG. 50, the pump portion 20*b* expands and contracts in interrelation with the reciprocation of the cam flange portion 15, thus effecting a pumping operation.

As described in the foregoing, also in this embodiment, one pump is enough to effect the suction operation and the discharging operation, and therefore, the structure of the developer discharging mechanism can be simplified. Furthermore, by the suction operation through the discharge opening, the decompressed state (negative pressure state) can be provided in the developer supply container, and therefore, the developer can be efficiently loosened.

In addition, also in this example, similar to the above-described Embodiments 5-11, the rotational force received from the developer replenishing apparatus 8 is converted a force operating the pump portion 20*b*, in the developer supply container 1, so that the pump portion 20*b* can be operated properly.

In addition, the rotational force received from the developer replenishing apparatus 8 is converted to the reciprocation force without using the pump portion 20*b*, by which the pump portion 20*b* is prevented from being damaged due to the torsion in the rotational moving direction. Therefore, it is unnecessary to increase the strength of the pump portion 20*b*, and the thickness of the pump portion 20*b* may be small, and the material thereof may be an inexpensive one.

Furthermore, in the structure of the this example, the pump portion 20*b* is not provided between the discharging portion 21*h* and the cylindrical portion 20*k* as in Embodiments 5-11, but is disposed at a position away from the cylindrical portion 20*k* of the discharging portion 21*h*, and therefore, the amount of the developer remaining in the developer supply container 1 can be reduced.

As shown in (a) of FIG. 51, it is a usable alternative that the internal space of the pump portion 20*b* is not uses as a developer accommodating space, and the filter 65 partitions between the pump portion 20*b* and the discharging portion 21*h*. Here, the filter has such a property that the air is easily passed, but the toner is not passed substantially.

With such a structure, when the pump portion 20*b* is compressed, the developer in the recessed portion of the bellow portion is not stressed. However, the structure of parts (a)-(c) of FIG. 50 is preferable from the standpoint that in the expanding stroke of the pump portion 20*b*, an additional developer accommodating space can be formed, that is, an additional space through which the developer can move is provided, so that the developer is easily loosened.

Embodiment 13

Referring to FIG. 52 (parts (a)-(c)), structures of the Embodiment 13 will be described. Parts (a)-(c) of FIG. 52 are enlarged sectional views of a developer supply container 1. In parts (a)-(c) of FIG. 52, the structures except for the pump are substantially the same as structures shown in FIGS. 50 and 51, and therefore, the detailed description there of is omitted.

In this example, the pump does not have the alternating peak folding portions and bottom folding portions, but it has a film-like pump 12 capable of expansion and contraction substantially without a folding portion, as shown in FIG. 52.

In this embodiment, the film-like pump 12 is made of rubber, but this is not inevitable, and flexible material such as resin film is usable.

With such a structure, when the cam flange portion 15 reciprocates in the rotational axis direction, the film-like pump 12 reciprocates together with the cam flange portion 15. As a result, as shown in parts (b) and (c) of FIG. 52, the film-like pump 12 expands and contracts interrelated with the reciprocation of the cam flange portion 15 in the directions of ω and γ, thus effecting a pumping operation.

As described in the foregoing, also in this embodiment, one pump is enough to effect the suction operation and the discharging operation, and therefore, the structure of the developer discharging mechanism can be simplified. Furthermore, by the suction operation through the discharge opening, the decompressed state (negative pressure state) can be provided in the developer supply container, and therefore, the developer can be efficiently loosened.

Also in this embodiment, similarly to Embodiments 5-12, the rotational force received from the developer replenishing apparatus 8 is converted to a force effective to operate the pump portion 12 in the developer supply container 1, and therefore, the pump portion 12 can be properly operated.

Embodiment 14

Referring to FIG. 53 (parts (a)-(e)), structures of the Embodiment 14 will be described. Part (a) of FIG. 53 is a schematic perspective view of the developer supply container 1, and (b) is an enlarged sectional view of the developer supply container 1, and (c)-(e) are schematic enlarged views of a drive converting mechanism. In this example, the same reference numerals as in the foregoing embodiments are assigned to the elements having the corresponding functions in this embodiment, and the detailed description thereof is omitted.

In this example, the pump portion is reciprocated in a direction perpendicular to a rotational axis direction, as is contrasted to the foregoing embodiments.

(Drive Converting Mechanism)

In this example, as shown in parts (a)-(e) of FIG. 53, at an upper portion of the flange portion 21, that is, the discharging portion 21*h*, a pump portion 21*f* of bellow type is connected. In addition, to a top end portion of the pump portion 21*f*, a cam projection 21*g* functioning as a drive converting portion is fixed by bonding. On the other hand, at one longitudinal end surface of the developer accommodating portion 20, a cam groove 20*e* engageable with a cam projection 21*g* is formed and it function as a drive converting portion.

As shown in part (b) of FIG. 53, the developer accommodating portion 20 is fixed so as to be rotatable relative to discharging portion 21*h* in the state that a discharging portion 21*h* side end compresses a sealing member 27 provided on an inner surface of the flange portion 21.

Also in this example, with the mounting operation of the developer supply container 1, both sides of the discharging portion 21*h* (opposite end surfaces with respect to a direction perpendicular to the rotational axis direction X) are supported by the developer replenishing apparatus 8. Therefore, during the developer supply operation, the discharging portion 21*h* is substantially non-rotatable.

In addition, with the mounting operation of the developer supply container 1, a projection 21*j* provided on the outer bottom surface portion of the discharging portion 21*h* is locked by a recess provided in a mounting portion 8*f*. Therefore, during the developer supply operation, the discharging portion 21*h* is fixed so as to be substantially non-rotatable in the rotational axis direction.

Here, the configuration of the cam groove 20*e* is elliptical configuration as shown in (c)-(e) of FIG. 53, and the cam projection 21*g* moving along the cam groove 20*e* changes in the distance from the rotational axis of the developer accommodating portion 20 (minimum distance in the diametrical direction).

As shown in (b) of FIG. 53, a plate-like partition wall 32 is provided and is effective to feed, to the discharging portion 21*h*, a developer fed by a helical projection (feeding portion) 20*c* from the cylindrical portion 20*k*. The partition wall 32 divides a part of the developer accommodating portion 20 substantially into two parts and is rotatable integrally with the developer accommodating portion 20. The partition wall 32 is provided with an inclined projection 32*a* slanted relative to the rotational axis direction of the developer supply container 1. The inclined projection 32*a* is connected with an inlet portion of the discharging portion 21*h*.

Therefore, the developer fed from the feeding portion 20*c* is scooped up by the partition wall 32 in interrelation with the rotation of the cylindrical portion 20*k*. Thereafter, with a further rotation of the cylindrical portion 20*k*, the developer slide down on the surface of the partition wall 32 by the gravity, and is fed to the discharging portion 21*h* side by the inclined projection 32*a*. The inclined projection 32*a* is provided on each of the sides of the partition wall 32 so that the developer is fed into the discharging portion 21*h* every one half rotation of the cylindrical portion 20*k*.

(Developer Supplying Step)

The description will be made as to developer supplying step from the developer supply container 1 in this example.

When the operator mounts the developer supply container 1 to the developer replenishing apparatus 8, the flange portion 21 (discharging portion 21*h*) is prevented from movement in the rotational moving direction and in the rotational axis direction by the developer replenishing apparatus 8. In addition, the pump portion 21*f* and the cam projection 21*g* are fixed to the flange portion 21, and are prevented from movement in the rotational moving direction and in the rotational axis direction, similarly.

And, by the rotational force inputted from a driving gear 300 (FIGS. 32 and 33) to a gear portion 20*a*, the developer accommodating portion 20 rotates, and therefore, the cam groove 20*e* also rotates. On the other hand, the cam projection 21*g* which is fixed so as to be non-rotatable receives the force through the cam groove 20*e*, so that the rotational force inputted to the gear portion 20*a* is converted to a force reciprocating the pump portion 21*f* substantially vertically.

Here, part (d) of FIG. 53 illustrates a state in which the pump portion 21*f* is most expanded, that is, the cam projection 21*g* is at the intersection between the ellipse of the cam groove 20*e* and the major axis La (point Y in (c) of FIG. 53). Part (e) of FIG. 53 illustrates a state in which the pump portion 21*f* is most contracted, that is, the cam projection 21*g* is at the intersection between the ellipse of the cam groove 20*e* and the minor axis La (point Z in (c) of FIG. 53).

The state of (d) of FIG. 53 and the state of (e) of FIG. 53 are repeated alternately at predetermined cyclic period so that the pump portion 21*f* effects the suction and discharging operation. That is the developer is discharged smoothly.

With such rotation of the cylindrical portion 20*k*, the developer is fed to the discharging portion 21*h* by the feeding portion 20*c* and the inclined projection 32*a*, and the developer in the discharging portion 21*h* is finally discharged through the discharge opening 21*a* by the suction and discharging operation of the pump portion 21*f*.

As described in the foregoing, also in this embodiment, one pump is enough to effect the suction operation and the discharging operation, and therefore, the structure of the developer discharging mechanism can be simplified. Furthermore, by the suction operation through the discharge opening, the decompressed state (negative pressure state) can be provided in the developer supply container, and therefore, the developer can be efficiently loosened.

In addition, also in this example, similarly to Embodiments 5-13, by the gear portion 20*a* receiving the rotational force from the developer replenishing apparatus 8, both of the rotating operation of the feeding portion 20*c* (cylindrical portion 20*k*) and the reciprocation of the pump portion 21*f* can be effected.

Since, in this example, the pump portion 21*f* is provided at a top of the discharging portion 21*h* (in the state that the developer supply container 1 is mounted to the developer replenishing apparatus 8), the amount of the developer unavoidably remaining in the pump portion 21*f* can be minimized as compared with Embodiment 5.

In this example, the pump portion 21*f* is a bellow-like pump, but it may be replaced with a film-like pump described in Embodiment 13.

In this example, the cam projection 21*g* as the drive transmitting portion is fixed by an adhesive material to the upper surface of the pump portion 21*f*, but the cam projection 21*g* is not necessarily fixed to the pump portion 21*f*. For example, a known snap hook engagement is usable, or a round rod-like cam projection 21*g* and a pump portion 21*f* having a hole engageable with the cam projection 21*g* may be used in combination. With such a structure, the similar advantageous effects can be provided.

Embodiment 15

Referring to FIGS. 54-56, the description will be made as to structures of Embodiment 11. Part of (a) of FIG. 54 is a schematic perspective view of a developer supply container 1, (b) is a schematic perspective view of a flange portion 21, (c) is a schematic perspective view of a cylindrical portion 20*k*, part (a)-(b) of FIG. 55 are enlarged sectional views of the developer supply container 1, and FIG. 56 is a schematic view of a pump portion 21*f*. In this example, the same reference numerals as in the foregoing embodiments are assigned to the elements having the corresponding functions in this embodiment, and the detailed description thereof is omitted.

In this example, a rotational force is converted to a force for forward operation of the pump portion 21*f* without converting the rotational force to a force for backward operation of the pump portion, as is contrasted to the foregoing embodiments.

In this example, as shown in FIGS. 54-56, a bellow type pump portion 21*f* is provided at a side of the flange portion 21 adjacent the cylindrical portion 20*k*. An outer surface of the cylindrical portion 20*k* is provided with a gear portion 20*a* which extends on the full circumference. At an end of the cylindrical portion 20*k* adjacent a discharging portion 21*h*, two compressing projections 21 for compressing the pump portion 21*f* by abutting to the pump portion 21*f* by the rotation of the cylindrical portion 20*k* are provided at diametrically opposite positions, respectively. A configuration of the compressing projection 20*l* at a downstream side with respect to the rotational moving direction is slanted to gradually compress the pump portion 21*f* so as to reduce the impact upon abutment to the pump portion 21*f* On the other hand, a configuration of the compressing projection 20*l* at the upstream side with respect to the rotational moving direction is a surface perpendicular to the end surface of the cylindrical portion 20*k* to be substantially parallel with the rotational axis direction of the cylindrical portion 20*k* so that the pump portion 21*f* instantaneously expands by the restoring elastic force thereof.

Similarly to Embodiment 10, the inside of the cylindrical portion 20*k* is provided with a plate-like partition wall 32 for feeding the developer fed by a helical projection 20*c* to the discharging portion 21*h*.

The description will be made as to developer supplying step from the developer supply container 1 in this example.

After the developer supply container 1 is mounted to the developer replenishing apparatus 8, cylindrical portion 20*k* which is the developer accommodating portion 20 rotates by the rotational force inputted from the driving gear 300 to the gear portion 20*a*, so that the compressing projection 21 rotates. At this time, when the compressing projections 21 abut to the pump portion 21*f*, the pump portion 21*f* is compressed in the direction of an arrow γ, as shown in part (a) of FIG. 55, so that a discharging operation is effected.

On the other hand, when the rotation of the cylindrical portion 20*k* continues until the pump portion 21*f* is released from the compressing projection 21, the pump portion 21*f* expands in the direction of an arrow w by the self-restoring force, as shown in part (b) of FIG. 55, so that it restores to the original shape, by which the suction operation is effected.

The states shown in (a) and (b) of FIG. 55 are alternately repeated, by which the pump portion 21*f* effects the suction and discharging operations. That is, the developer is discharged smoothly.

With the rotation of the cylindrical portion 20*k* in this manner, the developer is fed to the discharging portion 21*h* by the helical projection (feeding portion) 20*c* and the inclined projection (feeding portion) 32*a* (FIG. 53). The developer in the discharging portion 21*h* is finally discharged through the discharge opening 21*a* by the discharging operation of the pump portion 21*f*.

As described in the foregoing, also in this embodiment, one pump is enough to effect the suction operation and the discharging operation, and therefore, the structure of the developer discharging mechanism can be simplified. Furthermore, by the suction operation through the discharge opening, the decompressed state (negative pressure state) can be provided in the developer supply container, and therefore, the developer can be efficiently loosened.

In addition, in this example, similarly to Embodiments 5-14, the rotational force received from the developer replenishing apparatus 8, both of the rotating operation of developer supply container 1 and the reciprocation of the pump portion 21*f* can be effected.

In this example, the pump portion 21*f* is compressed by the contact to the compressing projection 20*l*, and expands by the self-restoring force of the pump portion 21*f* when it is released from the compressing projection 2*l*, but the structure may be opposite.

More particularly, when the pump portion 21*f* is contacted by the compressing projection 2*l*, they are locked, and with the rotation of the cylindrical portion 20*k*, the pump portion 21*f* is forcedly expanded. With further rotation of the cylindrical portion 20*k*, the pump portion 21*f* is released, by which the pump portion 21*f* restores to the original shape by the self-restoring force (restoring elastic force). Thus, the suction operation and the discharging operation are alternately repeated.

In the case of this example, the self restoring power of the pump 21*f* is likely to be deteriorated by repetition of the expansion and contraction of the pump portion 21*f* for a long term, and from this standpoint, the structures of Embodiments 5-14 are preferable. Or, by employing the structure of FIG. 56, the likelihood can be avoided. As shown in FIG. 56, compression plate 20*q* is fixed to an end surface of the pump portion 21*f* adjacent the cylindrical portion 20*k*. Between the outer surface of the flange portion 21 and the compression plate 20*q*, a spring 20*r* functioning as a urging member is provided covering the pump portion 21*f*. With such a structure, the self restoration of the pump portion 21*f* at the time when the contact between the compression projection 20*l* and the pump position is released can be assisted, the suction operation can be carried out assuredly even when the expansion and contraction of the pump portion 21*f* is repeated for a long term.

In this example, two compressing projections 20*l* functioning as the drive converting mechanism are provided at the diametrically opposite positions, but this is not inevitable, and the number thereof may be one or three, for example. In addition, in place of one compressing projection, the following structure may be employed as the drive converting mechanism. For example, the configuration of the end surface opposing the pump portion 21*f* of the cylindrical portion 20*k* is not a perpendicular surface relative to the rotational axis of the cylindrical portion 20*k* as in this example, but is a surface inclined relative to the rotational axis. In this case, the inclined surface acts on the pump portion to be equivalent to the compressing projection. In another alternative, a shaft portion is extended from a rotation axis at the end surface of the cylindrical portion 20*k* opposed to the pump portion 21*f* toward the pump portion 21*f* in the rotational axis direction, and a swash plate (disk) inclined relative to the rotational axis of the shaft portion is provided. In this case, the swash plate acts on the pump portion 21*f*, and therefore, it is equivalent to the compressing projection.

Embodiment 16

Referring to FIG. 57 (parts (a) and (b)), structures of the Embodiment 16 will be described. Parts (a) and (b) of FIG. 57 are sectional views schematically illustrating a developer supply container 1.

In this example, the pump portion 21*f* is provided at the cylindrical portion 20*k*, and the pump portion 21*f* rotates together with the cylindrical portion 20*k*. In addition, in this example, the pump portion 21*f* is provided with a weight 20*v*, by which the pump portion 21*f* reciprocates with the rotation. The other structures of this example are similar to those of Embodiment 14 (FIG. 53), and the detailed description thereof is omitted by assigning the same reference numerals to the corresponding elements.

As shown in part (a) of FIG. 57, the cylindrical portion 20*k*, the flange portion 21 and the pump portion 21*f* function as a developer accommodating space of the developer supply container 1. The pump portion 21*f* is connected to an outer periphery portion of the cylindrical portion 20*k*, and the action of the pump portion 21*f* works to the cylindrical portion 20*k* and the discharging portion 21*h*.

A drive converting mechanism of this example will be described.

One end surface of the cylindrical portion 20*k* with respect to the rotational axis direction is provided with coupling portion (rectangular configuration projection) 20*a* functioning as a drive inputting portion, and the coupling portion 20*a* receives a rotational force from the developer replenishing apparatus 8. On the top of one end of the pump portion 21*f* with respect to the reciprocation direction, the weight 20*v* is fixed. In this example, the weight 20*v* functions as the drive converting mechanism.

Thus, with the integral rotation of the cylindrical portion 20*k* and the pump 21*f*, the pump portion 21*f* expands and contract in the up and down directions by the gravitation to the weight 20*v*.

More particularly, in the state of part (a) of FIG. 57, the weight takes a position upper than the pump portion 21*f*, and the pump portion 21*f* is contracted by the weight 20*v* in the direction of the gravitation (white arrow). At this time, the developer is discharged through the discharge opening 21*a* (black arrow).

On the other hand, in the state of part of FIG. 57, weight takes a position lower than the pump portion 21*f*, and the pump portion 21*f* is expanded by the weight 20*v* in the direction of the gravitation (white arrow). At this time, the suction operation is effected through the discharge opening 21*a* (black arrow), by which the developer is loosened.

As described in the foregoing, also in this embodiment, one pump is enough to effect the suction operation and the discharging operation, and therefore, the structure of the developer discharging mechanism can be simplified. Furthermore, by the suction operation through the discharge opening, the decompressed state (negative pressure state) can be provided in the developer supply container, and therefore, the developer can be efficiently loosened.

Thus, in this example, similarly to Embodiments 5-15, the rotational force received from the developer replenishing apparatus 8, both of the rotating operation of developer supply container 1 and the reciprocation of the pump portion 21*f* can be effected.

In the case of this example, the pump portion 21*f* rotates about the cylindrical portion 20*k*, and therefore, the space of the mounting portion 8*f* of developer replenishing apparatus 8 is large, with the result of upsizing of the device, and from this standpoint, the structures of Embodiment 5-15 are preferable.

Embodiment 17

Referring to FIGS. 58-60, the description will be made as to structures of Embodiment 17. Part (a) of FIG. 58 is a perspective view of a cylindrical portion 20*k*, and (b) is a perspective view of a flange portion 21. Parts (a) and (b) of FIG. 59 are partially sectional perspective views of a developer supply container 1, and (a) shows a state in which a rotatable shutter is open, and (b) shows a state in which the rotatable shutter is closed. FIG. 60 is a timing chart illustrating a relation between operation timing of the pump 21*f* and timing of opening and closing of the rotatable shutter. In FIG. 60, contraction is a discharging step of the pump portion 21*f*, expansion is a suction step of the pump portion 21*f*.

In this example, a mechanism for separating between a discharging chamber 21*h* and the cylindrical portion 20*k* during the expanding-and-contracting operation of the pump portion 21*f* is provided, as is contrasted to the foregoing embodiments. In this example, the separation is provided between the cylindrical portion 20*k* and the discharging portion 21*h* so that the pressure variation is produced selectively in the discharging portion 21*h* when the volume of the pump portion 21*f* of the cylindrical portion 20*k* and the discharging portion 21*h* changes. The inside of the discharging portion 21*h* functions as a developer accommodating portion for receiving the developer fed from the cylindrical portion 20*k* as will be described hereinafter. The structures of this example in the other respects are substantially the same as those of Embodiment 14 (FIG. 53), and the description thereof is omitted by assigning the same reference numerals to the corresponding elements.

As shown in part (a) of FIG. 58, one longitudinal end surface of the cylindrical portion 20*k* functions as a rotatable shutter. More particularly, said one longitudinal end surface of the cylindrical portion 20*k* is provided with a communication opening 20*u* for discharging the developer to the flange portion 21, and is provided with a closing portion 20*h*. The communication opening 20*u* has a sector-shape.

On the other hand, as shown in part (b) of FIG. 58, the flange portion 21 is provided with a communication opening 21*k* for receiving the developer from the cylindrical portion 20*k*. The communication opening 21*k* has a sector-shape configuration similar to the communication opening 20*u*, and the portion other than that is closed to provide a closing portion 21*m*.

Parts (a)-(b) of FIG. 59 illustrate a state in which the cylindrical portion 20*k* shown in part (a) of FIG. 58 and the flange portion 21 shown in part (b) of FIG. 58 have been assembled. The communication opening 20*u* and the outer surface of the communication opening 21*k* are connected with each other so as to compress the sealing member 27, and the cylindrical portion 20*k* is rotatable relative to the stationary flange portion 21.

With such a structure, when the cylindrical portion 20*k* is rotated relatively by the rotational force received by the gear portion 20*a*, the relation between the cylindrical portion 20*k* and the flange portion 21 are alternately switched between the communication state and the non-passage continuing state.

That is, rotation of the cylindrical portion 20*k*, the communication opening 20*u* of the cylindrical portion 20*k* becomes aligned with the communication opening 21*k* of the flange portion 21 (part (a) of FIG. 59). With a further rotation of the cylindrical portion 20*k*, the communication opening 20*u* of the cylindrical portion 20*k* becomes out of alignment with the communication opening 21*k* of the flange portion 21 so that the situation is switched to a non-communication state (part (b) of FIG. 59) in which the flange portion 21 is separated to substantially seal the flange portion 21.

Such a partitioning mechanism (rotatable shutter) for isolating the discharging portion 21*h* at least in the expanding-and-contracting operation of the pump portion 21*f* is provided for the following reasons.

The discharging of the developer from the developer supply container 1 is effected by making the internal pressure of the developer supply container 1 higher than the ambient pressure by contracting the pump portion 21*f*. Therefore, if the partitioning mechanism is not provided as in foregoing Embodiments 5-15, the space of which the internal pressure is changed is not limited to the inside space of the flange portion 21 but includes the inside space of the cylindrical portion 20*k*, and therefore, the amount of volume change of the pump portion 21*f* has to be made eager.

This is because a ratio of a volume of the inside space of the developer supply container 1 immediately after the pump portion 21*f* is contracted to its end to the volume of the inside space of the developer supply container 1 immediately before the pump portion 21*f* starts the contraction is influenced by the internal pressure.

However, when the partitioning mechanism is provided, there is no movement of the air from the flange portion 21 to the cylindrical portion 20*k*, and therefore, it is enough to change the pressure of the inside space of the flange portion 21. That is, under the condition of the same internal pressure value, the amount of the volume change of the pump portion 21*f* may be smaller when the original volume of the inside space is smaller.

In this example, more specifically, the volume of the discharging portion 21*h* separated by the rotatable shutter is 40 $cm^3$, and the volume change of the pump portion 21*f* (reciprocation movement distance) is 2 $cm^3$ (it is 15 $cm^3$ in Embodiment 5). Even with such a small volume change, developer supply by a sufficient suction and discharging effect can be effected, similarly to Embodiment 5.

As described in the foregoing, in this example, as compared with the structures of Embodiments 5-16, the volume change amount of the pump portion 21*f* can be minimized. As a result, the pump portion 21*f* can be downsized. In addition, the distance through which the pump portion 21*f* is reciprocated (volume change amount) can be made smaller. The provision of such a partitioning mechanism is effective particularly in the case that the capacity of the cylindrical portion 20*k* is large in order to make the filled amount of the developer in the developer supply container 1 is large.

Developer supplying steps in this example will be described.

In the state that developer supply container 1 is mounted to the developer replenishing apparatus 8 and the flange portion 21 is fixed, drive is inputted to the gear portion 20*a* from the driving gear 300, by which the cylindrical portion 20*k* rotates, and the cam groove 20*e* rotates. On the other hand, the cam projection 21*g* fixed to the pump portion 21*f* non-rotatably supported by the developer replenishing apparatus 8 with the flange portion 21 is moved by the cam groove 20*e*. Therefore, with the rotation of the cylindrical portion 20*k*, the pump portion 21*f* reciprocates in the up and down directions.

Referring to FIG. 60, the description will be made as to the timing of the pumping operation (suction operation and discharging operation of the pump portion 21*f* and the timing of opening and closing of the rotatable shutter, in such a structure. FIG. 60 is a timing chart when the cylindrical portion 20*k* rotates one full turn. In FIG. 60, contraction means the contracting operation of the pump portion (discharging operation of the pump portion), expansion means the expanding operation of the pump portion (suction operation by the pump portion), and rest means non-operation of the pump portion. In addition, opening means the opening state of the rotatable shutter, and close means the closing state of the rotatable shutter.

As shown in FIG. 60, when the communication opening 21*k* and the communication opening 20*u* are aligned with each other, the drive converting mechanism converts the rotational force inputted to the gear portion 20*a* so that the pumping operation of the pump portion 21*f* stops. More specifically, in this example, the structure is such that when the communication opening 21*k* and the communication opening 20*u* are aligned with each other, a radius distance from the rotation axis of the cylindrical portion 20*k* to the cam groove 20*e* is constant so that the pump portion 21*f* does not operate even when the cylindrical portion 20*k* rotates.

At this time, the rotatable shutter is in the opening position, and therefore, the developer is fed from the cylindrical portion 20*k* to the flange portion 21. More particularly, with the rotation of the cylindrical portion 20*k*, the developer is scooped up by the partition wall 32, and thereafter, it slides down on the inclined projection 32*a* by the gravity, so that the developer moves via the communication opening 20*u* and the communication opening 21*k* to the flange 3.

As shown in FIG. 60, when the non-communication state in which the communication opening 21*k* and the communication opening 20*u* are out of alignment is established, the drive converting mechanism converts the rotational force inputted to the gear portion 20*b* so that the pumping operation of the pump portion 21*f* is effected.

That is, with further rotation of the cylindrical portion 20*k*, the rotational phase relation between the communication opening 21*k* and the communication opening 20*u* changes so that the communication opening 21*k* is closed by the stop portion 20*h* with the result that the inside space of the flange 3 is isolated (non-communication state).

At this time, with the rotation of the cylindrical portion 20*k*, the pump portion 21*f* is reciprocated in the state that the non-communication state is maintained the rotatable shutter is in the closing position). More particularly, by the rotation of the cylindrical portion 20*k*, the cam groove 20*e* rotates, and the radius distance from the rotation axis of the cylindrical portion 20*k* to the cam groove 20*e* changes. By this, the pump portion 21*f* effects the pumping operation through the cam function.

Thereafter, with further rotation of the cylindrical portion 20*k*, the rotational phases are aligned again between the communication opening 21*k* and the communication opening 20*u*, so that the communicated state is established in the flange portion 21.

The developer supplying step from the developer supply container 1 is carried out while repeating these operations.

As described in the foregoing, also in this embodiment, one pump is enough to effect the suction operation and the discharging operation, and therefore, the structure of the developer discharging mechanism can be simplified. Furthermore, by the suction operation through the discharge opening 21*a*, the decompressed state (negative pressure state) can be provided in the developer supply container, and therefore, the developer can be efficiently loosened.

In addition, also in this example, by the gear portion 20*a* receiving the rotational force from the developer replenishing apparatus 8, both of the rotating operation of the cylindrical portion 20*k* and the suction and discharging operation of the pump portion 21*f* can be effected.

Further, according to the structure of the this example, the pump portion 21*f* can be downsized. Furthermore, the volume change amount (reciprocation movement distance) can be reduced, and as a result, the load required to reciprocate the pump portion 21*f* can be reduced.

Moreover, in this example, no additional structure is used to receive the driving force for rotating the rotatable shutter from the developer replenishing apparatus 8, but the rotational force received for the feeding portion (cylindrical portion 20*k*, helical projection 20*c*) is used, and therefore, the partitioning mechanism is simplified.

As described above, the volume change amount of the pump portion 21*f* does not depend on the all volume of the developer supply container 1 including the cylindrical portion 20*k*, but it is selectable by the inside volume of the flange portion 21. Therefore, for example, in the case that the capacity (the diameter of the cylindrical portion 20*k* is changed when manufacturing developer supply containers having different developer filling capacity, a cost reduction effect can be expected. That is, the flange portion 21 including the pump portion 21*f* may be used as a common unit, which is assembled with different kinds of cylindrical portions 2*k*. By doing so, there is no need of increasing the number of kinds of the metal molds, thus reducing the manufacturing cost. In addition, in this example, during the non-communication state between the cylindrical portion 20*k* and the flange portion 21, the pump portion 21*f* is reciprocated by one cyclic period, but similarly to Embodiment 5, the pump portion 21*f* may be reciprocated by a plurality of cyclic periods.

Furthermore, in this example, throughout the contracting operation and the expanding operation of the pump portion, the discharging portion 21*h* is isolated, but this is not inevitable, and the following in an alternative. If the pump portion 21*f* can be downsized, and the volume change amount (reciprocation movement distance) of the pump portion 21*f* can be reduced, the discharging portion 21*h* may be opened slightly during the contracting operation and the expanding operation of the pump portion.

Embodiment 18

Referring to FIGS. 61-63, the description will be made as to structures of Embodiment 18. FIG. 61 is a partly sectional perspective view of a developer supply container 1. Parts (a)-(c) of FIG. 62 are a partial section illustrating an operation of a partitioning mechanism (stop valve 35). FIG. 63 is a timing chart showing timing of a pumping operation (contracting operation and expanding operation) of the pump portion 20*b* and opening and closing timing of the stop valve which will be described hereinafter. In FIG. 63, contraction means contracting operation of the pump portion 20*b* the discharging operation of the pump portion 20*b*), expansion means the expanding operation of the pump portion 20*b* (suction operation of the pump portion 20*b*). In addition, stop means a rest state of the pump portion 20*b*. In addition, opening means an open state of the stop valve 35 and close means a state in which the stop valve 35 is closed.

This example is significantly different from the above-described embodiments in that the stop valve 35 is employed as a mechanism for separating between a discharging portion 21*h* and a cylindrical portion 20*k* in an expansion and contraction stroke of the pump portion 20*b*. The structures of this example in the other respects are substantially the same as those of Embodiment 12 (FIGS. 50 and 51), and the description thereof is omitted by assigning the same reference numerals to the corresponding elements. In this example, in the structure of the Embodiment 12 shown in FIG. 50, a plate-like partition wall 32 shown in FIG. 53 of Embodiment 14 is provided.

In the above-described Embodiment 17, a partitioning mechanism (rotatable shutter) using a rotation of the cylindrical portion 20*k* is employed, but in this example, a partitioning mechanism (stop valve) using reciprocation of the pump portion 20*b* is employed. The description will be made in detail.

As shown in FIG. 61, a discharging portion 21*h* is provided between the cylindrical portion 20*k* and the pump portion 20*b*. A wall portion 33 is provided at a cylindrical portion 20*k* side of the discharging portion 21*h*, and a discharge opening 21*a* is provided lower at a left part of the wall portion 33 in the Figure. A stop valve 35 and an elastic member (seal) 34 as a partitioning mechanism for opening and closing a communication port 33*a* (FIG. 62) formed in the wall portion 33 are provided. The stop valve 35 is fixed to one internal end of the pump portion 20*b* (opposite the discharging portion 21*h*), and reciprocates in a rotational axis direction of the developer supply container 1 with expanding-and-contracting operations of the pump portion 20*b*. The seal 34 is fixed to the stop valve 35, and moves with the movement of the stop valve 35.

Referring to parts (a)-(c) of the FIG. 62 (FIG. 63 if necessary), operations of the stop valve 35 in a developer supplying step will be described.

FIG. 62 illustrates in (a) a maximum expanded state of the pump portion 20*b* in which the stop valve 35 is spaced from the wall portion 33 provided between the discharging portion 21*h* and the cylindrical portion 20*k*. At this time, the developer in the cylindrical portion 20*k* is fed into the discharging portion 21*h* through the communication port 33*a* by the inclined projection 32*a* with the rotation of the cylindrical portion 20*k*.

Thereafter, when the pump portion 20*b* contracts, the state becomes as shown in (b) of the FIG. 62. At this time, the seal 34 is contacted to the wall portion 33 to close the communication port 33*a*. That is, the discharging portion 21*h* becomes isolated from the cylindrical portion 20*k*.

When the pump portion 20*b* contracts further, the pump portion 20*b* becomes most contracted as shown in part (c) of FIG. 62.

During period from the state shown in part (b) of FIG. 62 to the state shown in part (c) of FIG. 62, the seal 34 remains contacting to the wall portion 33, and therefore, the discharging portion 21*h* is pressurized to be higher than the ambient pressure (positive pressure) so that the developer is discharged through the discharge opening 21*a*.

Thereafter, during expanding operation of the pump portion 20*b* from the state shown in (c) of FIG. 62 to the state shown in (b) of FIG. 62, the seal 34 remains contacting to the wall portion 33, and therefore, the internal pressure of the discharging portion 21*h* is reduced to be lower than the ambient pressure (negative pressure). Thus, the suction operation is effected through the discharge opening 21*a*.

When the pump portion 20*b* further expands, it returns to the state shown in part (a) of FIG. 62. In this example, the foregoing operations are repeated to carry out the developer supplying step. In this manner, in this example, the stop valve 35 is moved using the reciprocation of the pump portion, and therefore, the stop valve is opening during an initial stage of the contracting operation (discharging operation) of the pump portion 20*b* and in the final stage of the expanding operation (suction operation) thereof.

The seal 34 will be described in detail. The seal 34 is contacted to the wall portion 33 to assure the sealing property of the discharging portion 21*h*, and is compressed with the contracting operation of the pump portion 20*b*, and therefore, it is preferable to have both of sealing property and flexibility. In this example, as a sealing material having such properties, the use is made with polyurethane foam the available from Kabushiki Kaisha INOAC Corporation, Japan (tradename is MOLTOPREN, SM-55 having a thickness of 5 mm). The thickness of the sealing material in the maximum contraction state of the pump portion 20*b* is 2 mm the compression amount of 3 mm).

As described in the foregoing, the volume variation (pump function) for the discharging portion 21*h* by the pump portion 20*b* is substantially limited to the duration after the seal 34 is contacted to the wall portion 33 until it is compressed to 3 mm, but the pump portion 20*b* works in the range limited by the stop valve 35. Therefore, even when such a stop valve 35 is used, the developer can be stably discharged.

As described in the foregoing, also in this embodiment, one pump is enough to effect the suction operation and the discharging operation, and therefore, the structure of the developer discharging mechanism can be simplified. Furthermore, by the suction operation through the discharge opening 21*a*, the decompressed state (negative pressure state) can be provided in the developer supply container, and therefore, the developer can be efficiently loosened.

In this manner, in this example, similarly to Embodiments 5-17, by the gear portion 20*a* receiving the rotational force from the developer replenishing apparatus 8, both of the rotating operation of the cylindrical portion 20*k* and the suction and discharging operation of the pump portion 20*b* can be effected.

Furthermore, similarly to Embodiment 17, the pump portion 20*b* can be downsized, and the volume change volume of the pump portion 20*b* can be reduced. The cost reduction advantage by the common structure of the pump portion can be expected.

In addition, in this embodiment, no additional structure is used to receive the driving force for operating the stop valve 35 from the developer replenishing apparatus 8 is used, but the use is made with the reciprocation force of the pump portion 20*b*, and therefore, the partitioning mechanism can be simplified.

Embodiment 19

Referring to parts (a)-(c) of FIG. 64, the structures of Embodiment 19 will be described. Part (a) of FIG. 64 is a partially sectional perspective view of the developer supply container 1, and (b) is a perspective view of the flange portion 21, and (c) is a sectional view of the developer supply container.

This example is significantly different from the foregoing embodiments in that a buffer portion 23 is provided as a mechanism separating between discharging chamber 21*h* and the cylindrical portion 20*k*. In the other respects, the structures are substantially the same as those of Embodiment 14 (FIG. 53), and therefore, the detailed description is omitted by assigning the same reference numerals to the corresponding elements.

As shown in part (b) of FIG. 64, a buffer portion 23 is fixed to the flange portion 21 non-rotatably. The buffer portion 23 is provided with a receiving port 23*a* which opens upward and a supply port 23*b* which is in fluid communication with a discharging portion 21*h*.

As shown in part (a) and (c) of FIG. 64, such a flange portion 21 is mounted to the cylindrical portion 20*k* such that the buffer portion 23 is in the cylindrical portion 20*k*. The cylindrical portion 20*k* is connected to the flange portion 21 rotatably relative to the flange portion 21 immovably supported by the developer replenishing apparatus 8. The connecting portion is provided with a ring seal to prevent leakage of air or developer.

In addition, in this example, as shown in part (a) of FIG. 64, an inclined projection 32*a* is provided on the partition wall 32 to feed the developer toward the receiving port 23*a* of the buffer portion 23.

In this example, until the developer supplying operation of the developer supply container 1 is completed, the developer in the developer accommodating portion 20 is fed through the opening 23*a* into the buffer portion 23 by the partition wall 32 and the inclined projection 32*a* with the rotation of the developer supply container 1

Therefore, as shown in part (c) of FIG. 64, the inside space of the buffer portion 23 is maintained full of the developer.

As a result, the developer filling the inside space of the buffer portion 23 substantially blocks the movement of the air toward the discharging portion 21*h* from the cylindrical portion 20*k*, so that the buffer portion 23 functions as a partitioning mechanism.

Therefore, when the pump portion 21*f* reciprocates, at least the discharging portion 21*h* can be isolated from the cylindrical portion 20*k*, and for this reason, the pump portion can be downsized, and the volume change of the pump portion can be reduced.

As described in the foregoing, also in this embodiment, one pump is enough to effect the suction operation and the discharging operation, and therefore, the structure of the developer discharging mechanism can be simplified. Furthermore, by the suction operation through the discharge opening 21*a*, the decompressed state (negative pressure state) can be provided in the developer supply container, and therefore, the developer can be efficiently loosened.

In this manner, in this example, similarly to Embodiments 17-18, by the rotational force received from the developer replenishing apparatus 8, both of the rotating operation of the feeding portion 20*c* (cylindrical portion 20*k*) and the reciprocation of the pump portion 21*f* can be effected.

Furthermore, similarly to Embodiments 17-18, the pump portion can be downsized, and the volume change amount of the pump portion can be reduced. Also, the pump portion can be made common, by which the cost reduction advantage is provided.

Moreover, in this example, the developer is used as the partitioning mechanism, and therefore, the partitioning mechanism can be simplified.

Embodiment 20

Referring to FIGS. 65-66, the structures of Embodiment 20 will be described. Part (a) of FIG. 65 is a perspective view of a developer supply container 1, and (b) is a sectional view of the developer supply container 1, and FIG. 66 is a sectional perspective view of a nozzle portion 47.

In this example, the nozzle portion 47 is connected to the pump portion 20*b*, and the developer once sucked in the nozzle portion 47 is discharged through the discharge opening 21*a*, as is contrasted to the foregoing embodiments. In the other respects, the structures are substantially the same as in Embodiment 14, and the detailed description thereof is omitted by assigning the same reference numerals to the corresponding elements.

As shown in part (a) of FIG. 65, the developer supply container 1 comprises a flange portion 21 and a developer accommodating portion 20. The developer accommodating portion 20 comprises a cylindrical portion 20*k*.

In the cylindrical portion 20*k*, as shown in (b) of FIG. 65, a partition wall 32 functioning as a feeding portion extends over the entire area in the rotational axis direction. One end surface of the partition wall 32 is provided with a plurality of inclined projections 32*a* at different positions in the rotational axis direction, and the developer is fed from one end with respect to the rotational axis direction to the other end (the side adjacent the flange portion 21). The inclined projections 32*a* are provided on the other end surface of the partition wall 32 similarly. In addition, between the adjacent inclined projections 32*a*, a through-opening 32*b* for permitting passing of the developer is provided. The through-opening 32*b* functions to stir the developer. The structure of the feeding portion may be a combination of the helical projection 20*c* in the cylindrical portion 20*k* and a partition wall 32 for feeding the developer to the flange portion 21, as in the foregoing embodiments.

The flange portion 21 including the pump portion 20*b* will be described.

The flange portion 21 is connected to the cylindrical portion 20*k* rotatably through a small diameter portion 49 and a sealing member 48. In the state that the container is mounted to the developer replenishing apparatus 8, the flange portion 21 is immovably held by the developer replenishing apparatus 8 (rotating operation and reciprocation is not permitted).

In addition, as shown in FIG. 66, in the flange portion 21, there is provided a supply amount adjusting portion (flow rate adjusting portion) 52 which receives the developer fed from the cylindrical portion 20*k*. In the supply amount adjusting portion 52, there is provided a nozzle portion 47 which extends from the pump portion 20*b* toward the discharge opening 21*a*. Therefore, with the volume change of the pump 20*b*, the nozzle portion 47 sucks the developer in the supply amount adjusting portion 52, and discharges it through discharge opening 21*a*.

The structure for drive transmission to the pump portion 20*b* in this example will be described.

As described in the foregoing, the cylindrical portion 20*k* rotates when the gear portion 20*a* provided on the cylindrical portion 20*k* receives the rotation force from the driving gear 300. In addition, the rotation force is transmitted to the gear portion 43 through the gear portion 42 provided on the small diameter portion 49 of the cylindrical portion 20*k*. Here, the gear portion 43 is provided with a shaft portion 44 integrally rotatable with the gear portion 43.

One end of shaft portion 44 is rotatably supported by the housing 46. The shaft 44 is provided with an eccentric cam 45 at a position opposing the pump portion 20*b*, and the eccentric cam 45 is rotated along a track with a changing distance from the rotation axis of the shaft 44 by the rotational force transmitted thereto, so that the pump portion 20*b* is pushed down (reduced in the volume). By this, the developer in the nozzle portion 47 is discharged through the discharge opening 21*a*.

When the pump portion 20*b* is released from the eccentric cam 45, it restores to the original position by its restoring force (the volume expands). By the restoration of the pump portion (increase of the volume), suction operation is effected through the discharge opening 21*a*, and the developer existing in the neighborhood of the discharge opening 21*a* can be loosened.

By repeating the operations, the developer is efficiently discharged by the volume change of the pump portion 20*b*. As described in the foregoing, the pump portion 20*b* may be provided with an urging member such as a spring to assist the restoration (or pushing down).

The hollow conical nozzle portion 47 will be described. The nozzle portion 47 is provided with an opening 53 in a outer periphery thereof, and the nozzle portion 47 is provided at its free end with an ejection outlet 54 for ejecting the developer toward the discharge opening 21*a*.

In the developer supplying step, at least the opening 53 of the nozzle portion 47 can be in the developer layer in the supply amount adjusting portion 52, by which the pressure produced by the pump portion 20*b* can be efficiently applied to the developer in the supply amount adjusting portion 52.

That is, the developer in the supply amount adjusting portion 52 (around the nozzle 47) functions as a partitioning mechanism relative to the cylindrical portion 20*k*, so that the effect of the volume change of the pump 20*b* is applied to the limited range, that is, within the supply amount adjusting portion 52.

With such structures, similarly to the partitioning mechanisms of Embodiments 17-19, the nozzle portion 47 can provide similar effects.

As described in the foregoing, also in this embodiment, one pump is enough to effect the suction operation and the discharging operation, and therefore, the structure of the developer discharging mechanism can be simplified. Furthermore, by the suction operation through the discharge opening 21*a*, the decompressed state (negative pressure state) can be provided in the developer supply container, and therefore, the developer can be efficiently loosened.

In addition, in this example, similarly to Embodiments 5-19, by the rotational force received from the developer replenishing apparatus 8, both of the rotating operations of the developer accommodating portion 20 (cylindrical portion 20*k*) and the reciprocation of the pump portion 20*b* are effected. Similarly to Embodiments 17-19, the pump portion 20*b* and/or flange portion 21 may be made common to the advantages.

According to this example, the developer and the partitioning mechanism are not in sliding relation as in Embodiments 17-18, and therefore, the damage to the developer can be suppressed.

Comparison Example

Referring to FIG. 67, a comparison example will be described. Part (a) of FIG. 67 is a sectional view illustrating a state in which the air is fed into a developer supply container 150, part (b) of FIG. 67 is a sectional view illustrating a state in which the air (developer) is discharged from the developer supply container 150. Part (c) of FIG. 67 is a sectional view illustrating a state in which the developer is fed into a hopper 8*g* from a containing portion 123, and part (d) of FIG. 67 is a sectional view illustrating a state in which the air is taken into the containing portion 123 from the hopper 8*g*. In the comparison example, the same reference numerals as in the foregoing embodiments are assigned to the elements having the similar functions in this example, and the detailed description thereof is omitted for simplicity.

In this comparison example, a pump for suction and discharging, more particularly a displacement type pump 122 is provided on the developer replenishing apparatus 180 side.

The developer supply container 150 of this comparison example is not provided with the pump 2 and the locking portion 3 of the developer supply container 1 shown in FIG. 9 of Embodiment 1, and in place thereof, the upper surface of the container body 1*a* which is the connecting portion with the pump 2 is closed. In other words, the developer supply container 150 includes the container body 1*a*, the discharge opening 1*c*, the flange portion 1*g*, the sealing member 4 and the shutter 5 (omitted in FIG. 67). the developer replenishing apparatus 180 of this comparison example is not provided with locking member 9 and the mechanism for driving the locking member 9 of the developer replenishing apparatus 8 shown in FIGS. 3, 5 of Embodiment 1, and in place thereof, a pump, a containing portion, a valve mechanism and so on which will be described hereinafter are added.

More particularly, the developer replenishing apparatus 180 is provided with a bellow-like pump 122 of a displacement type for suction and discharging, and a containing portion 123 provided between the developer supply container 150 and the hopper 8*g* to temporarily accumulate the developer discharged from the developer supply container 150.

To the containing portion 123, a supply pipe portion 126 for connection with the developer supply container 150 and a supply pipe portion 127 for connection with the hopper 8*g* are connected. For the pump 122, reciprocation (expanding-and-contracting operation) is effected by a pump driving mechanism provided on the developer replenishing apparatus 180.

The developer replenishing apparatus 180 is includes a valve 125 provided in a connecting portion between the containing portion 123 and the developer supply container 150 side supply pipe portion 126, and a valve 124 provided in a connecting portion between the containing portion 123 and the hopper 8*g* side supply pipe portion 127. These valves 124, 125 are opened and closed by solenoid valves as valve driving mechanisms provided in the developer replenishing apparatus 180.

Developer discharging steps in the structure of the comparison example including the pump 122 in the developer replenishing apparatus 180 side will be described.

As shown in part (a) of FIG. 67, the valve driving mechanisms are actuated to close the valve 124 and open the valve 125. In this state, the pump 122 is contracted by the pump driving mechanism. At this time, the contracting operation of the pump 122 increases an internal pressure of the containing portion 123, so that the air is fed into the developer supply container 150 from the containing portion 123. As a result, the developer adjacent to the discharge opening 1*c* in the developer supply container 150 is loosened.

While keeping the state in which the valve 124 is closed, and the valve 125 is opened as shown in part (b) of FIG. 67, the pump 122 is expanded by the pump driving mechanism. At this time, by the expanding operation of the pump 122, the internal pressure of the containing portion 123 decreases, and the pressure of the air layer in the developer supply container 150 increases relatively. By the pressure difference between the containing portion 123 and the developer supply container 150, the air in the developer supply container 150 is discharged into the containing portion 123. By this, the developer is discharged with the air through the discharge opening 1*c* of the developer supply container 150, and is temporarily accumulated in the containing portion 123.

As shown in part (c) of FIG. 67, the valve driving mechanisms are operated to open the valve 124 and to close the valve 125. In this state, the pump 122 is contracted by the pump driving mechanism. At the, by the contracting operation of the pump 122, the internal pressure of the containing portion 123 increases, and the developer in the containing portion 123 is fed into the hopper 8*g*.

Then, while keeping the state in which the valve 124 is opened, and the valve 125 is closed, as shown in part (d) of FIG. 67, the pump 122 is expanded by the pump driving mechanism. At this time, by the expanding operation of the pump 122, the internal pressure of the containing portion 123 decreases, and the air is taken into the containing portion 123 from the hopper 8*g*.

By repeating the steps of parts (a)-(d) of FIG. 67 described above, the developer can be discharged through the discharge opening 1*c* of the developer supply container 150 while fluidizing the developer in the developer supply container 150.

However, with the structure of the comparison example, the valves 124, 125 and the valve driving mechanisms for controlling opening and closing of the valves, as shown in parts (a)-(d) of FIG. 67 are required. Thus, the control for the opening and closing of the valve is complicated in the structure of the comparison example. In addition, there is a high possibility that the developer may be bitten between the valve and the seat to which the valve abuts, with the result of a stress to the developer and therefore agglomerated mass. In such a state, the opening and closing operation of the valves cannot be properly performed, and as a result, no stable discharging of the developer for a long term cannot be expected.

In addition, in the comparison example, the internal pressure of the developer supply container 150 becomes positive by the air supply from the outside of the developer supply container 150 with the result of agglomeration of the developer, and therefore, the developer loosening effect is very slight as demonstrated in the above-described verification experiment (comparison between FIG. 20 and FIG. 21). Thus, the foregoing Embodiments 1-20 of the present invention is preferable since the developer can be sufficiently loosened and discharged from the developer supply container.

As shown in FIG. 68, it would be considered that the suction and discharging is effected by forward and backward rotations of a rotor 401 of a single shaft eccentric pump 400 used in place of the pump 122. However, in such a case, the developer discharged from the developer supply container 150 is subjected to a stress due to the rubbing between the rotor 401 and the stator 402, with the result of production of an agglomeration mass, which may adversely affect the image quality.

As described in the foregoing, the structure of the embodiments of the present invention in which the pump for the suction and discharging is provided in the developer supply container 1 is advantageous in that the developer discharging mechanism is simplified using the air than in the comparison example. In the structures of the foregoing embodiments of the present invention, the stress applied to the developer is smaller than in the comparison example of FIG. 68.

INDUSTRIAL APPLICABILITY

According to the first and second inventions, the developer in the developer supply container C2 loosened by making the internal pressure of the developer supply container a negative pressure by the pump portion.

According to the third and fourth inventions, the developer in the developer supply container can be properly loosened by a suction operation through the discharge opening of the developer supply container by the pump portion.

According to the fifth and sixth inventions, the developer in the developer supply container can be properly loosened by producing inward and outward flows through the pin hole by the air flow producing mechanism.

The invention claimed is:

1. A toner supply container comprising:

a casing accommodating toner and including a discharge opening, the discharge opening having an area of not more than 12.6 $mm^2$ and being configured to permit discharging of the toner from the casing;

a pump configured to alternately generate (i) a first air flow from outside to inside of the toner supply container and (ii) a second air flow from inside to outside of the toner supply container, the pump being configured to supply the toner from the discharge opening to outside of the toner supply container with the second air flow;

a rotational force receiving portion configured to receive a rotational force from outside of the toner supply container, the rotational force receiving portion being configured to drive the pump with rotation of the rotational force receiving portion, and a feeding portion provided in the casing and configured to feed the toner toward the discharge opening.

2. A toner supply container according to claim 1, wherein the rotational force receiving portion is a coupling portion.

3. A toner supply container according to claim 2, wherein the coupling portion includes a projection configured to receive the rotational force from outside of the toner supply container.

4. A toner supply container according to claim 1, wherein the rotational force receiving portion is a gear.

5. A toner supply container according to claim 1, wherein the discharge opening is provided at a bottom portion of the casing.

6. A toner supply container according to claim 1, wherein the rotational force receiving portion is configured to drive the pump and the feeding portion with the rotation of the rotational force receiving portion.

7. A toner supply container according to claim 1, wherein the feeding portion is rotatable.

8. A toner supply container according to claim 1, wherein the feeding portion is integral with the casing.

9. A toner supply container according to claim 1, wherein the feeding portion includes helical projection formed in an inner peripheral surface of the casing.

10. A toner supply container according to claim 1, wherein the feeding portion is movable relative to the casing.

11. A toner supply container according to claim 1, wherein the feeding portion has a helical shape.

12. A toner supply container according to claim 1, wherein the pump is a displacement type pump having a volume that changes with reciprocation of the pump.

13. A toner supply container according to claim 1, wherein the pump is a flexible bellow-like pump.

14. A toner supply container according to claim 1, further comprising a drive converting portion configured to convert the rotational force received from the rotational force receiving portion to a force for driving the pump.

15. A toner supply container according to claim 1, wherein the pump is configured to alternately change an internal pressure of the casing between a pressure lower than an ambient pressure and a pressure higher than the ambient pressure.

16. A toner supply container according to claim 15, wherein the pressure that is lower than the ambient pressure causes air to enter into the casing through the discharge opening, and the pressure that is higher than the ambient pressure causes the toner to be discharged out of the casing through the discharge opening.

17. A toner supply container according to claim 1, wherein the toner accommodated in the casing has a fluidity energy of not less than $4.3\times10^{-4}$ kg·m$^2$/s$^2$ and not more than $4.14\times10^{-3}$ kg·m$^2$/s$^2$.

18. A toner supply container according to claim 1, wherein the casing includes a toner accommodating chamber accommodating the toner and a toner discharge chamber provided with the discharge opening.

19. An image forming apparatus comprising:

a main assembly of the image forming apparatus, the main assembly including a mounting portion, a rotatable driver, and a receiving opening; and a toner supply container according to claim 1, wherein the toner supply container is detachably mountable to the mounting portion and configured to discharge the toner from the discharge opening to the receiving opening, and wherein the rotational force receiving portion is configured to receive the rotational force from the driver by engaging with the driver.

20. A toner supply container comprising:

a casing accommodating toner and including a discharge opening, the discharge opening having an area of not more than 12.6 mm$^2$ and being configured to permit discharging of the toner from the casing;

a pump configured to alternately generate (i) a first air flow in a direction from outside to inside of the toner supply container and (ii) a second air flow in a direction from inside to outside of the toner supply container, the second air flow being such that sufficient pressure is generated to move the toner from the casing through the discharge opening to outside of the toner supply container; and a rotational force receiving portion configured to receive a rotational force from outside of the toner supply container, the rotational force receiving portion being configured to drive the pump with rotation of the rotational force receiving portion, and a feeding portion provided in the casing and configured to feed the toner toward the discharge opening.

* * * * *